US011414764B2

(12) United States Patent
Khaled et al.

(10) Patent No.: US 11,414,764 B2
(45) **Date of Patent: *Aug. 16, 2022**

(54) METHOD OF INHIBITING METAL CORROSION WITH A PIPERAZINE-BASED POLYUREA

(71) Applicant: KING FAHD UNIVERSITY OF PETROLEUM AND MINERALS, Dhahran (SA)

(72) Inventors: Mazen Khaled, Dhahran (SA); Abdulaziz A. Al-Saadi, Dhahran (SA); Ismail Abdulazeez, Dhahran (SA); Othman Al-Hamouz, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/654,568

(22) Filed: Oct. 16, 2019

(65) Prior Publication Data

US 2021/0115570 A1 Apr. 22, 2021

(51) Int. Cl.
*C23F 11/14* (2006.01)

(52) U.S. Cl.
CPC ..... *C23F 11/149* (2013.01)

(58) Field of Classification Search
CPC ..... C23F 11/149; C23F 11/04; C23F 11/173
See application file for complete search history.

(56) References Cited

U.S. PATENT DOCUMENTS

| | | | | |
|---|---|---|---|---|
| 2,975,157 | A * | 3/1961 | Katz | C08G 18/3246 528/52 |
| 3,691,225 | A * | 9/1972 | Kamal | C07C 265/00 560/357 |
| 3,893,956 | A * | 7/1975 | Brandt | C08G 18/3225 524/211 |
| 7,611,772 | B2 | 11/2009 | Barancyk et al. | |
| 8,920,714 | B2 | 12/2014 | Kelley, II | |
| 2013/0040128 | A1* | 2/2013 | Boddie | C08G 18/10 428/319.3 |
| 2014/0023553 | A1* | 1/2014 | Kelly, II | C08G 18/40 422/9 |
| 2014/0116708 | A1* | 5/2014 | Wadekar | C09K 8/74 166/307 |

(Continued)

OTHER PUBLICATIONS

Ashok Chaudhari, et al., "Development of anticorrosive two pack polyurethane coatings based on modified fatty amide of *Azadirachta indica juss* oil cured at room temperature—A sustainable resource", RSC Advances, vol. 4, Issue 34, Apr. 2014, pp. 17866-17872.

(Continued)

*Primary Examiner* — Pamela H Weiss
(74) *Attorney, Agent, or Firm* — Oblon, McClelland, Maier & Neustadt, L.L.P.

(57) ABSTRACT

A method of inhibiting corrosion of metal in contact with a corrosive medium in an oil or gas field environment, whereby a formulation containing a polyurea is introduced into the corrosive medium in contact with the metal, wherein the polyurea is formed from a polymerization reaction between a piperazine having at least two reactive amine groups and a diisocyanate. The polyurea is introduced into the corrosive medium at a concentration of 1 to 250 ppm.

18 Claims, 28 Drawing Sheets

(56) References Cited

U.S. PATENT DOCUMENTS

| | | | | |
|---|---|---|---|---|
| 2017/0325448 | A1* | 11/2017 | Shukla | A01N 25/28 |
| 2018/0244973 | A1* | 8/2018 | Miller | C09K 8/36 |
| 2018/0346793 | A1* | 12/2018 | Al-Zoraia | C09K 8/52 |

OTHER PUBLICATIONS

Liangfu Zheng, et al., "Corrosion Benefits of Piperazine as an Alternative $CO_2$ Capture Solvent", Industrial & Engineering Chemistry Research, vol. 53, No. 29, Jun. 30, 2014, pp. 11740-11746.

* cited by examiner

METHOD OF INHIBITING METAL CORROSION WITH A PIPERAZINE-BASED POLYUREA

BACKGROUND OF THE INVENTION

Technical Field

The present disclosure relates to methods of inhibiting corrosion of metal in an oil or gas field environment with a polyurea formed from a piperazine and a polyfunctional isocyanate.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Corrosion of metals and alloys is a significant challenge facing the oil and gas industries. Over 50% of pipeline failures have been linked to pipeline corrosion. See Q. Sheng, K. C. d. Silveira, W. Tian, C. Fong, N. Maeda, R. Gubner, C. D. Wood, Simultaneous Hydrate and Corrosion Inhibition with Modified Poly(vinyl caprolactam) Polymers, Energy & Fuels, 31 (2017) 6724-6731, incorporated herein by reference in its entirety. In most of the reported cases, corrosion is caused by fluids flowing through the pipeline containing organic acids, brine and gases such as hydrogen sulfide and carbon dioxide. See J. J. Moloney, W. Y. Mok, C. G. Gamble, Compatible Corrosion And Kinetic Hydrate Inhibitors For Wet Sour Gas Transmission Lines, in: CORROSION 2009, NACE International, Atlanta, Ga., 2009, pp. 23; and C. I. Ossai, B. Boswell, T. J. Davies, Pipeline failures in corrosive environments—A conceptual analysis of trends and effects, Engineering Failure Analysis, 53 (2015) 36-58, each incorporated herein by reference in their entirety. Deterioration of pipeline due to corrosion often leads to severe economic and environmental consequences and sometimes leads to shutdown of oil production facilities. Hence, the fabrication of effective corrosion inhibitors that are able to protect against metallic corrosion while maintaining fluid flow has been the subject of many reported studies in recent years. See M. Askari, M. Aliofkhazraei, S. Ghaffari, A. Hajizadeh, Film former corrosion inhibitors for oil and gas pipelines—A technical review, Journal of Natural Gas Science and Engineering, 58 (2018) 92-114; Q. Li, H. Hu, Y. F. Cheng, Corrosion of pipelines in $CO_2$-saturated oil-water emulsion flow studied by electrochemical measurements and computational fluid dynamics modeling, Journal of Petroleum Science and Engineering, 147 (2016) 408-415; and W. Li, B. F. M. Pots, X. Zhong, S. Nesic, Inhibition of CO2 corrosion of mild steel—Study of mechanical effects of highly turbulent disturbed flow, Corrosion Science, 126 (2017) 208-226, each incorporated herein by reference in their entirety.

Organic compounds having electron-rich heteroatoms, such as sulfur, nitrogen and oxygen, aromatic fragments or multiple bonds, are commonly used for anti-corrosion applications due to their ability to adsorb and displace water molecules on the surface of the metal to form protective barriers in situ against corrosion. See A. Zeino, I. Abdulazeez, M. Khaled, M. W. Jawich, I. B. Obot, Mechanistic study of polyaspartic acid (PASP) as eco-friendly corrosion inhibitor on mild steel in 3% NaCl aerated solution, Journal of Molecular Liquids, (2017); X. Zheng, M. Gong, Q. Li, L. Guo, Corrosion inhibition of mild steel in sulfuric acid solution by loquat (*Eriobotrya japonica* Lindl.) leaves extract, Scientific Reports, 8 (2018) 9140; D. Gopi, E.-S. M. Sherif, M. Surendiran, M. Jothi, P. Kumaradhas, L. Kavitha, Experimental and theoretical investigations on the inhibition of mild steel corrosion in the ground water medium using newly synthesised bipodal and tripodal imidazole derivatives, Materials Chemistry and Physics, 147 (2014) 572-582; and A. Ismail, H. M. Irshad, A. Zeino, I. H. Toor, Electrochemical Corrosion Performance of Aromatic Functionalized Imidazole Inhibitor Under Hydrodynamic Conditions on API X65 Carbon Steel in 1 M HCl Solution, Arabian Journal for Science and Engineering, (2019), each incorporated herein by reference in their entirety. Several organic molecules having imidazole, pyridine, triazole, benzimidazole, quinoline, cationic ammonium salts and schiff base moieties have been reported for anti-corrosion applications. See M. B. Petrović Mihajlović, M. B. Radovanović, . Z. Tasić, M. M. Antonijević, Imidazole based compounds as copper corrosion inhibitors in seawater, Journal of Molecular Liquids, 225 (2017) 127-136; I. Abdulazeez, A. Zeino, C. W. Kee, A. A. Al-Saadi, M. Khaled, M. W. Wong, A. A. Al-Sunaidi, Mechanistic studies of the influence of halogen substituents on the corrosion inhibitive efficiency of selected imidazole molecules: A synergistic computational and experimental approach, Applied Surface Science, 471 (2019) 494-505; K. R. Ansari, M. A. Quraishi, A. Singh, Pyridine derivatives as corrosion inhibitors for N80 steel in 15% HCl: Electrochemical, surface and quantum chemical studies, Measurement, 76 (2015) 136-147; B. D. Mert, M. Erman Mert, G. Kardaş, B. Yazici, Experimental and theoretical investigation of 3-amino-1,2,4-triazole-5-thiol as a corrosion inhibitor for carbon steel in HCl medium, Corrosion Science, 53 (2011) 4265-4272; J. Aljourani, M. A. Golozar, K. Raeissi, The inhibition of carbon steel corrosion in hydrochloric and sulfuric acid media using some benzimidazole derivatives, Materials Chemistry and Physics, 121 (2010) 320-325; V. V. Gite, P. D. Tatiya, R. J. Marathe, P. P. Mahulikar, D. G. Hundiwale, Microencapsulation of quinoline as a corrosion inhibitor in polyurea microcapsules for application in anticorrosive PU coatings, Progress in Organic Coatings, 83 (2015) 11-18; M. A. Hegazy, M. Abdallah, M. K. Awad, M. Rezk, Three novel di-quaternary ammonium salts as corrosion inhibitors for API X65 steel pipeline in acidic solution. Part I: Experimental results, Corrosion Science, 81 (2014) 54-64; and J. Haque, V. Srivastava, D. S. Chauhan, H. Lgaz, M. A. Quraishi, Microwave-Induced Synthesis of Chitosan Schiff Bases and Their Application as Novel and Green Corrosion Inhibitors: Experimental and Theoretical Approach, ACS Omega, 3 (2018) 5654-5668, each incorporated herein by reference in their entirety. Large polymeric compounds are another class reported to possess corrosion inhibition activity. See R. Baskar, D. Kesavan, M. Gopiraman, K. Subramanian, Corrosion inhibition of mild steel in 1.0M hydrochloric acid medium by new photo-cross-linkable polymers, Progress in Organic Coatings, 77 (2014) 836-844; and Y. Ren, Y. Luo, K. Zhang, G. Zhu, X. Tan, Lignin terpolymer for corrosion inhibition of mild steel in 10% hydrochloric acid medium, Corrosion Science, 50 (2008) 3147-3153, each incorporated herein by reference in their entirety. Due to the presence of multiple functional groups in the polymer network, they are able to form stronger complex interactions which result in the coverage of a large area on the surface of the metal. Organic polymers containing urethane, aniline, pyrrole, imide and urea repeating units among others have been investigated and have shown anti-corrosion properties. See S. Banerjee, A. Mishra, M. M. Singh, B. Maiti, B. Ray, P. Maiti, Highly efficient polyurethane ionomer corrosion inhibitor: the effect of chain structure, RSC Advances, 1 (2011) 199-210; G. Qu, F. Li, E. B. Berda, M. Chi, X. Liu, C. Wang, D. Chao, Electroactive polyurea bearing oligoaniline pendants: Electrochromic and anticorrosive properties, Polymer, 58 (2015) 60-66; M. Menkuer, H. Ozkazanc, Electrodeposition of polypyrrole on copper surfaces in OXA-DBSA mix electrolyte and their corrosion behaviour, Progress in Organic Coatings, 130 (2019) 149-157; C.-L. Xu, Y.-Z. Wang, Durability, anti-corrosion and self-clean in air/oil of a transparent superhydrophobic polyimide film, Applied Materials Today, 10 (2018) 18-23; and K.-Y. Chen, Y.-S. Lai, J.-K. You, K. S. Santiago, J.-M. Yeh, Effective anticorrosion coatings prepared from sulfonated electroactive polyurea, Polymer, 166 (2019) 98-107, each incorporated herein by reference in their entirety.

Among this class of polymeric compounds, the interest in polyureas as corrosion inhibitors relates to their use as protective coatings against various media due to their high thermal and chemical resistance, water proofing properties, abrasion resistance, and structural diversity. See K. W. Allen, S. M. Smith, W. C. Wake, A. O. van Raalte, The concept of an endurance limit for adhesive joints, International Journal of Adhesion and Adhesives, 5 (1985) 23-32, L. Feng, J. O. Iroh, Corrosion resistance and lifetime of polyimide-b-polyurea novel copolymer coatings, Progress in Organic Coatings, 77 (2014) 590-599; P. D. Tatiya, P. P. Mahulikar, V. V. Gite, Designing of polyamidoamine-based polyurea microcapsules containing tung oil for anticorrosive coating applications, Journal of Coatings Technology and Research, 13 (2016) 715-726; K. Wazarkar, M. Kathalewar, A. Sabnis, High performance polyurea coatings based on cardanol, Progress in Organic Coatings, 106 (2017) 96-110; and F. Maia, K. A. Yasakau, J. Carneiro, S. Kallip, J. Tedim, T. Henriques, A. Cabral, J. Venâncio, M. L. Zheludkevich, M. G. S. Ferreira, Corrosion protection of AA2024 by sol-gel coatings modified with MBT-loaded polyurea microcapsules, Chemical Engineering Journal, 283 (2016) 1108-1117, each incorporated herein by reference in their entirety. For example, Feng et al. reported the corrosion resistance of a polyimide-b-polyurea copolymer coating on Al 2024-T3 aluminum alloy in saline media. Tatiya at al. studied the anti-corrosion properties of a self-healing polyurea microcapsule coating containing tung oil in saturated saline media. Kunal et al. reported the corrosion inhibitive performance of polyurea coatings based on cardanol using salt spray tests on mild steel. Maia et al. reported the corrosion protection of AA 2024 aluminum alloy in saline media by using mercaptobenzothiazole-loaded polyurea microcapsules. However, application of protective coatings is an expensive process as it requires either shutting down the production system to apply the coating or coating all of the piping prior to installation. Moreover, it is practically impossible to coat the pipeline when it is already corroded and filled with petroleum products. Thus, one of the best corrosion mitigation strategies is to design corrosion inhibitors that are soluble in aqueous media and that can be injected continuously into the pipeline flow streams to serve as protective barriers against corrosives.

In view of the forgoing, one objective of the present disclosure is to provide methods of inhibiting the corrosion of a metal in contact with a corrosive medium using a piperazine-based polyurea that can be directly introduced into the corrosive medium, particularly into corrosive media at the high temperatures common to oil and gas field settings where corrosion is usually most severe.

BRIEF SUMMARY OF THE INVENTION

Thus, the present disclosure provides a method of inhibiting corrosion of metal in contact with a corrosive medium e.g., in an oil or gas field environment, the method involving introducing a formulation containing a polyurea into the corrosive medium in contact with the metal, wherein the polyurea comprises reacted units of a piperazine having at least two reactive amine groups and a diisocyanate, and wherein the polyurea is introduced into the corrosive medium at a concentration of 1 to 250 ppm.

In some embodiments, the piperazine is at least one selected from the group consisting of piperazine, 2-methylpiperazine, 2-ethylpiperazine, 2,3-dimethylpiperazine, 2,2-dimethylpiperazine, 2,5-dimethylpiperazine, 2,6-dimethylpiperazine, and 1-(2-aminoethyl)piperazine.

In some embodiments, the piperazine is piperazine

In some embodiments, the diisocyanate is toluene 2,4-diisocyanate, toluene 2,6-diisocyanate, or a mixture of toluene 2,4-diisocyanate and toluene 2,6-diisocyanate, and when the diisocyanate is the mixture, a molar ratio of the toluene 2,4-diisocyanate to the toluene 2,6-diisocyanate is 1:1 to 50:1.

In some embodiments, the polyurea is formed with a molar ratio of the piperazine to the diisocyanate of 1:1 to 4:1.

In some embodiments, the polyurea has a weight average molecular weight of 20 to 30 kDa and a polydispersity index of 1.1 to 1.8.

In some embodiments, the polyurea is in the form of microparticles having an average diameter of 10 to 50 μm.

In some embodiments, the microparticles are macroporous with an average macropore size of 400 to 600 nm.

In some embodiments, the microparticles have a BET surface area of 30 to 350 $m^2/g$.

In some embodiments, the formulation further includes at least one polar aprotic solvent selected from the group consisting of N-methyl-2-pyrrolidone, dimethylformamide, dimethyl sulfoxide, and 1,3-dimethyl-2-imidazolidinone, and a volume ratio of the polar aprotic solvent to the corrosive medium is 1:80 to 1:200.

In some embodiments, the formulation further includes at least one additive selected from the group consisting of a viscosity modifying agent, a chelating agent, a stabilizing agent, a dispersing agent, a supplemental corrosion inhibitor, a scale inhibitor, a defoaming agent, and an emulsifier.

In some embodiments, the formulation is substantially free of a binder.

In some embodiments, the metal is not pre-coated with the formulation.

In some embodiments, the metal is mild steel.

In some embodiments, the corrosive medium has a pH of 0 to 7.

In some embodiments, the corrosive medium contains at least one acid selected from the group consisting of hydrochloric acid, sulfuric acid, nitric acid, hydrofluoric acid, acetic acid, and formic acid.

In some embodiments, the corrosive medium contains carbon dioxide.

In some embodiments, the corrosive medium has a total dissolved solids content of 10,000 to 400,000 mg/L.

In some embodiments, the corrosive medium is a water-oil mixture.

In some embodiments, the corrosive medium has a temperature of 20 to 80° C.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
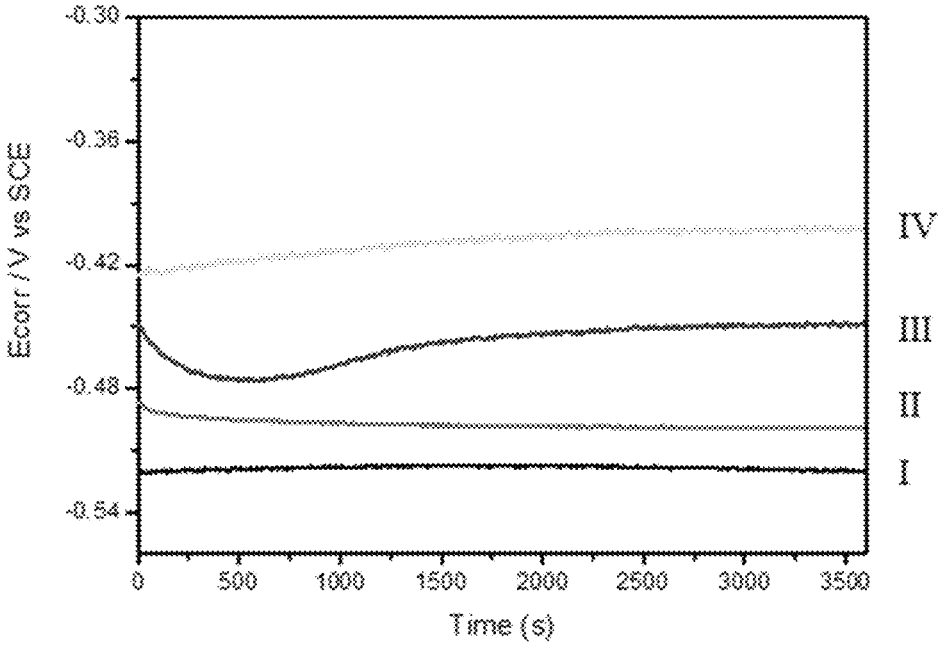
FIGS. 1A-1B are graphs illustrating the open circuit potential plots of a mild steel specimen immersed in (FIG. 1A) 1.0 M HCl and (FIG. 1B) 0.5 M NaCl in (I) the absence of inhibitor and the presence of (II) 20 ppm, (111) 50 ppm and (IV) 100 ppm PUCorr-2 at 25° C.

Embodiments of the present disclosure will now be described more fully hereinafter with reference to the accompanying drawings, in which some, but not all embodiments of the disclosure are shown.

Definitions

As used herein, the term "fatty" describes a compound with a long-chain (linear) hydrophobic portion made up of hydrogen and anywhere from 8 to 26 carbon atoms, which may be fully saturated or partially unsaturated, and optionally attached to a polar functional group such as a hydroxyl group, an amine group, or a carboxyl group (e.g., carboxylic acid). Fatty alcohols, fatty amines, fatty acids, fatty esters, and fatty amides are examples of materials which contain a fatty portion, and are thus considered "fatty" compounds herein. For example, stearic acid, which has 18 carbons total (a fatty portion with 17 carbon atoms and 1 carbon atom from the —COOH group), is considered to be a fatty acid having 18 carbon atoms herein.

As used herein, "alkoxylated" or "alkoxylate" refers to compounds containing a polyether group (i.e., polyoxyalkylene group) derived from oligomerization or polymerization of one or more alkylene oxides having 2 to 4 carbon atoms, and specifically includes polyoxyethylene (derived from ethylene oxide), polyoxypropylene (derived from propylene oxide), and polyoxybutylene (derived from butylene oxide), as well as mixtures thereof.

The phrase "substantially free", unless otherwise specified, describes a particular component being present in an amount of less than about 1 wt. %, preferably less than about 0.5 wt. %, more preferably less than about 0.1 wt. %, even more preferably less than about 0.05 wt. %, yet even more preferably less than about 0.01 wt. %, yet even more preferably 0 wt. %, relative to a total weight of the composition being discussed.

As used herein, the terms "optional" or "optionally" means that the subsequently described event(s) can or cannot occur or the subsequently described component(s) may or may not be present (e.g., 0 wt. %).

The term "alkyl", as used herein, unless otherwise specified, refers to a straight, branched, or cyclic, aliphatic fragment having 1 to 26, preferably 8 to 22, and more preferably 12 to 18 carbon atoms. Non-limiting examples include, but are not limited to, methyl, ethyl, propyl, isopropyl, butyl, isobutyl, t-butyl, pentyl, isopentyl, neopentyl, hexyl, isohexyl, 3-methylpentyl, 2,2-dimethylbutyl, 2,3-dimethylbutyl, lauryl, myristyl, cetyl, stearyl, and the like, including guerbet-type alkyl groups (e.g., 2-methylpentyl, 2-ethylhexyl, 2-proylheptyl, 2-butyloctyl, 2-pentylnonyl, 2-hexyldecyl, 2-heptylundecyl, 2-octyldodecyl, 2-nonyltridecyl, 2-decyltetradecyl, and 2-undecylpentadecyl), as well as unsaturated alkenyl and alkynyl variants such as vinyl, allyl, 1-propenyl, 2-propenyl, 1-butenyl, 2-butenyl, 3-butenyl, 1-pentenyl, 2-pentenyl, 3-pentenyl, 4-pentenyl, 1-hexenyl, 2-hexenyl, 3-hexenyl, 4-hexenyl, 5-hexenyl, oleyl, linoleyl, and the like. Optionally substituted alkyl groups are also included in the definition of alkyl. As used herein, "optionally substituted" means that at least one hydrogen atom is replaced with a non-hydrogen group, provided that normal valencies are maintained and that the substitution results in a stable compound. Such optional substituents may include, but are not limited to, aryl, alkoxy, aryloxy, arylalkyloxy, aroyl, alkanoyl, alkanoyloxy, carboxy, alkoxycarbonyl, hydroxy, halo (e.g. chlorine, bromine, fluorine or iodine), amino (e.g. alkylamino, arylamino, arylalkylamino, alkanoylamino, either mono- or disubstituted), oxo, amido (e.g. —$CONH_2$, —CONHalkyl, —CONHaryl, —CONHarylalkyl or cases where there are two substituents on one nitrogen), and the like. For example, ethanolamine is considered to be an alkyl amine compound in the present disclosure because it contains an amine group attached to an optionally substituted alkyl group (i.e., a primary amine bonded to a hydroxy-substituted ethyl group). Further, any alkyl and/or aryl groups present in these optional substituents may also optionally be substituted, for example the alkyl group of an alkylamino substituent may also be optionally substituted, as defined above.

As used herein, "inhibit" means to lessen or reduce an amount of, or to prevent, retard, slow, hinder, delay an undesirable process from occurring, or combinations thereof.

As used herein the term "corrosion inhibitor" refers to a substance(s) that lessens or reduces an amount of, and/or that prevents, retards, slows, hinders, delays the deterioration of a metal surface by oxidation or other chemical reaction. Corrosive substances that can cause corrosion, particularly of metal surfaces used during the production, recovery, transportation, storage and refining of hydrocarbons or various natural gases, include water with high salt contents, acidic inorganic compounds such as inorganic acids, carbon dioxide ($CO_2$) or hydrogen sulfide ($H_2S$), natural organic acids, and microorganisms. Preferred corrosion inhibitors of the present invention inhibit the destructive effect such substances have on various metal surfaces.

As used herein, "produced water" refers to the aqueous fluid which flows back from the subterranean formation as a byproduct along with oil/gas. Produced water typically has a very high salt content.

As used herein, "mesoporous" materials are those containing mesopores, that is, pores with a diameter between 2 to 50 nm. As used herein, "microporous" materials are those containing micropores, that is, pores with a diameter less than 2 nm. On the other hand, "macroporous" materials are those containing macropores, that is, pores with a diameter greater than 50 nm. A material which possesses two or more types of pore sizes (e.g., micropores and mesopores) is said to be a "hierarchical" material in the present disclosure.

As used herein, "crosslinking", "cross-linking", "cross-linked", "cross-linked", a "crosslink", or a "cross-link" refers to polymer matrixes containing branches that connect polymer chains via bonds that link one polymer chain to another.

As used herein, "reactive amine groups" are those which are capable of reacting with an isocyanate group, either catalyzed or uncatalyzed, to form a urea linkage. Reactive amine groups are thus generally those which are primary or secondary amines, and which are solvent accessible or sterically unencumbered to an extent that allows for urea formation.

Formulation

The present disclosure generally relates to methods of inhibiting corrosion of metal in contact with a corrosive medium in an oil or gas field environment, for example in transportation (e.g., by pipeline), processing, storage, and distribution of produced oil/gas containing mixtures. The method generally involves use of a formulation that contains or consists of a polyurea (as a corrosion inhibitor), and optionally an organic solvent, a surfactant, and/or an additive(s).

Polyurea

Polyurea refers to a polymerization product from the reaction of a suitable polyfunctional isocyanate monomer (a monomer containing at least 2 isocyanate moieties) with a suitable polyfunctional amine monomer (a monomer containing at least 2 reactive amine groups). The polymerization provides urea or carbamide linkages (—NH—CO—NH—) between isocyanate and amine moieties of the polyurea network. The polyurea of the present disclosure comprises, consists essentially of, or consists of reacted units of a piperazine having at least two reactive amine groups (as the suitable polyfunctional amine monomer) and a polyfunctional isocyanate. A general (and most basic) piperazine structure is presented below.

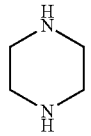

piperazine

Preferably, the isocyanate and the piperazine monomers used herein are each di-functional, i.e., have two reactive sites (e.g. a diisocyanate, and in the case of the piperazine, two amino groups capable of reacting with an isocyanate group).

As used herein a "copolymer" refers to a polymer derived from more than one species of monomer and are obtained by "copolymerization" of more than one species of monomer. Copolymers obtained by copolymerization of two monomer and/or oligomer species may be termed bipolymers, those obtained from three monomers may be termed terpolymers and those obtained from four monomers may be termed quarterpolymers, etc. In some embodiments, the polyurea of the present disclosure is a terpolymer, for example a terpolymer obtained from reaction between a mixture of two diisocyanate monomers and a single piperazine monomer. When the polyurea is formed using two or more types of polyfunctional isocyanate monomers, a molar ratio of the two types of polyfunctional isocyanate monomers may range from 1:50 to 50:1, or 1:40 to 40:1, or 1:30 to 30:1, or 1:20 to 20:1, or 1:10 to 10:1, or 1:5 to 5:1, or 1:3 to 3:1, or 1:2 to 2:1, or 1:1. Likewise, when the polyurea is formed using two or more types of piperazine monomers, a molar ratio of the two types of piperazine monomers may range from 1:50 to 50:1, or 1:40 to 40:1, or 1:30 to 30:1, or 1:20 to 20:1, or 1:10 to 10:1, or 1:5 to 5:1, or 1:3 to 3:1, or 1:2 to 2:1, or 1:1. In preferred embodiments, the polyurea of the present disclosure is a bipolymer obtained from reaction between a single diisocyanate monomer and a single piperazine monomer.

The isocyanate monomer of the present disclosure is preferably a compound having two isocyanate groups (i.e., a diisocyanate). In some embodiments, the diisocyanate is an aromatic diisocyanate containing two diisocyanate moieties separated by an aromatic structure. The aromatic structure may be monocyclic or polycyclic. Examples of aromatic structures include, but are not limited to, benzene, naphthalene, anthracene, phenanthrene, pyrene, and biphenyl. Exemplary aromatic diisocyanates include, but are not limited to, toluene 2,4-diisocyanate, toluene 2,6-diisocyanate, 1,3-phenylene diisocyanate, 1,4-phenylene diisocyanate, 1,3-bis(1-isocyanato-1-methylethyl)benzene, 1-chloromethyl-2,4-diisocyanatobenzene, 4-chloro-6-methyl-1,3-phenylene diisocyanate, 4,4'-methylenebis(phenyl isocyanate), 2,4'-methylenebis(phenyl isocyanate), 2,2'-methylenebis(phenyl isocyanate), m-xylylene diisocyanate, and 1,5-naphthalene diisocyanate.

The polyurea may be formed from aliphatic diisocyanates. Such aliphatic diisocyanates may be employed alone, or in combination with another isocyanate type described herein, such as the aromatic diisocyanates mentioned above. Suitable examples of aliphatic diisocyanates include, but are not limited to, isophorone diisocyanate, trimethylene diisocyanate, tetramethylene diisocyanate, pentamethylene diisocyanate, hexamethylene diisocyanate, 2,3-butylene diisocyanate, 1,3-butylene diisocyanate, 2,4,4-trimethylhexamethylene diisocyanate, 4,4'-dicyclohexylmethane diisocyanate, dodecamethylene diisocyanate, 1,3-cyclopentane diisocyanate, 1,3-cyclohexane diisocyanate, 1,4-cyclohexane diisocyanate, methyl-2,4-cyclohexane diisocyanate, and methyl-2,6-cyclohexane diisocyanate.

The polyurea may also be formed from polyisocyanates having more than two isocyanate moieties, for example, three, four, five, etc. Such polyisocyanates may be employed alone, or in combination with another isocyanate type described herein, for example the aromatic diisocyanates and/or the aliphatic diisocyanates mentioned above. The polyisocyanates having more than two isocyanate moieties may themselves be aromatic polyisocyanates or aliphatic polyisocyanates. Acceptable examples of polyisocyanates having more than two isocyanate moieties include, but are not limited to, 2,4,6-triisocyanate toluene, 1,3,5-triisocyanate benzene, 4,4'-triphenylmethane triisocyanate.

In some embodiments, the polyurea of the present disclosure comprises reacted units of a diisocyanate, preferably an aromatic diisocyanate. In preferred embodiments, the polyurea is formed using toluene 2,4-diisocyanate, toluene 2,6-diisocyanate, or both as the polyfunctional isocyanate monomer units. When a mixture of toluene 2,4-diisocyanate and toluene 2,6-diisocyanate is employed, a molar ratio of the toluene 2,4-diisocyanate to the toluene 2,6-diisocyanate preferably ranges from 1:1 to 50:1, 1.5:1 to 40:1, 2:1 to 30:1, 2.5:1 to 20:1, 3:1 to 10:1, 3.5:1 to 5:1, or about 4:1.

As the piperazine component, any piperazine(s) may be used to form the polyurea of the present disclosure so long as it has at least two reactive amine groups. The reactive amine groups may be ring nitrogen atoms located in the piperazine ring structure (e.g., piperazine, $C_4H_{10}N_2$), may be present as a substituent off of the piperazine core ring structure (e.g., bis(aminopropyl)piperazine), or a combination such as where one reactive amine group is a ring nitrogen atom of the piperazine ring structure and the other reactive amine group is a substituent off of the piperazine core ring structure (e.g., 1-(3-aminopropyl)piperazine). In preferred embodiments, the piperazine has two reactive amine groups. Suitable examples of piperazine monomers used to make the polyurea of the present disclosure include, but are not limited to, piperazine, 2-methylpiperazine, 2-ethylpiperazine, 2,3-dimethylpiperazine, 2,2-dimethylpiperazine, 2,5-dimethylpiperazine, 2,6-dimethylpiperazine, 2,2,5,5-tetramethylpiperazine, 2,3,5,6-tetramethylpiperazine, 1-(2-aminoethyl)piperazine, 1-(3-aminopropyl)piperazine, bis(aminoethyl)piperazine, bis(aminopropyl) piperazine, 2-isopropyl-piperazine, 2-isobutyl-piperazine, 2-(trifluoromethyl)piperazine, 2-(3-methoxyphenyl)piperazine, and 2-benzyl-piperazine, with specific mention being made to piperazine, 2-methylpiperazine, 2-ethylpiperazine, 2,3-dimethylpiperazine, 2,2-dimethylpiperazine, 2,5-dimethylpiperazine, 2,6-dimethylpiperazine, and 1-(2-aminoethyl)piperazine. In preferred embodiments, the piperazine employed to make the polyurea is piperazine.

Mineral or organic acid salt derivatives (mineral or organic acid salts of the reactive amine groups) of any piperazine defined or mentioned above are also contemplated herein so long as the mineral or organic acid salt derivative can be converted into a reactive amine group under conditions suitable for polyurea formation, for example, by using an exogenous base. Examples of mineral or organic acid salt derivatives include, but are not limited to, any piperazine described above which is reacted with an inorganic acid such as hydrochloric, hydrobromic, sulfuric, sulfamic, phosphoric, and nitric; or an organic acid such as acetic, propionic, succinic, glycolic, stearic, lactic, malic, tartaric, citric, ascorbic, pamoic, maleic, hydroxymaleic, phenylacetic, glutamic, benzoic, salicylic, sulfanilic, 2-acetoxybenzoic, fumaric, toluenesulfonic, methanesulfonic, ethane disulfonic, oxalic, and isethionic, adipic, and the like.

In addition to the piperazine monomer component, additional nucleophilic monomers which are reactive towards isocyanate groups may also optionally be used herein to form the polyurea. Additional nucleophilic monomers include, but are not limited to, chain extending and termination agents, such as

- monoamines (e.g. ammonia, $C_1$-$C_{18}$ alkylamines, $C_6$-$C_{20}$ arylamines, $C_7$-$C_{22}$ arylalkylamines, and substituted variants thereof including polyoxyalkyleneamines), with specific mention being made to methylamine, ethylamine, propylamine, benzylamine, aniline;
- polyamines (other than piperazines) such as aliphatic polyamines (e.g., aliphatic diamines) and aromatic polyamines (e.g., aromatic diamines such as dianilines), with specific mention being made to ethylenediamine, 1,2-diaminopropane, 1,3-diaminopropane, 1,4-diaminobutane, 1,5-diaminopentane, 1,6-diaminohexane, 1,12-diaminododecane, 2,5-diamino-2,5-dimethylhexane, trimethyl-1,6-hexane-diamine, piperazine, 1,4-diaminocyclohexane, isophoronediamine, N-cyclohexyl-1,3-propanediamine, bis-(4-amino-cyclohexyl)methane, bis-(4-amino-3-methyl-cyclohexyl)-methane, diethylenetriamine, triethylenetetraamine, tetraethylenepentamine, pentaethylenehexamine, dipropylenetriamine, tripropylenetetraamine, bis-(3-aminopropyl)amine, o-, m- and p-phenylenediamine, 1,2-diamino-3-methylbenzene, 1,3-diamino-4-methylbenzene(2,4-diaminotoluene), 1,3-bisaminomethyl-4,6-dimethylbenzene, 2,4- and 2,6-diamino-3,5-diethyltoluene, 1,4- and 1,6-diaminonaphthalene, 1,8- and 2,7-diaminonaphthalene, bis-(4-amino-phenyl)-methane, 2,2-bis-(4-aminophenyl)-propane, 4,4'-methylenedianiline, 4,4'-oxybisaniline, amine-capped aniline timers, sulfonated amine-capped aniline timers; and aliphatic, cycloaliphatic, and aromatic mono- and polyalcohols, with specific mention being made to ethylene glycol (1,2-ethanediol), diethylene glycol, triethylene glycol, tetraethylene glycol, propylene glycol, dipropylene glycol, 1,3-propanediol, 1,3-butanediol, 1,4-butanediol, 1,6-hexanediol, glycerol, pentaerythritol, polyethylene glycol, polypropylene glycol, polyalkadiene polyols (e.g., polybutadiene-based polyols), and poly(tetramethylene ether) glycol.

In particular, if a polyalcohol is employed in addition to the piperazine, a hybrid polymer comprising polyurea-urethane motifs may be formed.

In preferred embodiments, the polyurea does not contain reacted monomer units of a polyalcohol (e.g., to form urethane motifs), an aliphatic polyamine (e.g., 1,4-diaminobutane), an aromatic polyamine such as a dianiline (e.g., 4,4'-oxybisaniline, amine-capped aniline timer), a pyrrole, a dianhydride (e.g., pyromellitic dianhydride to form imide motifs), and/or a sulfonated monomer unit such as sulfonated amine-capped aniline timers (e.g., to form sulfonated urea motifs). In preferred embodiments, the polyurea is not formed using polyol monomers and thus is substantially free (preferably completely free) of polyurethane motifs. Preferably, the polyurea consists of reacted units of a piperazine having at least two reactive amine groups and a diisocyanate, i.e., the polyurea is formed using only diisocyanate and piperazine monomers, more preferably a single isocyanate (e.g., toluene 2,4-diisocyanate) and a single piperazine (e.g., piperazine), i.e., is a bipolymer.

The polyurea may be prepared by dissolving the piperazine (and any other optional nucleophilic monomer described above, for example, a polyalcohol) in an acceptable organic solvent, such as a polar aprotic solvent, for example acetonitrile, tetrahydrofuran (THF), dimethylformamide (DMF), dimethyl sulfoxide (DMSO), ethyl acetate, butyl acetate, 1,3-dimethyl-2-imidazolidinone, 1-methyl-2-pyrrolidone (NMP), and the like, to form a first mixture. In preferred embodiments, acetonitrile is used as the organic solvent. The first mixture may be optionally heated prior to addition of the polyfunctional isocyanate, for example, to a temperature of 40 to 90° C., preferably 45 to 85° C., preferably 50 to 80° C., preferably 55 to 75° C., preferably 60 to 70° C. While the polyurea may be prepared in water or an aqueous solution, it is preferred that the polyurea is formed using reaction mediums which are substantially free of water.

Next, the polyfunctional isocyanate (e.g. toluene 2,4-diisocyanate and toluene 2,6-diisocyanate) may be mixed with the first mixture, preferably by slow addition (dropwise) to form a reaction mixture, and the reaction mixture may be heated at 40 to 90° C., preferably 45 to 85° C., preferably 50 to 80° C., preferably 55 to 75° C., preferably 60 to 70° C. with continued mixing, thereby forming the polyurea. In preferred embodiments, no binder is present during polyurea formation (examples of binders will be discussed hereinafter).

The mixing may occur via stirring, shaking, swirling, sonicating, blending, or by otherwise agitating the reaction mixture. In preferred embodiments, the reaction mixture is agitated using a magnetic stirrer or an overhead stirrer at a speed of 100 to 2,000 rpm, preferably 200 to 1,500 rpm, preferably 300 to 1,000 rpm, preferably 400 to 800 rpm, preferably 500 to 700 rpm, preferably about 600 rpm for 0.5 to 12 hours, preferably 1 to 10 hours, preferably 2 to 8 hours, preferably 3 to 7 hours, preferably about 6 hours. An external heat source, such as a water bath or an oil bath, an oven, microwave, or a heating mantle, may be employed to heat the first mixture and/or the reaction mixture.

In some embodiments, the polyurea is formed using a molar ratio of the piperazine to the polyfunctional isocyanate (e.g., diisocyanate) of 1:1 to 4:1, preferably 1.2:1 to 3.5:1, preferably 1.5:1 to 3:1, or about 2:1. While the polymerization reaction concentration can vary, typically the piperazine is present in the reaction mixture at a concentration of 0.05 to 10 M, preferably 0.1 to 5 M, preferably 0.2 to 2 M, preferably 0.4 to 1 M, or about 0.5 M, while the polyfunctional isocyanate monomer is present in the reaction mixture at a concentration of 0.025 to 5 M, preferably 0.05 to 2.5 M, preferably 0.1-1 M, preferably 0.2-0.5 M, preferably about 0.25 M.

When the polymerization reaction is deemed sufficiently complete, the polyurea may be collected for example via filtration, optionally washed with an organic solvent, for example with acetone or a similar solvent, and then dried. In some embodiments, the powder may be dried under vacuum with optional heating, for example at 45 to 85° C., preferably 50 to 80° C., preferably 55 to 75° C., preferably 60 to 70° C., or otherwise until a constant weight is achieved.

The polyurea of the present disclosure may have a weight average molecular weight of 1 to 100 kDa, preferably 2 to 80 kDa, preferably 5 to 60 kDa, preferably 10 to 40 kDa, preferably 15 to 35 kDa, preferably 20 to 30 kDa. In some embodiments, the polyurea has a polydispersity index ($M_w/M_n$) of 1.1 to 1.8, preferably 1.2 to 1.65, preferably 1.3 to 1.6, preferably 1.35 to 1.55, preferably 1.4 to 1.5, preferably 1.45.

In preferred embodiments, the polyurea employed in the present disclosure is in the form of microparticles (i.e., polyurea microparticles). The microparticles typically have an average diameter of 10 to 50 μm, preferably 12 to 48 μm, preferably 14 to 46 μm, preferably 16 to 44 μm, preferably 18 to 42 μm, preferably 20 to 40 μm, preferably 22 to 38 μm, preferably 24 to 36 μm, preferably 26 to 34 μm, preferably 28 to 32 μm, preferably 30 μm.

The microparticles of the polyurea may be spherical, ellipsoidal, oblong, ovoidal, or some other generally rounded (non-angular) shape, preferably the microparticles are spherical. The size and shape of the microparticles may be analyzed by techniques such as dynamic light scattering (DLS), scanning electron microscopy (SEM), transmission electron microscopy (TEM), and/or atomic force microscopy (AFM) (see e.g., FIG. 5A).

In some embodiments, the polyurea microparticles utilized in the disclosed methods are monodisperse, having a coefficient of variation or relative standard deviation, expressed as a percentage and defined as the ratio of the particle size standard deviation ((a) to the particle size mean (p) multiplied by 100 of less than 25%, preferably less than 20%, preferably less than 15%, preferably less than 10%, preferably less than 8%, preferably less than 6%, preferably less than 5%. In some embodiments, the polyurea microparticles utilized in the disclosed methods are polydisperse with a coefficient of variation (or relative standard deviation) of greater than or equal to 25%, preferably greater than or equal to 30%, preferably greater than or equal to 35%, preferably greater than or equal to 40%.

Depending on the conditions employed during their synthesis, the polyurea microparticles may be formed with varying porosity (or lack thereof). Preferably, the polyurea microparticles used in the disclosed methods are porous. In some embodiments, the microparticles are macroporous (i.e., contain macropores), preferably containing macropores with an average macropore size of 400 to 600 nm, preferably 420 to 580 nm, preferably 440 to 560 nm, preferably 460 to 540 nm, preferably 480 to 520 nm, preferably 500 nm. Such macropores may be clearly visible in topographical imaging such as SEM, where the microparticles can be seen to possess a sponge-like morphology (e.g., see FIG. X). In some embodiments, the microparticles are mesoporous (i.e., contain mesopores), preferably containing mesopores with an average mesopore size of 20 to 40 nm, preferably 22 to 38 nm, preferably 24 to 36 nm, preferably 26 to 34 nm, preferably 28 to 32 nm, preferably 30 nm. In some embodiments, the polyurea microparticles are hierarchical and contain both macropores and mesopores. Pore size may be determined by techniques including, but not limited to, gas adsorption (e.g. $N_2$ adsorption), mercury intrusion porosimetry, and imaging techniques such as scanning electron microscopy (SEM), and x-ray computed tomography (XRCT).

In some embodiments, the microparticles have a BET surface area of 30 to 350 $m^2/g$, preferably 40 to 340 $m^2/g$, preferably 50 to 320 $m^2/g$, preferably 60 to 300 $m^2/g$, preferably 70 to 280 $m^2/g$, preferably 80 to 260 $m^2/g$, preferably 90 to 240 $m^2/g$, preferably 100 to 220 $m^2/g$, preferably 110 to 200 $m^2/g$, preferably 120 to 180 $m^2/g$, preferably 130 to 160 $m^2/g$, preferably 140 $m^2/g$.

In preferred embodiments, the formulation is substantially free of the piperazine monomer (non-polymerized piperazine) and the polyfunctional isocyanate monomer (non-polymerized polyfunctional isocyanate). That is, the formulation preferably includes only piperazine and isocyanate in reacted form as part of the polyurea polymer chain.

Organic Solvent

The formulation may also optionally include one or more organic solvents. When the formulation is prepared using an organic solvent, enough organic solvent is utilized to provide a volume ratio of the organic solvent to the corrosive medium of 1:80 to 1:200, preferably 1:82 to 1:190, preferably 1:84 to 1:180, preferably 1:86 to 1:170, preferably 1:88 to 1:160, preferably 1:90 to 1:150, preferably 1:92 to 1:140, preferably 1:94 to 1:130, preferably 1:95 to 1:120, preferably 1:96 to 1:115, preferably 1:97 to 1:110, preferably 1:98 to 1:108, preferably 1:99 to 1:105, or about 1:100.

The organic solvent may be at least one selected from the group consisting of a polar aprotic solvent, an aromatic solvent, a terpene or a terpineol, a mono alcohol with 1 to 12 carbon atoms, and a polyol with 2 to 18 carbon atoms. Acceptable organic solvents include, but are not limited to, formamide, N-methyl-2-pyrrolidone, dimethyl formamide, dimethyl acetamide, dimethyl sulfoxide, 1,3-dimethyl-2-imidazolidinone, acetone, methyl ethyl ketone, methanol, ethanol, propanol, isopropanol, n-butanol, isobutanol, n-pentanol, n-hexanol, terpineol (e.g., α-terpeneol), α-pinene, d-limonene, nopol, eucalyptol, menthol, prenol, 3-methyl-3-buten-1-ol, 2-ethyl-1-hexanol, 2-ethyl-1-butanol, 2-propylheptan-1-ol, 2-butyl-1-octanol, ethylene glycol, diethylene glycol, triethylene glycol, tetraethylene glycol, ethylene glycol methyl ether, ethylene glycol ethyl ether, ethylene glycol propyl ether, ethylene glycol butyl ether, diethylene glycol monomethyl ether, diethylene glycol monoethyl ether, ethylene glycol monobutyl ether, propylene glycol, dipropylene glycol, propylene glycol monomethyl ether, pyrocatechol (1,2-benzenediol), resorcinol (1,3-benzenediol), benzene, phenol, cresol, benzyl alcohol, 1,3-propanediol, 1,3-butanediol, 2-butoxyethanol, 1,4-butanediol, 1,6-hexanediol, glycerol, pentaerythritol, manitol, sorbitol, as well as mixtures thereof.

Preferably, the organic solvent used is at least partially soluble in water and preferably miscible with water. More preferably, when used, the organic solvent is a polar aprotic solvent, preferably at least one polar aprotic solvent selected from the group consisting of N-methyl-2-pyrrolidone, dimethylformamide, dimethyl sulfoxide, and 1,3-dimethyl-2-imidazolidinone, more preferably N-methyl-2-pyrrolidone.

In some embodiments, the formulation is substantially free of an organic solvent.

Surfactants

The formulation may also optionally include one or more surfactants. The surfactant(s), when present, may be included in an amount of up to 5 wt. %, preferably up to 4 wt. %, preferably up to 3 wt. %, preferably up to 2 wt. %, preferably up to 1 wt. %, preferably up to 0.5 wt. %, preferably up to 0.1 wt. %, preferably up to 0.05 wt. %, preferably up to 0.01 wt. %, based on a total weight of the formulation. Cationic, anionic, non-ionic, and/or amphoteric surfactants may be employed herein.

Cationic surfactants may include, but are not limited to a protonated amine formed from a reaction between a $C_6$-$C_{26}$ alkyl amine compound and an acid (e.g., acetic acid, formic acid, propionic acid, butyric acid, pentanoic acid, hexanoic acid, oxalic acid, malonic acid, lactic acid, glyceric acid, glycolic acid, malic acid, citric acid, benzoic acid, p-toluenesulfonic acid, trifluoromethanesulfonic acid, hydrochloric acid, nitric acid, phosphoric acid, sulfuric acid, hydrobromic acid, perchloric acid, hydroiodic acid, etc.), such as protonated salts of $C_6$-$C_{26}$ alkyl monoamines, $C_6$-$C_{26}$ alkyl (poly)alkylene polyamines, and alkoxylated fatty amines;

a protonated $C_6$-$C_{26}$ alkyl amidoamine formed from a reaction between a $C_6$-$C_{26}$ alkyl amidoamine compound and an acid (for example the acids listed above), such as protonated forms of the amide reaction product between any fatty acid previously listed (or ester derivative thereof) with a polyamine (e.g., putrescine, cadaverine, ethylene diamine, $N^1$,$N^1$-dimethylethane-1,2-diamine, $N^1$,$N^1$-dimethylpropane-1,3-diamine, $N^1$,$N^1$-diethylethane-1,2-diamine, $N^1$,$N^1$-diethylpropane-1,3-diamine, spermidine, 1,1,1-tris(aminomethyl) ethane, tris(2-aminoethyl)amine, spermine, TEPA, DETA, TETA, AEEA, PEHA, HEHA, dipropylene triamine, tripropylene tetramine, tetrapropylene pentamine, pentapropylene hexamine, hexapropylene heptamine, dibutylene triamine, tributylene tetramine, tetrabutylene pentamine, pentabutylene hexamine, hexabutylene heptamine), with specific mention being made to protonated forms of stearamidopropyldimethylamine, stearamidopropyldiethylamine, stearamidoethyldiethylamine, stearamidoethyldimethylamine, palmitamidopropyldimethylamine, palmitamidopropyldiethylamine, palmitamidoethyldiethylamine, palmitamidoethyldimethylamine, behenamidopropyldimethylamine, behenamidopropyldiethylmine, behenamidoethyldiethylamine, behenamidoethyldimethylamine, arachidamidopropyldimethylamine, arachidamidopropyldiethylamine, arachidamidoethyldiethylamine, and arachidamidoethyldimethylamine; and a quaternary ammonium compound made from alkylation with suitable alkylating agents (e.g., dimethyl sulfate, methyl chloride or bromide, benzyl chloride or bromide, $C_6$-$C_{26}$ alkyl chloride or bromide, etc.) of a tertiary $C_6$-$C_{26}$ alkyl amine, an alkoxylated (tertiary) amine, or an aprotic nitrogenous heteroarene (optionally substituted) having at least one aromatic nitrogen atom with a reactive lone pair of electrons, with specific mention being made to a tri-fatty alkyl lower alkyl ammonium compound (e.g., trioctyl methyl ammonium chloride), a $C_{10}$-$C_{18}$ alkyl trimethyl ammonium chloride or methosulfate, a di-$C_{10}$-$C_{18}$ alkyl dimethyl ammonium chloride or methesulfate, a $C_{10}$-$C_{18}$ alkyl benzyl dimethyl ammonium chloride, a methyl quaternized $C_6$-$C_{22}$ alkyl propylene diamine, a methyl quaternized $C_6$-$C_{22}$ alkyl propylene triamine, a methyl quaternized $C_6$-$C_{22}$ alkyl propylene tetraamine, a N—$C_{10}$-$C_{18}$ alkyl pyridinium or a quinolinium bromide or chloride such as N-octyl pyridinium bromide, N-nonyl pyridinium bromide, N-decyl pyridinium bromide, N-dodecyl pyridinium bromide, N-tetradecyl pyridinium bromide, N-dodecyl pyridinium chloride, N-cyclohexyl pyridinium bromide, naphthyl methyl quinolinium chloride, naphthyl methyl pyridinium chloride, and cetylpyridinium chloride (for example those disclosed in CN101544903B—incorporated herein by reference in its entirety);

as well as mixtures thereof.

Anionic surfactants may include, but are not limited to:

sulfates, such as alkyl sulfates, alkyl-ester-sulfates, alkyl ether sulfates, alkyl-alkoxy-ester-sulfate, sulfated alkanolamides, glyceride sulfates, in particular, sulfates of fatty alcohols or polyoxyalkylene ethers of fatty alcohols such as sodium dodecyl sulfate, sodium laureth sulfate, ammonium lauryl sulfate, potassium lauryl sulfate, sodium myreth sulfate;

sulfonates such as alkyl sulfonates, fatty alkyl-benzene sulfonates, lower alkyl-benzene sulfonates, alpha olefin sulfonates, lignosulfonates, sulfo-carboxylic compounds, for example, dodecyl benzene sulfonate, dioctyl sodium sulfosuccinate, perfluorooctanesulfonate (PFOS), perfluorobutanesulfonate;

phosphates such as alkyl aryl ether phosphates, alkyl ether phosphates, phosphates of fatty alcohols or polyoxyalkylene ethers of fatty alcohols such as cetyl phosphate salts, dicetyl phosphate salts, ceteth-10-phosphate salts;

carboxylate salts of fatty acids, acylamino acids, lactylates, and/or fatty alcohols/polyoxyalkylene ethers of fatty alcohols such as sodium stearate, vegetable oil-based anionic surfactants (e.g., palm oil anionic surfactant), sodium behenoyl lactylate, sodium isostearoyl lactylate, sodium caproyl lactylate, sodium laureth-5 carboxylate, sodium laureth-6 carboxylate, sodium laureth-11 carboxylate;

and mixtures thereof.

Non-ionic surfactants may include, but are not limited to:

amides or alkanolamides of fatty acids, that is, amide reaction products between a fatty acid and an amine or alkanolamine compound, such as coconut fatty acid monoethanolamide (e.g., N-methyl coco fatty ethanol amide), coconut fatty acid diethanolamide, oleic acid diethanolamide, palm based oleylamine, and vegetable oil fatty acid diethanolamide;

alkoxylated alkanolamides of fatty acids, preferably ethoxylated and/or propoxylated variants of the alkanolamides of fatty acids using for example anywhere from 2 to 30 EO and/or PO molar equivalents, preferably 3 to 15 EO and/or PO molar equivalents, preferably 4 to 10 EO and/or PO molar equivalents, preferably 5 to 8 EO and/or PO molar equivalents per moles of the alkanolamide of the fatty acid (e.g., coconut fatty acid monoethanolamide with 4 moles of ethylene oxide);

amine oxides, such as N-cocoamidopropyl dimethyl amine oxide and dimethyl $C_6$-$C_{22}$ alkyl amine oxide (e.g., dimethyl coco amine oxide);

fatty esters, such as ethoxylated and/or propoxylated fatty acids (e.g., castor oil with 2 to 40 moles of ethylene oxide), alkoxylated glycerides (e.g., PEG-24 glyceryl monostearate), glycol esters and derivatives, monoglycerides, polyglyceryl esters, esters of polyalcohols, and sorbitan/sorbitol esters;

ethers, such as (i) alkoxylated $C_1$-$C_{22}$ alkanols, which may include alkoxylated $C_1$-$C_5$ alkanols, preferably ethoxylated or propoxylated $C_1$-$C_5$ alkanols (e.g., dipropylene glycol n-butyl ether, tripropylene glycol n-butyl ether, dipropylene glycol methyl ether, tripropylene glycol methyl ether, diethylene glycol n-butyl ether, triethylene glycol n-butyl ether, diethylene glycol methyl ether, triethylene glycol methyl ether) and alkoxylated $C_6$-$C_{26}$ alkanols (including alkoxylated fatty alcohols), preferably alkoxylated $C_7$-$C_{22}$ alkanols, more preferably alkoxylated $C_8$-$C_{14}$ alkanols, preferably ethoxylated or propoxylated (e.g., cetyl stearyl alcohol with 2 to 40 moles of ethylene oxide, lauric alcohol with 2 to 40 moles of ethylene oxide, oleic alcohol with 2 to 40 moles of ethylene oxide, ethoxylated lanoline derivatives, laureth-3, ceteareth-6, ceteareth-11, ceteareth-15, ceteareth-16, ceteareth-17, ceteareth-18, ceteareth-20, ceteareth-23, ceteareth-25, ceteareth-27, ceteareth-28, ceteareth-30, isoceteth-20, laureth-9/myreth-9, and PPG-3 caprylyl ether); (ii) alkoxylated polysiloxanes; (iii) ethylene oxide/propylene oxide copolymers (e.g., PPG–1-PEG-9-lauryl glycol ether, PPG-12-buteth-16, PPG-3-buteth-5, PPG-5-buteth-7, PPG-7-buteth-10, PPG-9-buteth-12, PPG-12-buteth-16, PPG-15-buteth-20, PPG-20-buteth-30, PPG-28-buteth-35, and PPG-33-buteth-45); and (iv) alkoxylated alkylphenols;

alkyl polyglycosides (APGs) such as those made from reaction between fatty alcohols and glucose;

and mixtures thereof.

Amphoteric surfactants may include, but are not limited to:

$C_6$-$C_{22}$ alkyl dialkyl betaines, such as fatty dimethyl betaines ($R—N(CH_3)_2(^+)—CH_2COO^-$), obtained from a $C_6$-$C_{22}$ alkyl dimethyl amine which is reacted with a monohaloacetate salt (e.g., sodium monochloroacetate), such as $C_{12}$-$C_{14}$ dimethyl betaine (carboxylate methyl $C_{12}$-$C_{14}$ alkyl dimethylammonium);

$C_6$-$C_{22}$ alkyl amido betaines ($R—CO—NH—CH_2CH_2CH_2—N(CH_3)_2(^+)—CH_2COO^-$ or $R—CO—NH—CH_2CH_2—N(CH_3)_2(^+)—CH_2COO^-$), obtained by the reaction of a monohaloacetate salt (e.g., sodium monochloroacetate) with the reaction product of either dimethyl amino propylamine or dimethyl amino ethylamine with a suitable carboxylic acid or ester derivatives thereof, such as $C_{10}$-$C_{18}$ amidopropyl dimethylamino betaine;

$C_6$-$C_{22}$ alkyl sultaines or $C_6$-$C_{22}$ alkyl amido sultaines, which are similar to those $C_6$-$C_{22}$ alkyl dialkyl betaines or $C_6$-$C_{22}$ alkyl amido betaines described above except in which the carboxylic group has been substituted by a sulfonic group ($R—N(CH_3)_2(^+)—CH_2CH_2CH_2SO_3^-$ or $R—CO—NH—CH_2CH_2CH_2—N(CH_3)_2(^+)—CH_2CH_2CH_2SO_3^-$ or $R—CO—NH—CH_2CH_2—N(CH_3)_2(^+)—CH_2CH_2CH_2SO_3^-$) or a hydroxysulfonic group ($R—N(CH_3)_2(^+)—CH_2CH(OH)—CH_2SO_3^-$ or R—CO—NH—$CH_2CH_2CH_2$—$N(CH_3)_2(^+)$—$CH_2CH(OH)$—$CH_2SO_3^-$ or R—CO—NH—$CH_2CH_2$—$N(CH_3)_2(^+)$—$CH_2CH(OH)$—$CH_2SO_3^-$), such as $C_{10}$-$C_{18}$ dimethyl hydroxysultaine and $C_{10}$-$C_{18}$ amido propyl dimethylamino hydroxysultaine;

and mixtures thereof.

In preferred embodiments, the formulation is substantially free of a surfactant.

Additives

The formulation may optionally further include any additive(s) suitable for use in oil and gas well operations, and particularly during oil recovery and oil transportation operations, which are known by those of ordinary skill in the art. For example, when employed, the additive may be at least one of a viscosity modifying agent, a chelating agent, a stabilizing agent, a dispersing agent, a supplemental corrosion inhibitor, a scale inhibitor, a defoaming agent, and an emulsifier. Typically, when present, the additive(s) may be incorporated in an amount of up to 5 wt. %, preferably up to 4 wt. %, preferably up to 3 wt. %, preferably up to 2 wt. %, preferably up to 1 wt. %, preferably up to 0.5 wt. %, preferably up to 0.1 wt. %, preferably up to 0.05 wt. %, preferably up to 0.01 wt. %, based on a total weight of the formulation.

Suitable additive(s) may include, but are not limited to, viscosity modifying agents e.g., bauxite, bentonite, dolomite, limestone, calcite, vaterite, aragonite, magnesite, taconite, gypsum, quartz, marble, hematite, limonite, magnetite, andesite, garnet, basalt, dacite, nesosilicates or orthosilicates, sorosilicates, cyclosilicates, inosilicates, phyllosilicates, tectosilicates, kaolins, montmorillonite, fullers earth, halloysite, polysaccharide gelling agents (e.g., xanthan gum, scleroglucan, and diutan) as well as synthetic polymer gelling agents (e.g., polyacrylamides and co-polymers thereof, see U.S. Pat. No. 7,621,334—incorporated herein by reference in its entirety), *psyllium* husk powder, hydroxyethyl cellulose, carboxymethylcellulose, and polyanionic cellulose, poly(diallyl amine), diallyl ketone, diallyl amine, styryl sulfonate, vinyl lactam, laponite;

chelating agents, such as chelating agents useful as sequestration agents of metal ions, for example iron control agents, such as ethylene diamine tetraacetic acid (EDTA), diethylene triamine pentaacetic acid (DPTA), hydroxyethylene diamine triacetic acid (HEDTA), ethylene diamine di-ortho-hydroxy-phenyl acetic acid (EDDHA), ethylene diamine di-ortho-hydroxy-para-methyl phenyl acetic acid (EDDHMA), ethylene diamine di-ortho-hydroxy-para-carboxy-phenyl acetic acid (EDDCHA);

stabilizing agents e.g., polypropylene glycol, polyethylene glycol, carboxymethyl cellulose, hydroxyethyl cellulose, polysiloxane polyalkyl polyether copolymers, acrylic copolymers, alkali metal alginates and other water soluble alginates, carboxyvinyl polymers, polyvinylpyrollidones, polyacrylates;

dispersing agents e.g., polymeric or co-polymeric compounds of polyacrylic acid, polyacrylic acid/maleic acid copolymers, styrene/maleic anhydride copolymers, polymethacrylic acid and polyaspartic acid;

a supplemental corrosion inhibitor (i.e., corrosion inhibitors other than the polyurea of the present disclosure) e.g., alkoxylated fatty amines, chromates, zinc salts, (poly)phosphates, organic phosphorus compounds (phosphonates), acetylenic alcohols such as propargylic alcohol, α,β-unsaturated aldehydes such as cinnameldehyde and crotonaldehyde, aromatic aldehydes such as furfural, p-anisaldehyde, phenones including alkenyl phenones such as phenyl vinyl ketone, nitrogen-containing heterocycles such as imidazolines, piperazines, hexamethylene tetramines, quaternized heteroarenes such as 1-(benzyl)quinolinium chloride, and condensation products of carbonyls and amines such as Schiff bases;

scale inhibitors e.g., sodium hexametaphosphate, sodium tripolyphosphate, hydroxyethylidene diphosphonic acid, aminotris(methylenephosphonic acid (ATMP), vinyl sulfonic acid, allyl sulfonic acid, polycarboxylic acid polymers such as polymers containing 3-allyloxy-2-hydroxy-propionic acid monomers, sulfonated polymers such as vinyl monomers having a sulfonic acid group, polyacrylates and co-polymers thereof;

defoaming agents e.g., silicone oils, silicone oil emulsions, organic defoamers, emulsions of organic defoamers, silicone-organic emulsions, silicone-glycol compounds, silicone/silica adducts, emulsions of silicone/silica adducts;

emulsifiers such as a tallow amine, a ditallow amine, or combinations thereof, for example a 50% concentration of a mixture of tallow alkyl amine acetates, C16-C18 (CAS 61790-60) and ditallow alkyl amine acetates (CAS 71011-03-5) in a suitable solvent such as heavy aromatic naphtha and ethylene glycol;

as well as mixtures thereof.

In some embodiments, the formulation is substantially free of an additive (e.g., viscosity modifying agent, a chelating agent, a stabilizing agent, a dispersing agent, a corrosion inhibitor, a scale inhibitor, a stabilizing agent, a defoaming agent, and an emulsifier).

In some embodiments, the formulation is substantially free of polymers (other than the polyurea described above), including both water-soluble and oil-soluble polymers, i.e., the polyurea is the only polymer present in the formulation. In preferred embodiments, the formulation is substantially free of a polysaccharide (e.g., xanthan gum, scleroglucan, and diutan) and a quaternary ammonium surfactant.

As described herein, the formulation is preferably formulated for direct application into corrosive mediums (flow streams) encountered during the production, transportation, storage, and/or separation of crude oil and natural gas. The direct introduction of the formulations described herein into corrosive mediums is advantageous in that corrosion inhibition can be performed as needed, the formulations can be injected while fluid flow is maintained, and thus production efforts can continue without interruption. Thus the formulations described herein are not intended for protective coating applications whereby the formulations are first contacted with metal surfaces (used as a pre-coating for the metal surface). Instead, the methods described herein are preferably employed to inhibit corrosion of metals which are not pre-coated/pre-treated for corrosion resistance, where the anticorrosion effect can be achieved by addition of the formulations directly into various flow streams.

Thus, the formulation of the present disclosure is preferably substantially free of binder(s) (preferably the formulation is devoid of any binder(s)), broadly categorized as any binding material that is designed to bind various components to the metal surface being pre-treated, for example, to provide a protective coating for the metal. Examples of binders include, but are not limited to, an epoxy ester resin (—CO—O—$CH_2$—CHOH—, formed by reacting epoxy groups with carboxylic acids), long-oil, middle-oil or short-oil or even oil-free alkyd resins, stand oils, linseed oil/linseed oil-stand oil combinations, urethane-, epoxy resin-, acrylic resin- and styrene-modified alkyd resins, PVC-copolymers, cyclorubbers, oil-modified epoxides, water-dilutable alkyd resins in their non-neutralized form, unsaturated polyester resins or mixtures thereof with copolymerizable monomers (e.g., styrene, (meth)acrylate, or similar ethylenically unsaturated compounds), and acid binders, for example, those binders and binder-containing systems described in U.S. Pat. No. 3,893,956, incorporated herein by reference in its entirety.

Oil & Gas Field Methods

Petroleum oil and natural gas wells are typically subjected to numerous chemical treatments during their production life to enhance operation and protect the integrity of the asset. Corrosion of metal surfaces in aqueous media has long been a problem for the oil and gas industry. It is well-known that during the production of oil and gas, several other corrosive components are present, such as brines, organic acids, carbon dioxide, hydrogen sulfide, and microorganisms. These aggressive constituents can cause severe metal corrosion as demonstrated by surface pitting, embrittlement, and loss of metal. Corrosion issues are problematic for any drilling operation, but are even more troublesome in deep-sea operations where replacement of corroded equipment is difficult and costly.

Application of protective coatings (pre-coating metal surfaces with a binding film to protect against corrosion) is an extremely expensive process as it requires large amounts of anti-corrosive films/binding systems to be applied, and requires shutting down the production system for the coating application, which is not economical for industrial applications. Therefore, a more economical approach is to inject corrosion inhibitors into the flow streams during the production, transportation, storage, and/or separation of crude oil and natural gas, which is more economical since lower quantities of corrosion inhibitors can be used, and does not require shutting down production.

The present disclosure thus provides a method, preferably an in-situ or downhole method, for inhibiting corrosion of metal in contact with a corrosive medium in an oil or gas field environment with the formulations described herein, in one or more of their embodiments.

The formulations of the present disclosure may be deployed during any upstream (exploration, field development, and production operations), midstream (transportation e.g., by pipeline, processing, storage, and distribution), or downstream (manufacturing, refining, wholesale) oil and gas process where metal corrosion is a concern. Preferably, the formulations are employed during production (preferably secondary or tertiary recovery stages) or transportation/processing processes (to protect oil and gas well tubing and field equipment from corrosion during transport (e.g., by pipeline) and processing.

The disclosed methods may be effective for inhibiting corrosion of metal caused by contact with various types of corrosive mediums, including aqueous mixtures, produced petroleum or natural gas mixtures, and multi-phase mixtures such as water-oil mixtures and water-oil-gas mixtures. The formulations herein are particularly effective when introduced into corrosive mediums containing at least one of an acid, carbon dioxide, a corrosive sulfur species (e.g., hydrogen sulfide, mercaptans, etc.), and/or brine, and may be used to combat corrosion in a wide variety of oil and gas production, transportation, and processing systems, including those containing produced gas, sour gas, sweet gas, heavy brines, conditioning solutions, and the like. The formulations may be effective at combating corrosion in corrosive mediums having a wide range of pH values, typically a pH of 0 to 7, preferably 0.5 to 6, preferably 1 to 5, preferably 2 to 4, preferably 3.

In some embodiments, the corrosive medium is an aqueous solution, i.e., is substantially free of an oil phase (e.g., contains less than 1 wt. %, preferably less than 0.5 wt. %, more preferably less than 0.1 wt. %, even more preferably less than 0.05 wt. %, yet even more preferably 0 wt. % of an oil phase, based on a total weight of the acidic treatment fluid).

In some embodiments, the corrosive medium is a multi-phase mixture such as a water-oil mixture. The disclosed formulations can be used in both oil-rich multi-phase mixtures, for example in transportation/storage applications of produced crude oil and produced crude oil/water emulsions, as well as in water-rich corrosive mixtures, for example in production applications involving produced water with minor amounts of crude oil. The corrosive medium may thus have a water (or brine) to oil ratio (w/o) by volume of at least 5:95, preferably at least 20:80, preferably at least 40:60, preferably at least 50:50, preferably at least 55:45, preferably at least 60:40, preferably at least 65:35, and up to 95:5, preferably up to 90:10, preferably up to 85:15, preferably up to 80:20, preferably up to 75:25, preferably up to 70:30.

During production operations or operations involving the transport of fluids obtained from production, any oil optionally present is typically a crude oil. The type of crude oil present in the corrosive medium depends on the location of the well/oil producing geological formation, including, but not limited to, a very light crude oil such as Arab Extra Light, Arab Super Light, or Arab Super Light Ardjuna crude oil (e.g., a jet fuel, gasoline, kerosene, petroleum ether, petroleum spirit, or petroleum naphtha crude oil); a light crude oil such as Arab Light or Arab Light/Seg 17 Blend crude oil (e.g., grade 1 and grade 2 fuel oil, diesel fuel oil, domestic fuel oil); a medium crude oil such as Arab Medium crude oil; and a heavy crude oil such as Arab Heavy crude oil (e.g., grade 3, 4, 5, and 6 fuel oil, heavy marine fuel). Both sweet (sulfur volume lower than 0.50%) and sour (sulfur volume higher than 0.50%) crude oils may be present in the corrosive medium. In some embodiments, the corrosive medium is a water-oil mixture, with the oil phase being a crude oil such as a light or medium crude oil, preferably a light crude oil, preferably Arabian Light crude oil, preferably Arabian Light crude oil having a density at 25° C. of 0.81 to 0.83 g/mL, preferably 0.815 to 0.8298 g/mL, preferably 0.82 to 0.8296 g/mL, preferably 0.822 to 0.8294 g/mL, preferably 0.824 to 0.829 g/mL, preferably 0.826 to 0.8288 g/mL, preferably 0.828 to 0.8286 g/mL.

In some embodiments, the corrosive medium contains at least one acid. The acid may be in liquid or gas forms and include, but is not limited to, inorganic acids such as hydrochloric acid (HCl), sulfuric acid ($H_2SO_4$), nitric acid ($HNO_3$), hydrofluoric acid (HF), and phosphoric acid; organic acids such as acetic acid ($CH_3COOH$), formic acid (HCOOH), and citric acid; as well as acidic gases common to many subterranean environments such as carbon dioxide ($CO_2$) and hydrogen sulfide ($H_2S$). These acids may be present in the corrosive medium at saturated concentrations, or at a concentration in a range of 0.01 to 10 M, 0.05 to 8 M, 0.1 to 6 M, 0.25 to 4 M, 0.5 to 3 M, 0.75 to 2 M, or about 1 M. Preferably, the acid is least one acid selected from the group consisting of hydrochloric acid, sulfuric acid, nitric acid, hydrofluoric acid, acetic acid, and formic acid. In at least one embodiment, the corrosive medium contains hydrochloric acid.

Inorganic salts (such as sodium chloride) have been known to cause serious corrosion to metals such as steel. The formulations of the present disclosure are also effective at inhibiting metal corrosion in high salt environments, such as those common to oil and gas recovery, for example in fluids made of/containing produced water. In some embodiments, the corrosive medium contains a brackish water having a total dissolved solids (TDS) content of 3,000 to less than 10,000 mg/L, preferably 4,000 to 9,000 mg/L, preferably 5,000 to 8,000 mg/L, preferably 6,000 to 7,000 mg/L. In some embodiments, the corrosive medium contains saline or brine (e.g., seawater, produced water, etc.) having a TDS content of 10,000 to 400,000 mg/L, preferably 20,000 to 350,000 mg/L, preferably 30,000 to 300,000 mg/L, preferably 40,000 to 250,000 mg/L, preferably 60,000 to 200,000 mg/L, preferably 80,000 to 150,000 mg/L, preferably 100,000 to 125,000 mg/L. Representative examples of cations which may be optionally present in the corrosive mediums include, but are not limited to, sodium, potassium, magnesium, calcium, strontium, barium, iron (ferrous and ferric), lead, copper, cobalt, manganese, nickel, zinc, aluminum, chromium, and titanium, as well as mixtures thereof. Representative examples of anions which may be optionally present in the corrosive mediums include, but are not limited to, chloride, carbonate, bicarbonate, sulfate, bromide, iodide, acetate, hydroxide, sulfide, hydrosulfide, chlorate, fluoride, hypochlorite, nitrate, nitrite, perchlorate, peroxide, phosphate, phosphite, sulfite, hydrogen phosphate, hydrogen sulfate, as well as mixtures thereof. For example, the corrosive medium may be an aqueous fluid formed from, or may contain an aqueous component formed from, seawater having a salinity of 30,000 ppm to 36,000 ppm, preferably 31,000 ppm to 35,000 ppm, more preferably 32,000 ppm to 34,000 ppm.

In some embodiments, the corrosive medium contains an acid. In some embodiments, the corrosive medium contains salt (brine). In some embodiments, the corrosive medium contains salt (brine) and $CO_2$, for example where the corrosive medium is a brine-containing solution saturated with $CO_2$.

Introduction of the formulation may proceed through suitable injection lines to areas where corrosion can or is likely to occur through capillaries or umbilical lines (in many cases at the wellhead if suitable metallurgy is used downhole). Injection may be performed manually or it may be automatic, for example, by using chemical injection pumps. In some embodiments, the formulation may be stored in a chemical storage tank and a chemical injection pump associated therewith may be used to introduce the formulation into the desired location of the oil/gas operation. In any of the above applications (i.e., upstream process, midstream process, etc.), the formulation or any of its components combinable downhole may be injected continuously and/or in batches. The chemical injection pump(s) can be automatically or manually controlled to inject any amount of the formulation needed for inhibiting corrosion.

The corrosive mediums in which the formulation is applied to may be in contact with many different types of surfaces on tubing and field equipment that are susceptible to corrosion. Illustrative examples of which include, but are not limited to, separation vessels, dehydration units, gas lines, pipelines, cooling water systems, valves, spools, fittings (e.g., such as those that make up the well Christmas tree), treating tanks, storage tanks, coils of heat exchangers, fractionating columns, cracking units, pump parts (e.g., parts of beam pumps), as well as downhole surfaces that may be impacted by corrosion from the corrosive mediums, such as those pipes, pump parts such as sucker rods, electrical submersible pumps, screens and the like, which are positioned in a wellbore during production.

Any metal surface that may come into contact with the corrosive medium may be protected by the formulations of the present disclosure. Typical metals found in oil and gas field environments that may be protected include carbon steels (e.g., mild steels, high-tensile steels, higher-carbon steels); high alloy steels including chrome steels, ferritic alloy steels, austenitic stainless steels, precipitation-hardened stainless steels high nickel content steels; galvanized steel, aluminum, aluminum alloys, copper, copper nickel alloys, copper zinc alloys, brass, ferritic alloy steels, and any combination thereof. In some embodiments, the metal is steel(s) such as carbon steel, low carbon steel, mild steel, medium carbon steel, high carbon steel, alloy steel, stainless steel, austenitic steel, ferritic steel, martensitic steel, tool steel, or mixtures thereof. Preferably, the metal is carbon steel. More preferably, the metal is a mild steel, for example mild steel with a carbon content of up to 0.3%, preferably 0.1 to 0.25%, preferably 0.15 to 0.2%, for example, 1018 (e.g. AISI 1018), ASTM A36, 12L14, ASTM A653, and other steel alloys such as A366/1008, A513 (alloy 1020-1026), 8620 alloy.

In general, the dosage of the polyurea suitable for inhibiting corrosion may be dependent upon many factors, such as the corrosivity of the system, the water cut realized in the application, and the conditions at the metal surface such as the corrosive medium flow rate, temperature, etc. While concentrations of the polyurea above 250 ppm may be used, the formulation is preferably introduced into the corrosive medium in an amount sufficient to provide the corrosive medium with a concentration of polyurea ranging from 1 to 250 ppm, preferably 2 to 240 ppm, preferably 3 to 230 ppm, preferably 4 to 220 ppm, preferably 5 to 210 ppm, preferably 10 to 200 ppm, preferably 12 to 190 ppm, preferably 14 to 180 ppm, preferably 16 to 170 ppm, preferably 18 to 160 ppm, preferably 20 to 150 ppm, preferably 22 to 140 ppm, preferably 24 to 130 ppm, preferably 26 to 120 ppm, preferably 28 to 110 ppm, preferably 30 to 100 ppm, preferably 32 to 95 ppm, preferably 34 to 90 ppm, preferably 36 to 85 ppm, preferably 38 to 80 ppm, preferably 40 to 75 ppm, preferably 42 to 70 ppm, preferably 44 to 65 ppm, preferably 46 to 60 ppm, preferably 48 to 55 ppm, preferably 50 to 52 ppm.

The methods of the present disclosure provide an anticorrosive effect at a variety of temperatures common to the oil and gas industry, which can on occasion exceed temperatures of 120° C. to 140° C. In preferred embodiments, the formulation is introduced into a corrosive medium having a temperature of 10 to 120° C., preferably 15 to 100° C., preferably 20 to 80° C., preferably 30 to 70° C., preferably 40 to 60° C., preferably 45 to 55° C. Typically, the corrosivity of a system (and thus the rate of metal corrosion) is most severe at high temperatures, and as the temperature increases, so does the rate of corrosion. As a result, the anticorrosion effects of corrosion inhibitors tends to diminish with increasing temperatures, necessitating the use of larger amounts of corrosion inhibitors to keep pace with the increase in corrosivity. Such a trend is particularly problematic in oil and gas settings where high temperatures are a common occurrence, and the use of large quantities of corrosion inhibitors is cost prohibitive. However, it has been surprisingly found that the anticorrosion effect provided by the polyurea of the present disclosure increases as a function of temperature (see Tables 1-4). This unexpected behavior makes the polyurea of the present disclosure particularly well suited for oil and gas field environments, especially those where the corrosive medium has a temperature of at least 40° C., preferably at least 45° C., preferably at least 50° C., preferably at least 55° C., preferably at least 60° C., preferably at least 65° C., preferably at least 70° C., e.g., downhole applications before, during, or after extraction, injection, or recovery of hydrocarbons or drilling fluids.

Corrosion rate is the speed at which metals undergo deterioration within a particular environment. Corrosion rate may be measured according to the American Society for Testing and Materials (ASTM) standard weight loss (immersion) test (e.g., according to ASTM G31-72), or may be computed using millimeter penetration per year (mmpy), for example using Tafel extrapolation of potentiodynamic polarization (PDP) measurements. In some embodiments, the method of the present disclosure provides a metal corrosion rate of 0.005 to 1 mmpy, preferably 0.007 to 0.95 mmpy, preferably 0.01 to 0.9 mmpy, preferably 0.02 to 0.85 mmpy, preferably 0.03 to 0.8 mmpy, preferably 0.04 to 0.75 mmpy, preferably 0.05 to 0.7 mmpy, preferably 0.06 to 0.65 mmpy, preferably 0.07 to 0.6 mmpy, preferably 0.08 to 0.55 mmpy, preferably 0.09 to 0.5 mmpy, preferably 0.1 to 0.45 mmpy, preferably 0.12 to 0.4 mmpy, preferably 0.14 to 0.35 mmpy, preferably 0.16 to 0.33 mmpy, preferably 0.18 to 0.3 mmpy, preferably 0.2 to 0.29 mmpy, preferably 0.22 to 0.28 mmpy, preferably 0.24 to 0.27 mmpy, preferably 0.25 to 0.26 mmpy.

Corrosion inhibition efficiency (IE % or r %) may be measured with the Tafel extrapolation of potentiodynamic polarization (PDP) or electrochemical impedance spectroscopy measurements (EIS). In preferred embodiments, the method described herein achieves a corrosion inhibition efficiency of 77 to 99.9%, preferably 79 to 99.8%, preferably 80 to 99.7%, preferably 82 to 99.6%, preferably 84 to 99.5%, preferably 86 to 99.4%, preferably 88 to 99.3%, preferably 90 to 99.2%, preferably 91 to 99.1%, preferably 92 to 99%, preferably 93 to 98.9%, preferably 94 to 98.8%, preferably 95 to 98.7%, preferably 96 to 98.6%, preferably 97 to 98.5%, preferably 97.5 to 98%.

The examples below are intended to further illustrate protocols for preparing, characterizing the polyurea and the formulation containing the polyurea and uses thereof, and are not intended to limit the scope of the claims.

Where a numerical limit or range is stated herein, the endpoints are included. Also, all values and subranges within a numerical limit or range are specifically included as if explicitly written out.

As used herein the words "a" and "an" and the like carry the meaning of "one or more."

The present disclosure also contemplates other embodiments "comprising", "consisting of" and "consisting essentially of", the embodiments or elements presented herein, whether explicitly set forth or not.

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

EXAMPLES

Materials and Methods

Synthesis of PUCorr-2

Figure 16:
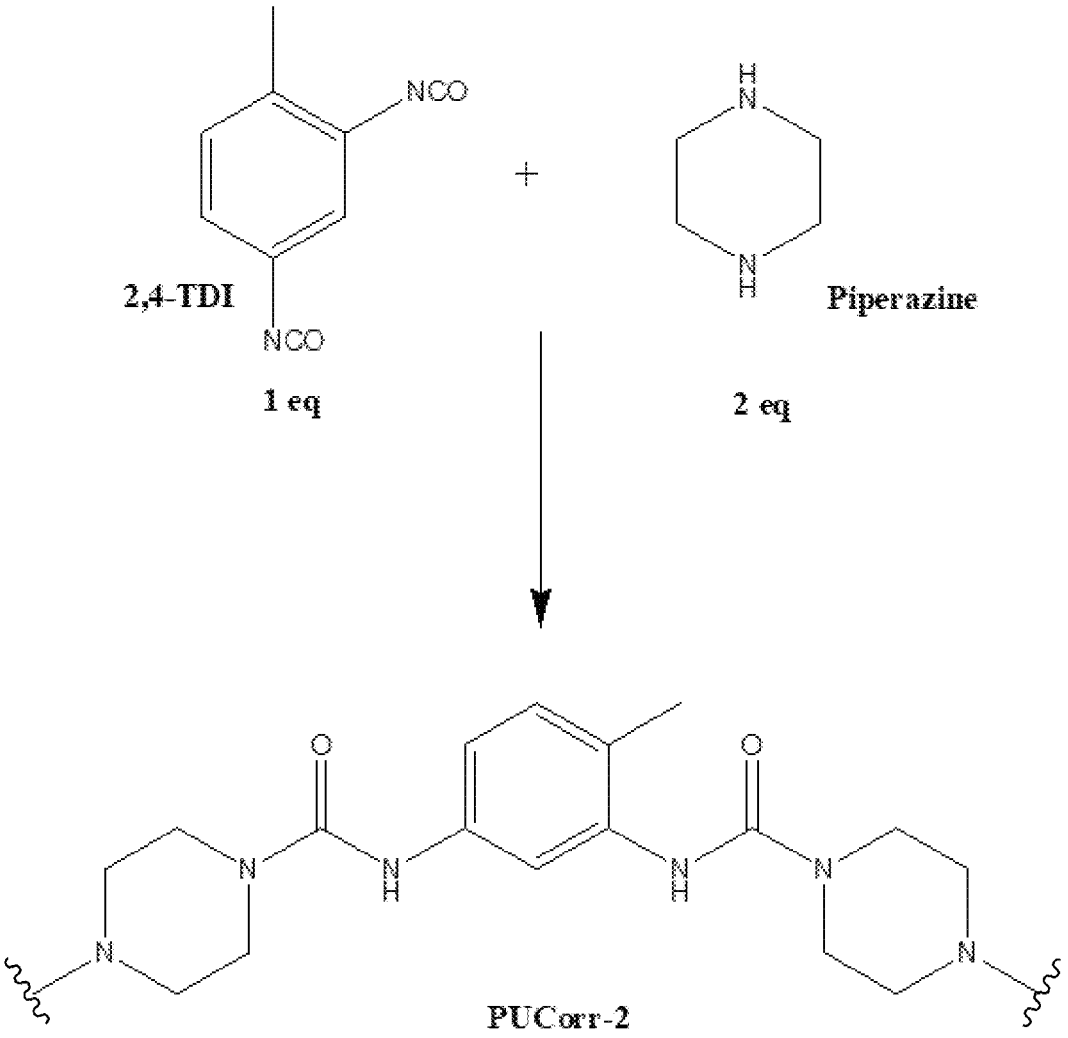
FIG. 16 illustrates a synthetic scheme for making the piperazine-based polyurea, PUCorr-2.

All chemicals were of high purity and used without further purifications. They include; toluene diisocyanate (TDI, 95%), Sigma Aldrich, piperazine (PPZ, 99%), Sigma Aldrich, hydrochloric acid, sodium chloride (Fisher Scientific) and N-methyl-2-pyrrolidone (Riedel-de Haen). To enhance the dispersion of PUCorr-2 in the electrolyte solutions, N-methyl-2-pyrrolidone was added (1:100 v/v) in both blank solutions and solutions containing the inhibitor (PUCorr-2). PUCorr-2 was synthesized following a previously reported procedure (F. Zhang, X. Jiang, X. Zhu, Z. Chen, X. Z. Kong, Preparation of uniform and porous polyurea microspheres of large size through interfacial polymerization of toluene diisocyanate in water solution of ethylene diamine, Chemical Engineering Journal, 303 (2016) 48-55, incorporated herein by reference in its entirety) with slight modifications (FIG. 16): Piperazine, PPZ (0.86 g, 10 mmol), was added to 20 ml acetonitrile in a three-necked round bottomed flask and immersed in an oil bath at 60° C. until it dissolved completely. Thereafter, toluene diisocyanate, TDI (0.90 g, 5 mmol), was added-drop wise while stirring at 600 rpm, and the polymerization was allowed to continue for 6 h. At the end of 6 h, the product was filtered, washed in acetone and dried up in a vacuum oven at 70° C. until a constant mass was reached. The resulting powder weighed 1.72 g (98% yield). FTIR; 3350 $cm^{-1}$ (s, NH stretch), 3000 $cm^{-1}$ (m, CH stretch), 1680 $cm^{-1}$ (vs, C═O stretch), 1550 $cm^{-1}$ (vs, NH bend, or C═C stretch), 1400 $cm^{-1}$ (vs, $sp^3$ CH bend), 1230 $cm^{-1}$ (vs, CN stretch), 950 $cm^{-1}$ (s, $sp^3$ C—C stretch), 650 $cm^{-1}$ (w, NH wag). $^1H$ NMR (DMSO-$d_6$); δ 1.9 (s, 1H, terminal NH), δ 2.1 (t, 4H, $2CH_2$), δ 2.2 (s, 3H, $CH_3$), δ 2.7 (t, 4H, $2CH_2$), δ 7.0-7.5 (m, 3H, Ar—H) and δ 8.0-8.5 (s, 1H, each of urea NH). $^{13}C$ NMR (DMS0-$d_6$); δ 18.0 ($CH_3$), δ 44.0 and 46.0 ($CH_2$), δ 115.0-140.0 (Ar—C) and δ 156.0 (C═O). Elemental analysis (EDX); C: 54.34 wt %, N: 27.92 wt % and O: 17.74 wt %.

Electrochemical Measurements

Figure 1B:
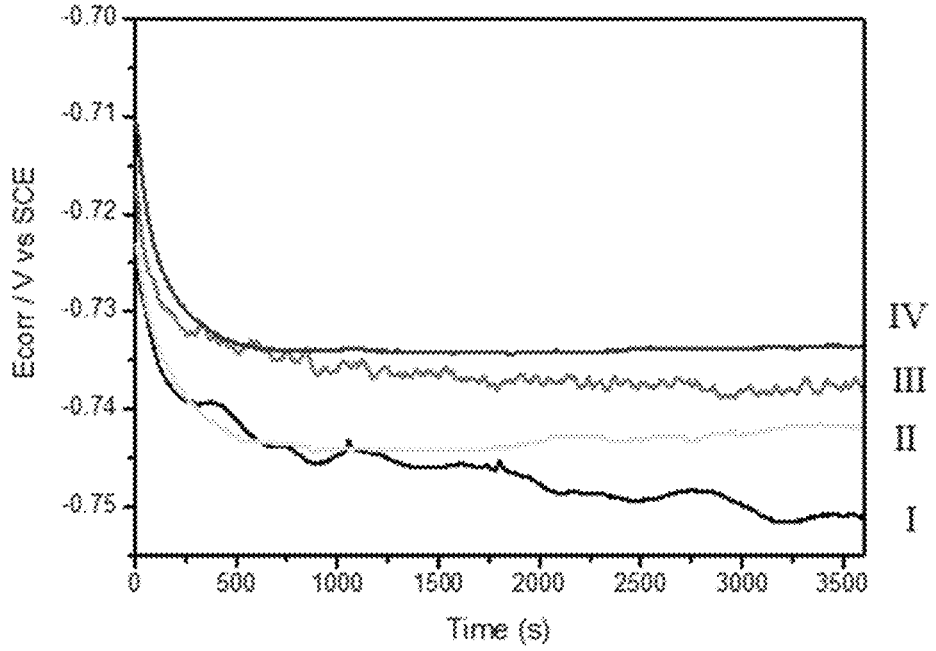

Electrochemical measurements were conducted on a Gamry jacketed electrochemical equipped with three-electrode compartments. Mild steel bar AISI 1018 with compositions; C, 0.15-0.20%; Mn, 0.60-0.90%; P, 0.04%; S, 0.05% and balance Fe was used as the sample specimen, saturated calomel electrode (SCE) and carbon graphite as the reference and counter electrodes, respectively. Gamry potentiostat/galvanostat/ZRA (Reference 600) equipped with a Gamry framework interface was used for electrochemical studies. Gamry Echem Analyst version 6.03 was used for data analysis and fittings. All electrochemical measurements were carried out in triplicates and the average value reported. Prior to the electrochemical measurements, a stabilization period of 60 min was allowed for mild steel specimen in both acid (1.0 M HCl) and saline (0.5 MNaCl) media with advantageous concentrations of PUCorr-2 (20-100 ppm) as shown in FIGS. 1A-1B. Polarization curves were obtained by scanning the potential at 0.5 mV/s in the range +250 mV to −250 mV against the open circuit potential ($E_{ocp}$). To characterize the electrochemical processes occurring at the steel/solution interface in the absence and presence of the inhibitor molecule, electrochemical impedance spectroscopy measurements (EIS) were carried out. EIS measurements were performed at an open circuit potential ($E_{ocp}$ vs SCE) in the frequency range 100 KHz to 100 mHz, with an amplitude of perturbation 10 mV r.m.s. Inhibition efficiencies were calculated using equations (1) and (2), as follows:

$$\eta(\%) = \left(\frac{i^{\circ}_{corr} - i_{corr}}{i^{\circ}_{corr}}\right) \times 100 \quad (1)$$

where $i_{corr}^{o}$ and $i_{corr}$ are corrosion current density values in the absence and presence of the inhibitor obtained from Tafel polarization measurements, respectively, and $$\eta(\%) = \left(\frac{R_p - \check{R}_p}{R_{ct}}\right) \times 100 \quad (2)$$

where $R_p$ and $R_p^{o}$ are the resistances to polarization in the presence and absence of the inhibitor as obtained from EIS measurements, respectively.

DFT Calculations

Full geometry optimization of PUCorr-2 was performed on Gaussian 09 package, using the hybrid-functional of the Becke three-parameters, Lee, Yang and Par (B3LYP) and the 6-31G(d) basis set. See M. J. Frisch, G. W. Trucks, H. B. Schlegel, G. E. Scuseria, M. A. Robb, J. R. Cheeseman, G. Scalmani, V. Barone, B. Mennucci, G. A. Petersson, H. Nakatsuji, M. Caricato, X. Li, H. P. Hratchian, A. F. Izmaylov, J. Bloino, G. Zheng, J. L. Sonnenberg, M. Hada, M. Ehara, K. Toyota, R. Fukuda, J. Hasegawa, M. Ishida, T. Nakajima, Y. Honda, O. Kitao, H. Nakai, T. Vreven, J. A. Montgomery, J. E. Peralta, F. Ogliaro, M. Bearpark, J. J. Heyd, E. Brothers, K. N. Kudin, V. N. Staroverov, R. Kobayashi, J. Normand, K. Raghavachari, A. Rendell, J. C. Burant, S. S. Iyengar, J. Tomasi, M. Cossi, N. Rega, J. M. Millam, M. Klene, J. E. Knox, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, R. L. Martin, K. Morokuma, V. G. Zakrzewski, G. A. Voth, P. Salvador, J. J. Dannenberg, S. Dapprich, A. D. Daniels, Farkas, J. B. Foresman, J. V. Ortiz, J. Cioslowski, D. J. Fox, Gaussian 09, Revision B.01, in, Wallingford Conn., 2009, incorporated herein by reference in its entirety. Structural geometry optimizations of the various forms of the polymer were carried out to the minima on potential energy surfaces without imposing any constrains. Their relative stabilities and the total energies of the natural bonding orbitals were also computed. Reactivity descriptors such as global hardness ($\eta$), electron affinity (A), ionization potential (I), electronegativity ($\chi$), and fraction of transferred electrons ($\Delta N$) were calculated. To further check the possible local reactivity sites on the molecules, Mulliken atomic charge distributions were computed.

Results and Discussion

Characterization of PUCorr-2

Figure 2A:
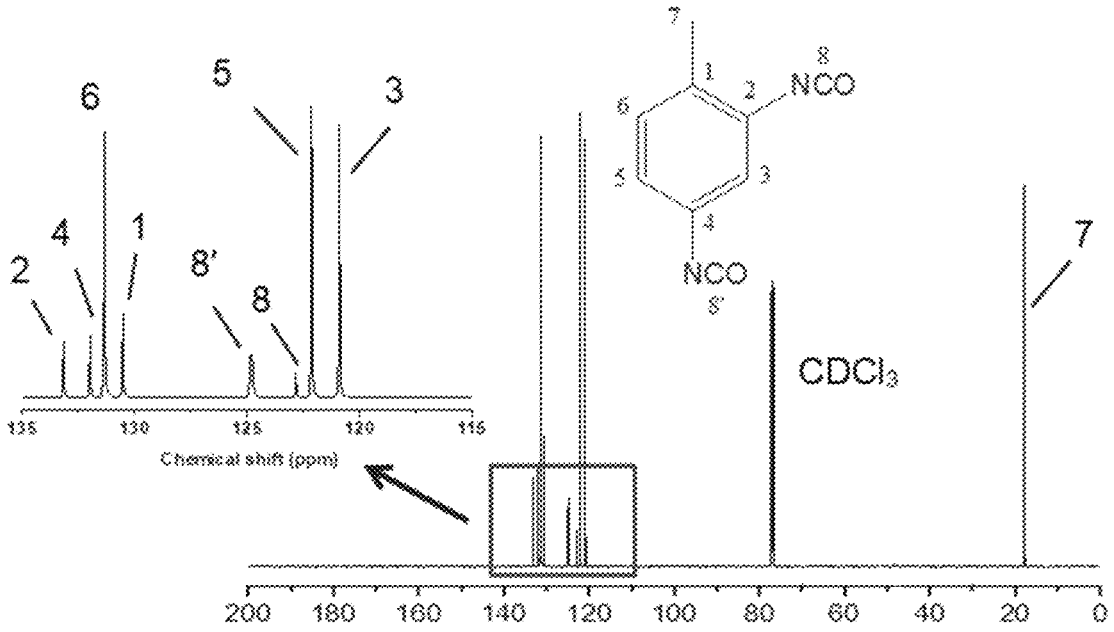
FIGS. 2A-2C illustrate the $^{13}C$ NMR spectra of (FIG. 2A) TDI, (FIG. 2B) piperazine (PPZ), and (FIG. 2C) PUCorr-2.
Figure 2B:
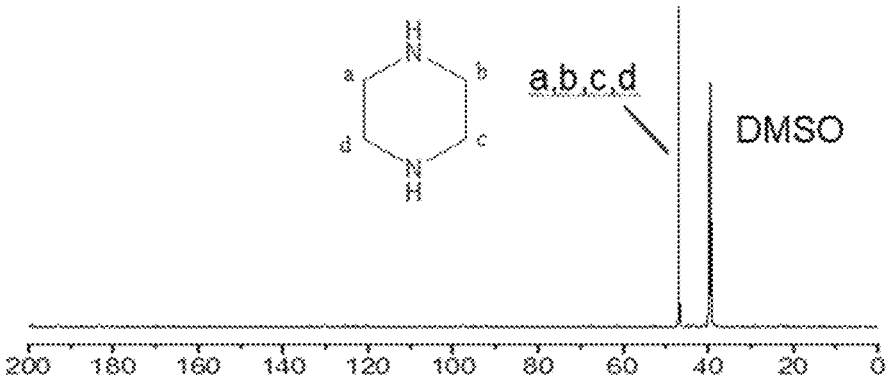
Figure 2C:
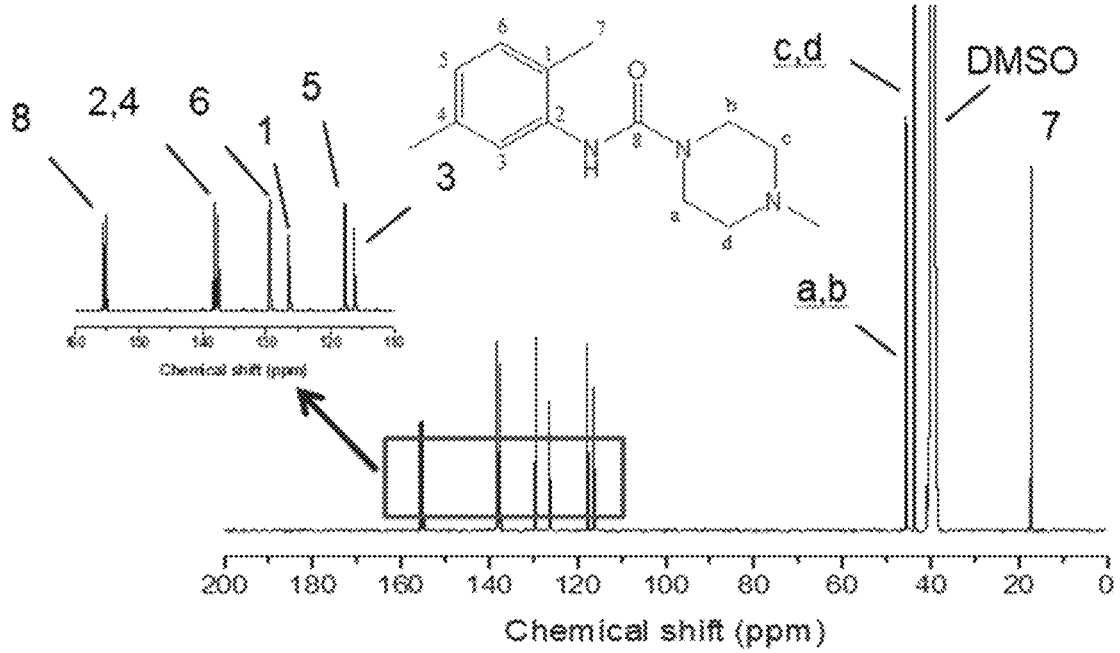

To check the successful synthesis and level of purity of PUCorr-2, $^{1}H$ NMR and $^{13}C$ NMR techniques were utilized. Similar tests were conducted on the monomers and the results are presented in FIGS. 2A-2C and FIG. 3A-3C. The $^{13}C$ NMR spectra of PUCorr-2 and its monomers are presented in FIGS. 2A-C. Assignment of $^{13}C$ resonance peaks followed an earlier reported procedure and are labeled as shown in these figures. See H. Han, S. Li, X. Zhu, X. Jiang, X. Z. Kong, One step preparation of porous polyurea by reaction of toluene diisocyanate with water and its characterization, RSC Advances, 4 (2014) 33520-33529, incorporated herein by reference in its entirety. The $^{13}C$ resonance spectrum of toluene diisocyanate, TDI showed a single peak at chemical shift 18.0 ppm corresponding to the methyl carbon ($C_7$) present on the molecule. Others are the aromatic and isocyanate carbon atoms labeled and identified accordingly as shown in FIG. 2A. The $^{13}C$ NMR spectrum of piperazine, PPZ (FIG. 2B) gave a single peak at around 48.0 ppm corresponding to the four methylene carbon atoms in the molecule. Resonance peak of the compound appeared at the same chemical shift because all four carbon atoms have the same chemical environment. In the case of PUCorr-2 (FIG. 2C), it can be seen that while the methyl carbon atom of TDI ($C_7$) appeared at the same chemical shift as in the monomer, the methylene carbon atoms in PPZ now have different chemical environments and appeared separately as $C_a$,$C_b$ and $C_c$,$C_d$ at 44.0 and 46.0 ppm, respectively. Furthermore, peaks assigned to —NCO carbons ($C_8$ and $C_{8'}$) at 123.0 and 125.0 ppm is now absent. In addition, peaks assigned to carbon atoms bearing the —NCO group ($C_2$ and $C_4$) both appeared shifted due to the formation of urea linkage. New peaks appeared at around chemical shift 155.5 ppm and have been assigned to characteristic resonances of the carbonyl (C═O) linkage in polyurea.

Figure 3A:
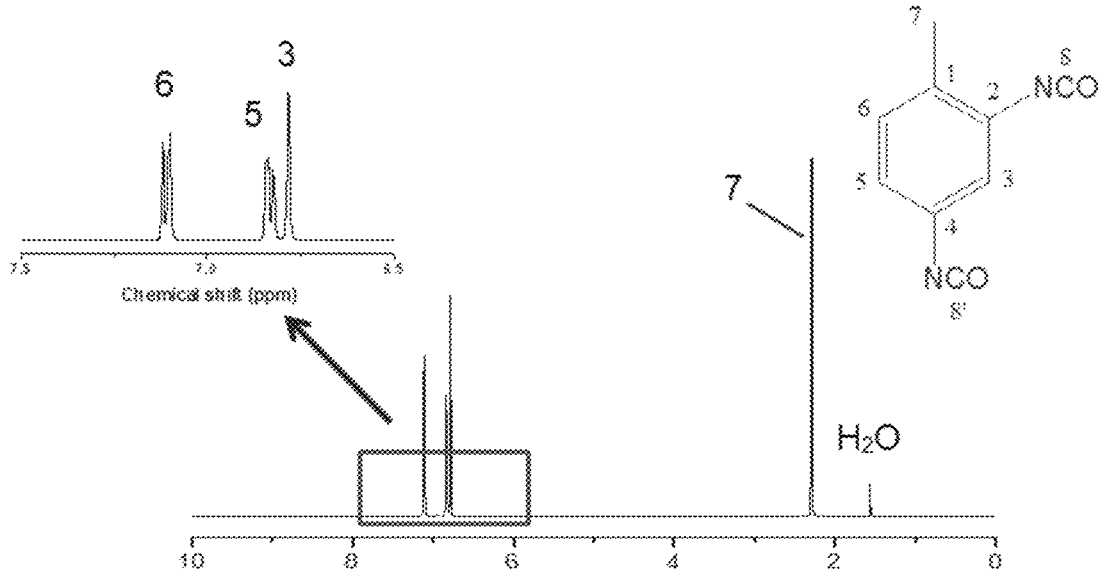
FIGS. 3A-3C illustrate the $^{1}H$ NMR spectra of (FIG. 3A) TDI, (FIG. 3B) PPZ, and (FIG. 3C) PUCorr-2.
Figure 3B:
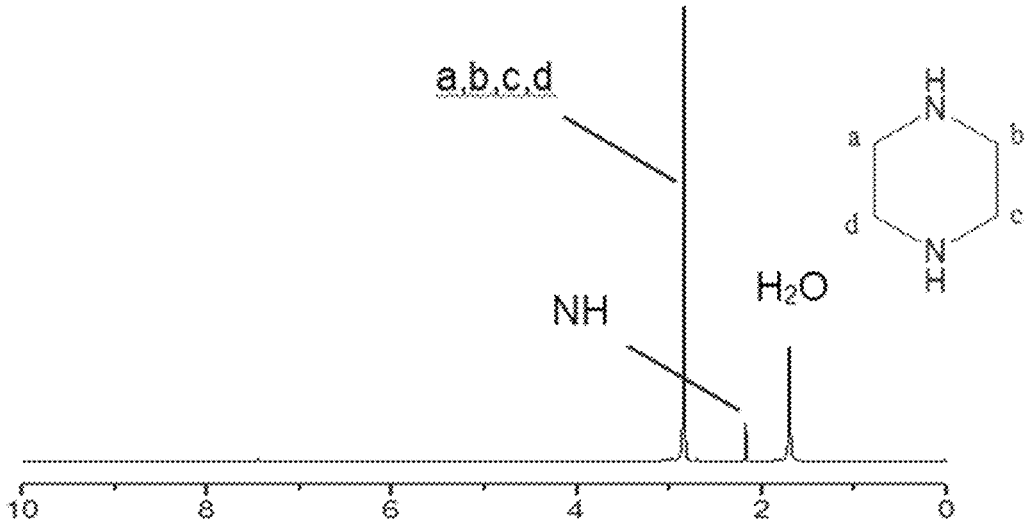
Figure 3C:
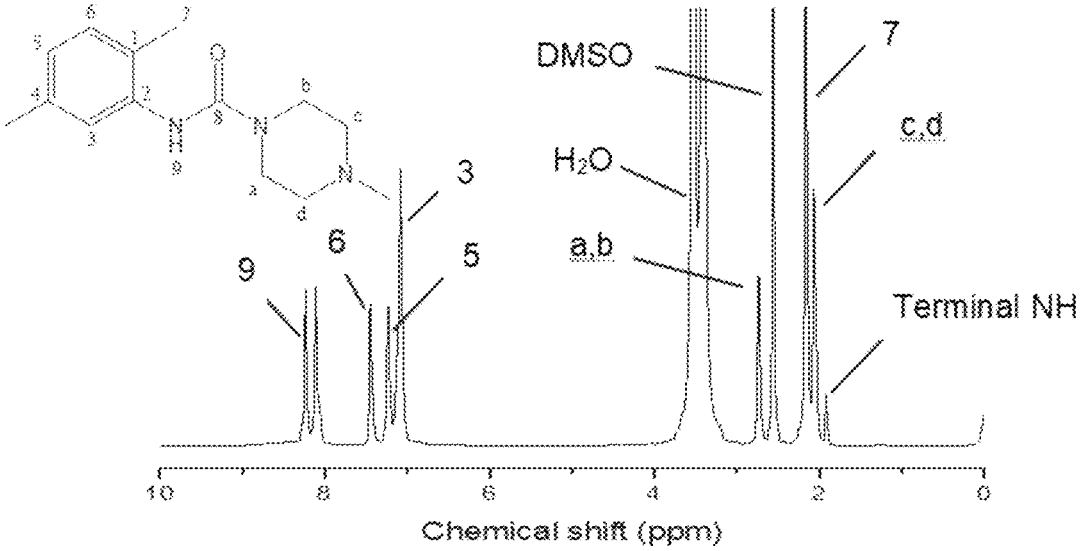

PUCorr-2 and the monomers were further characterized using $^{1}H$ NMR spectroscopy as presented in FIGS. 3A-3C. Notably from the $^{1}H$ NMR spectrum of TDI (FIG. 3A), four distinct resonance peaks at chemical shifts 2.40, 6.76, 6.80 and 7.15 ppm were present corresponding to the methyl ($H_7$) and aromatic proton atoms ($H_3$, $H_5$ and $H_6$), respectively. The spectrum of PPZ on the other hand (FIG. 3B) gave two resonance peaks at 2.20 and 2.80 ppm corresponding to the —NH and methylene protons ($H_a$, $H_b$, $H_c$ and $H_d$), respectively. $^{1}H$ NMR spectrum of PUCorr-2 (FIG. 3C) showed a resonance peak at 1.90 ppm (singlet) corresponding to terminal —NH protons on the polymer. Others are resonance peaks at 2.10 ppm (triplet, 4H $H_c$ and $H_d$), 2.20 ppm (singlet, 3H, $H_7$) and 2.70 ppm (triplet, 4H, $H_a$ and $H_b$). Solvent (DMSO) and residual water peaks appeared at 2.55 and 3.50 ppm, respectively while aromatic protons ($H_3$, $H_5$ and $H_6$) appeared in the region 7.00-7.50 ppm. Finally, —NH protons of the urea linkage appeared at 8.10-8.20 ppm due the difference in chemical environments.

Figure 4A:
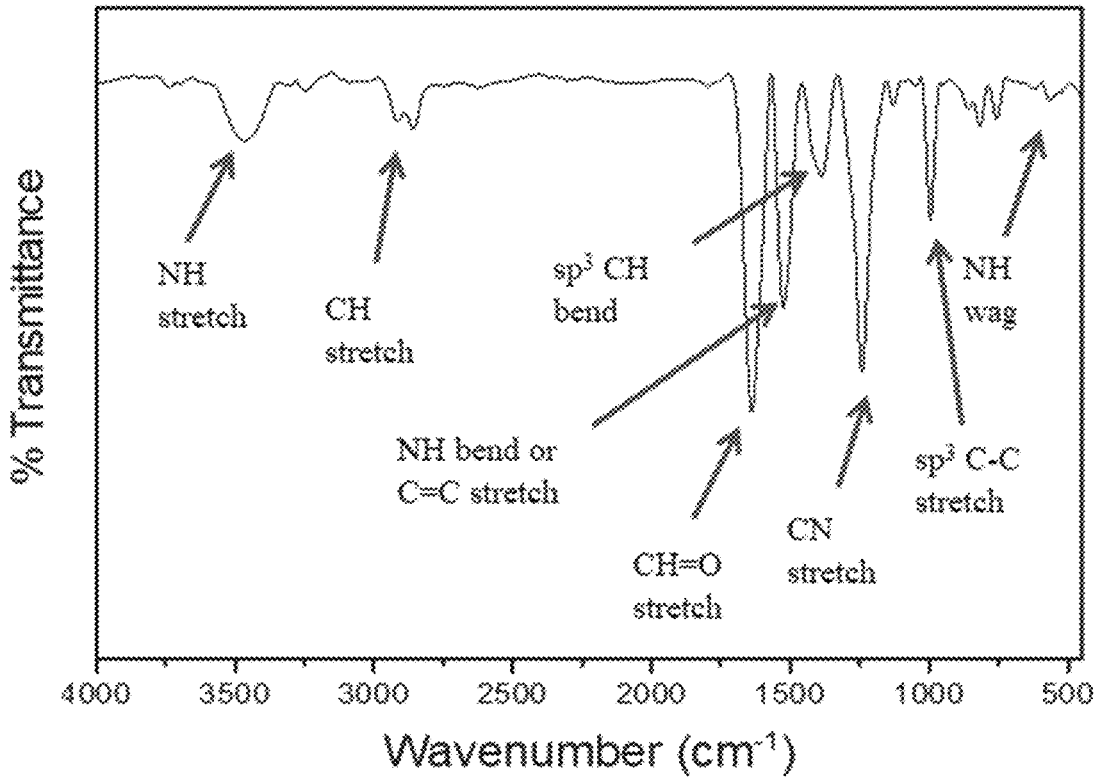
FIGS. 4A-4B are graphs illustrating the (FIG. 4A) FT-IR and (FIG. 4B) TGA spectra of PUCorr-2.
Figure 4B:
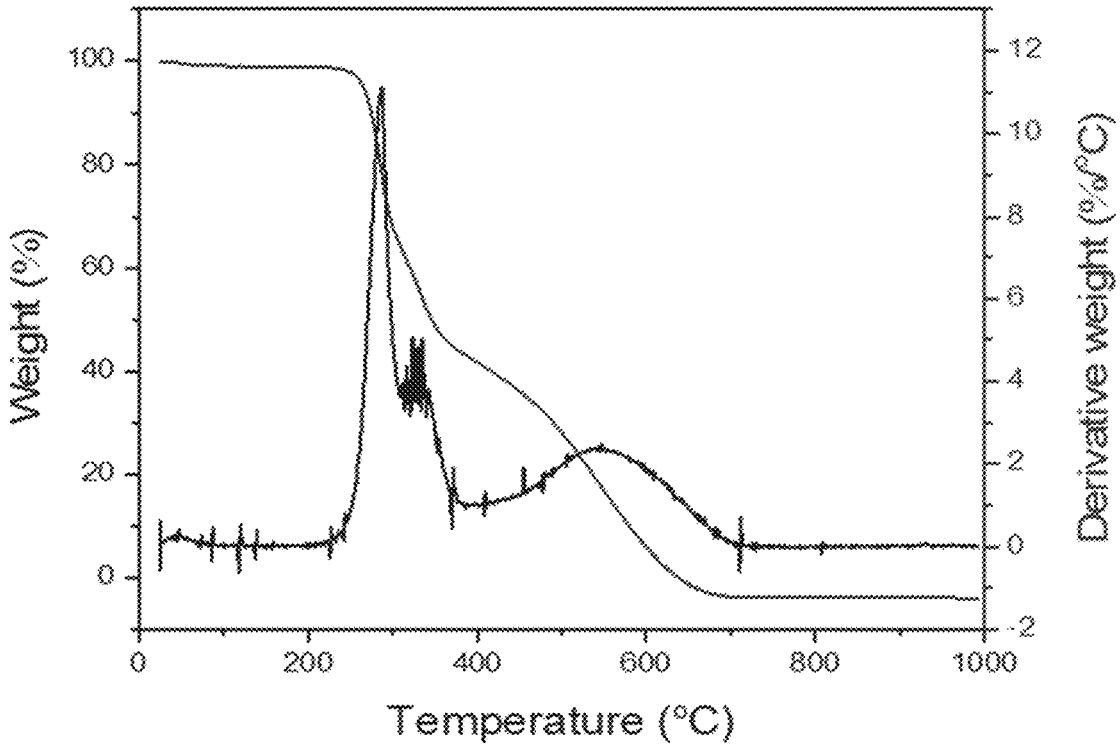
Figure 5A:
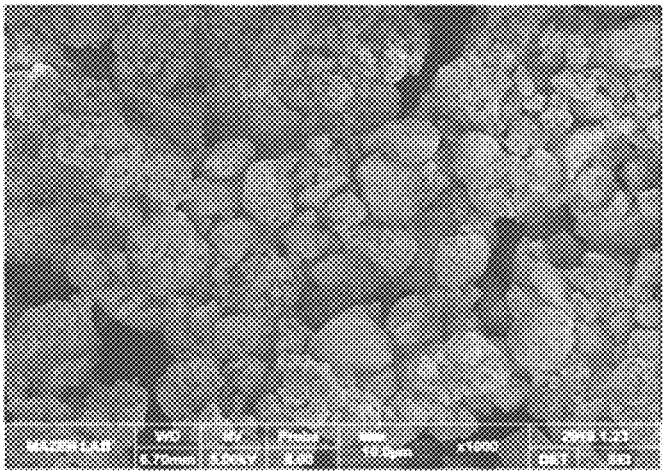
FIGS. 5A-5C illustrate the morphological features (FIG. 5A), elemental composition (FIG. 5B) and x-ray powder diffraction (FIG. 5C) of PUCorr-2.
Figure 5B:
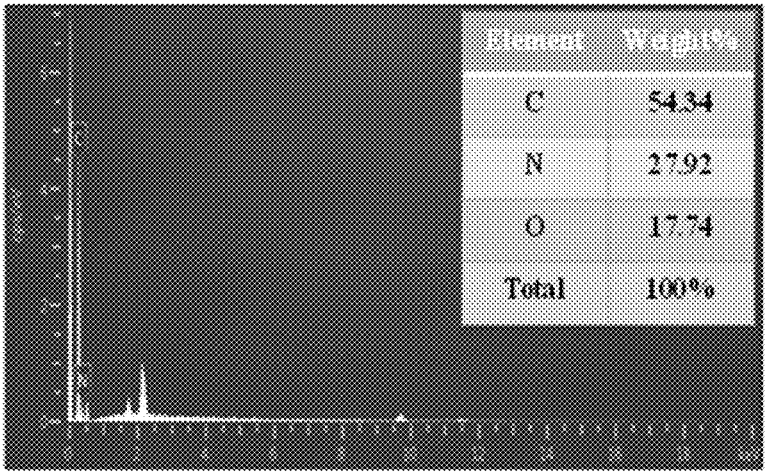
Figure 5C:
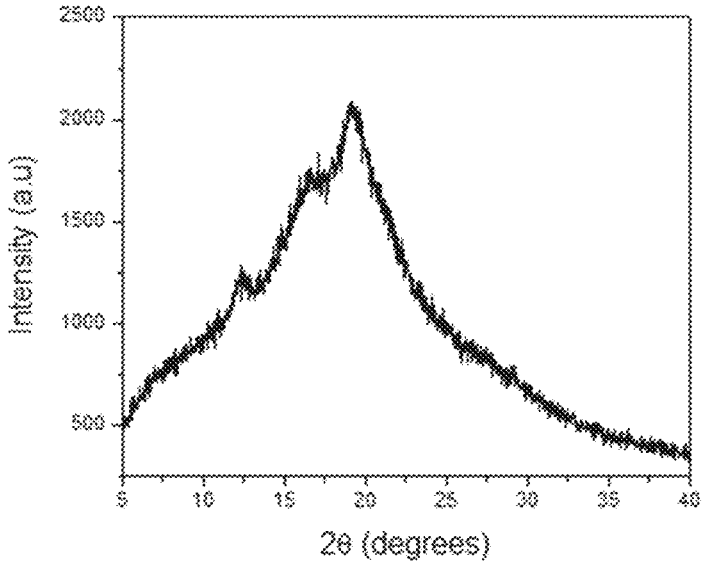
Figure 6A:
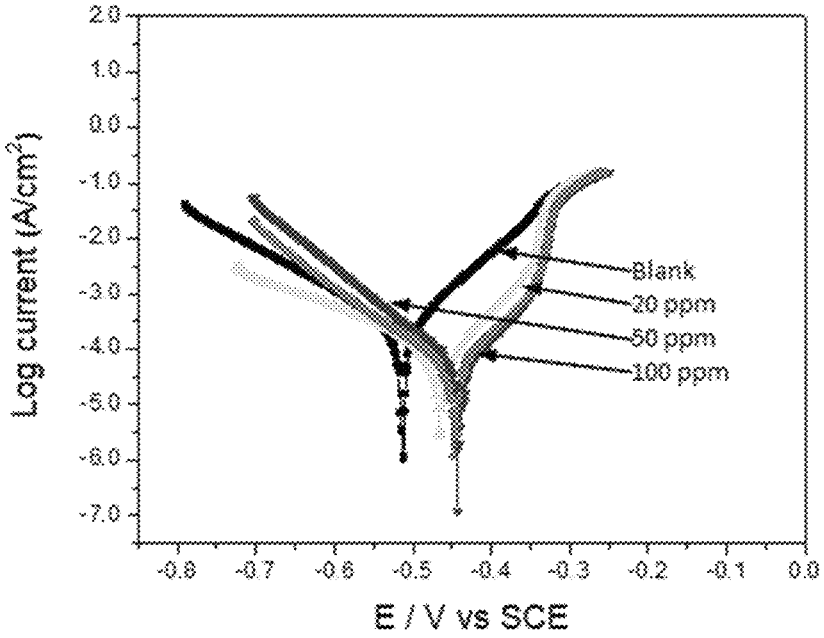
FIGS. 6A-6E are graphs illustrating the Tafel polarization curves of mild steel specimen in 1.0 M HCl in the absence (blank) and presence of PUCorr-2 (20-100 ppm) at (FIG. 6A) 298 K, (FIG. 6B) 303 K, (FIG. 6C) 313 K, (FIG. 6D) 323 K and (FIG. 6E) 333 K.
Figure 6B:
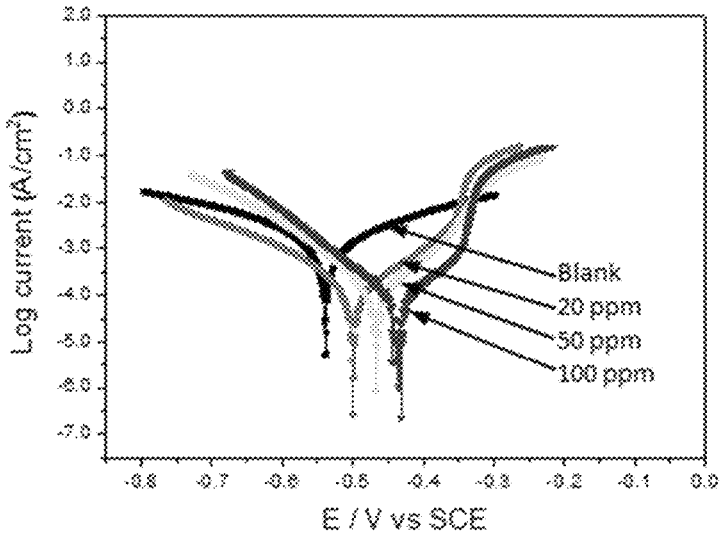
Figure 6C:
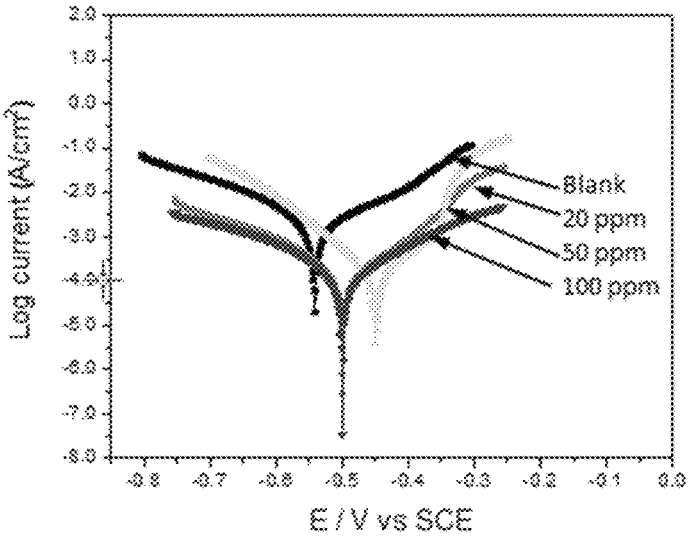
Figure 6D:
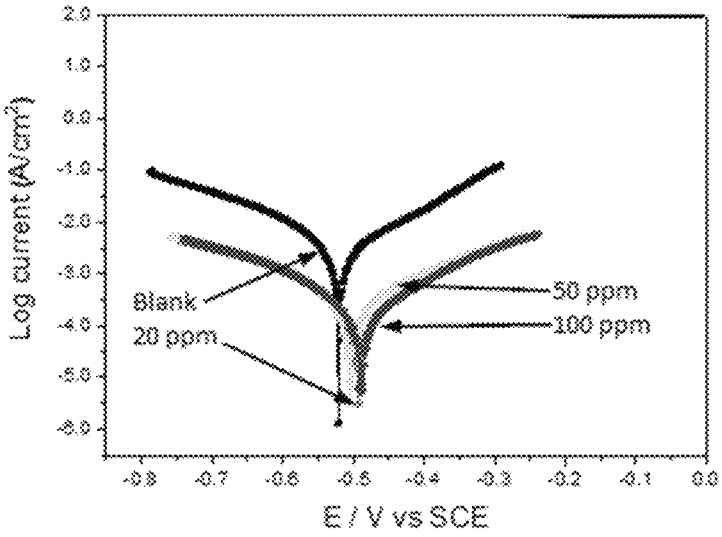
Figure 6E:
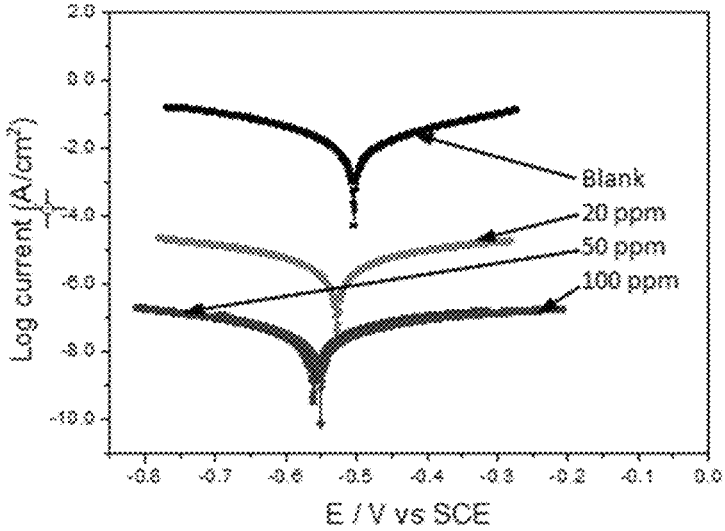
Figure 7A:
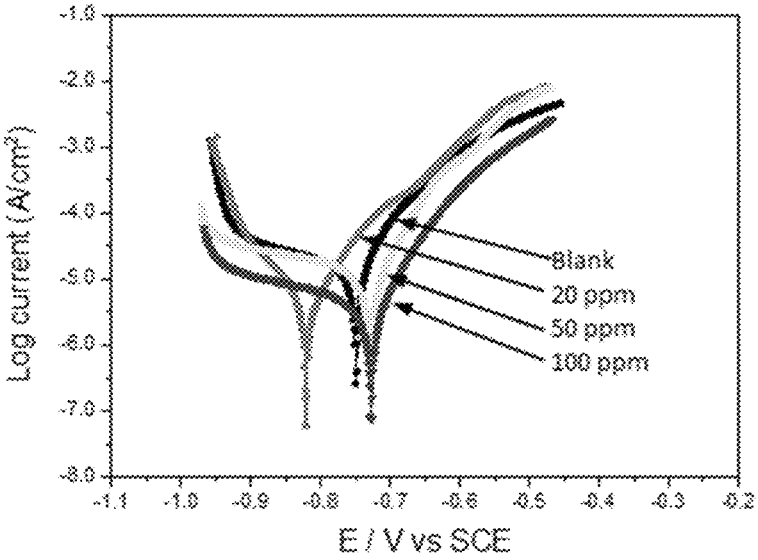
FIGS. 7A-7E are graphs illustrating the Tafel polarization curves of mild steel specimen in 0.5 M NaCl in the absence (blank) and presence of PUCorr-2 (20-100 ppm) at (FIG. 7A) 298 K, (FIG. 7B) 303 K, (FIG. 7C) 313 K, (FIG. 7D) 323 K and (FIG. 7E) 333 K.
Figure 7B:
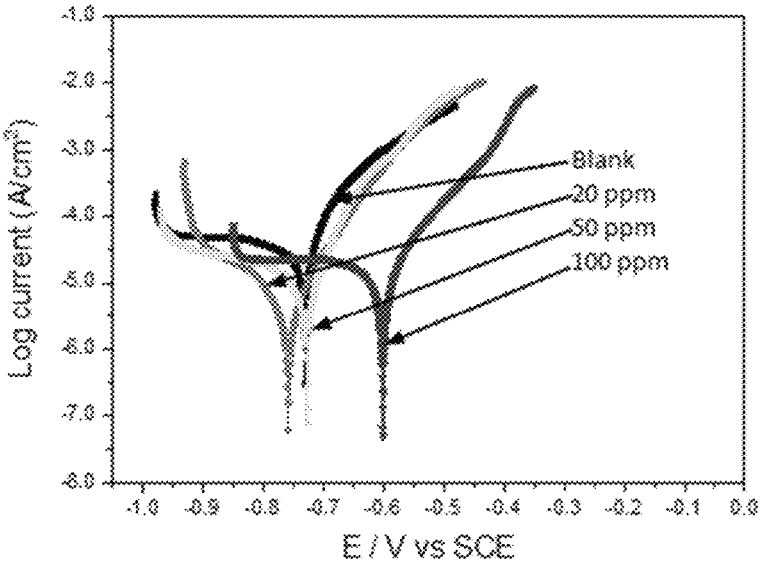
Figure 7C:
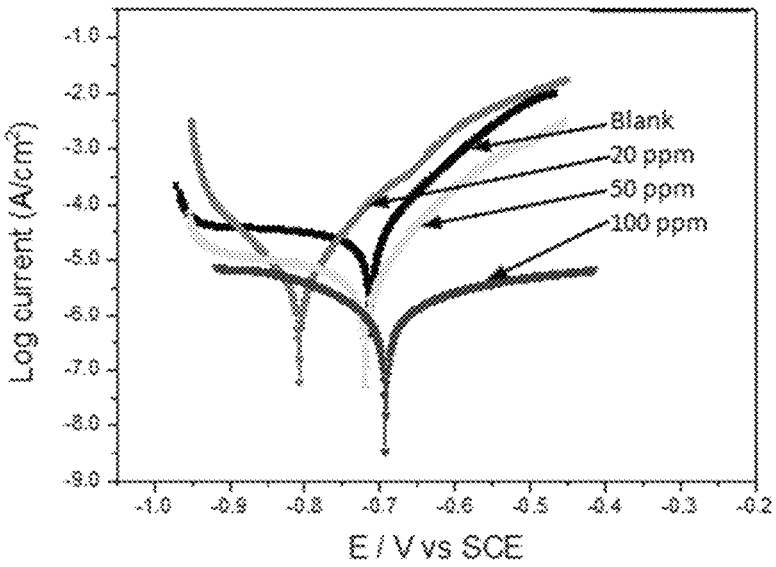
Figure 7D:
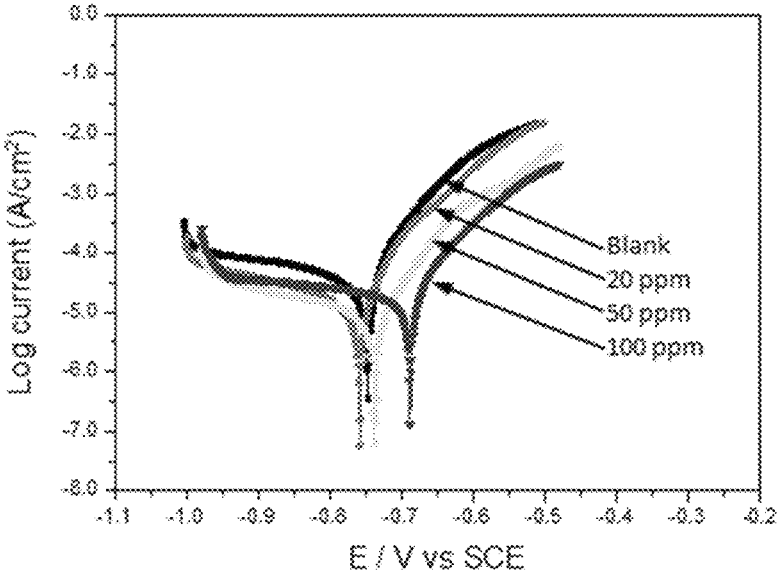
Figure 7E:
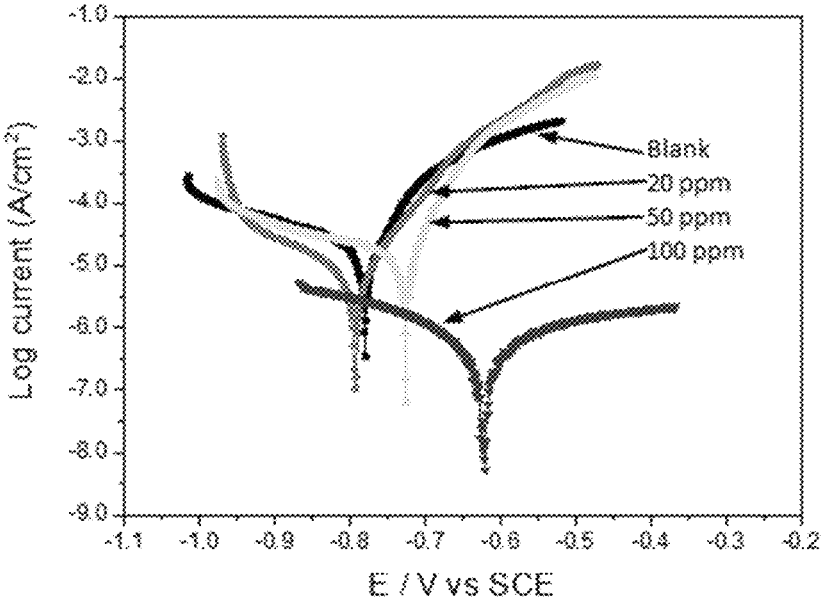
Figure 8A:
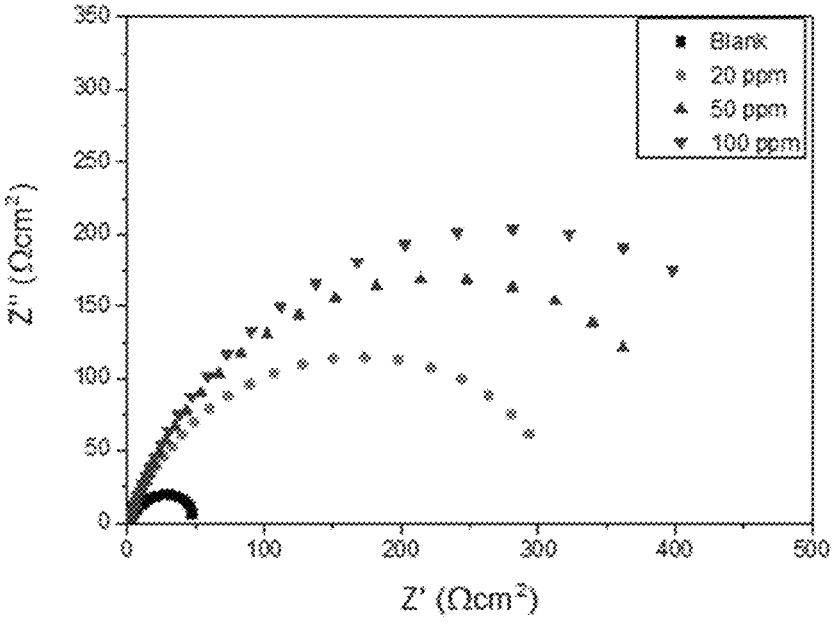
FIGS. 8A-8D are graphs of the mild steel specimen in 0.5 M NaCl in the absence and presence of 20-100 ppm PUCorr-2 at (FIG. 8A) 298 K using a Nyquist plot, (FIG. 8B) 298 K using a Bode plot, (FIG. 8C) 333 K using a Nyquist plot, and (FIG. 8D) 333 K using a Bode plot.
Figure 8B:
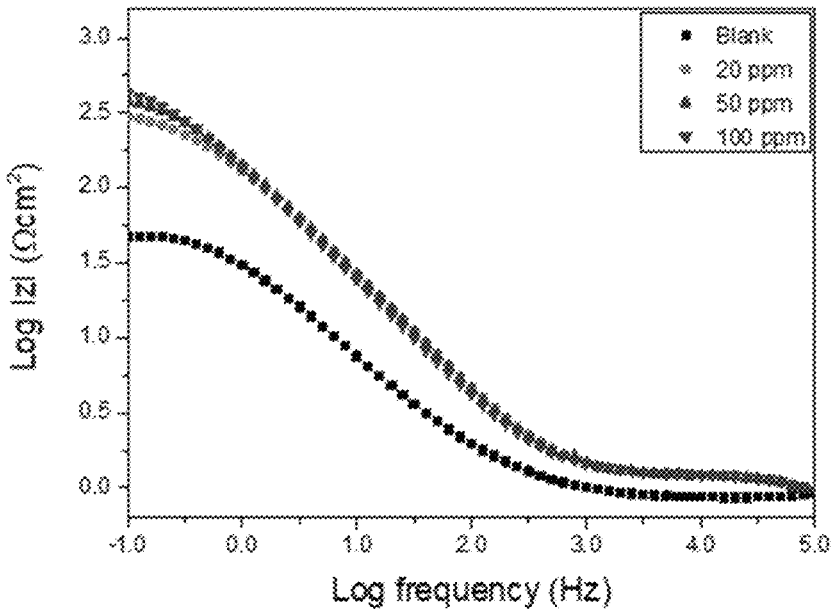
Figure 8C:
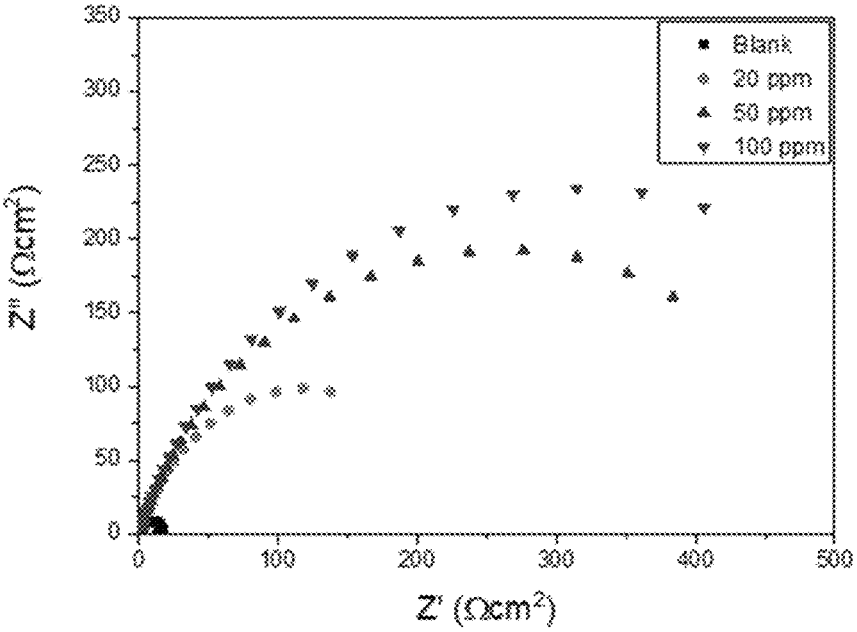
Figure 8D:
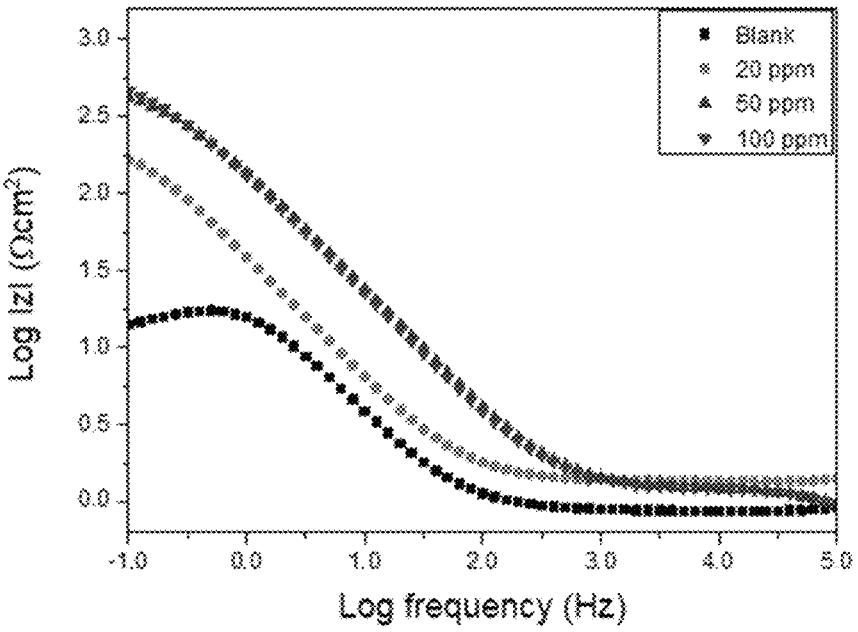
Figure 8E:
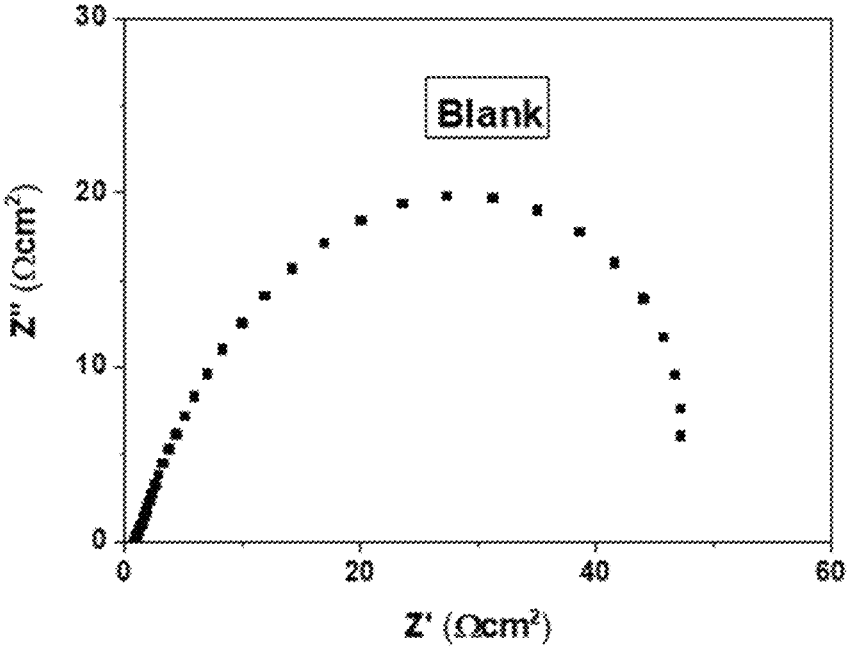
FIGS. 8E-8F represents expanded Nyquist plots in blank solution at (FIG. 8E) 298 K and (FIG. 8F) 333 K.
Figure 8F:
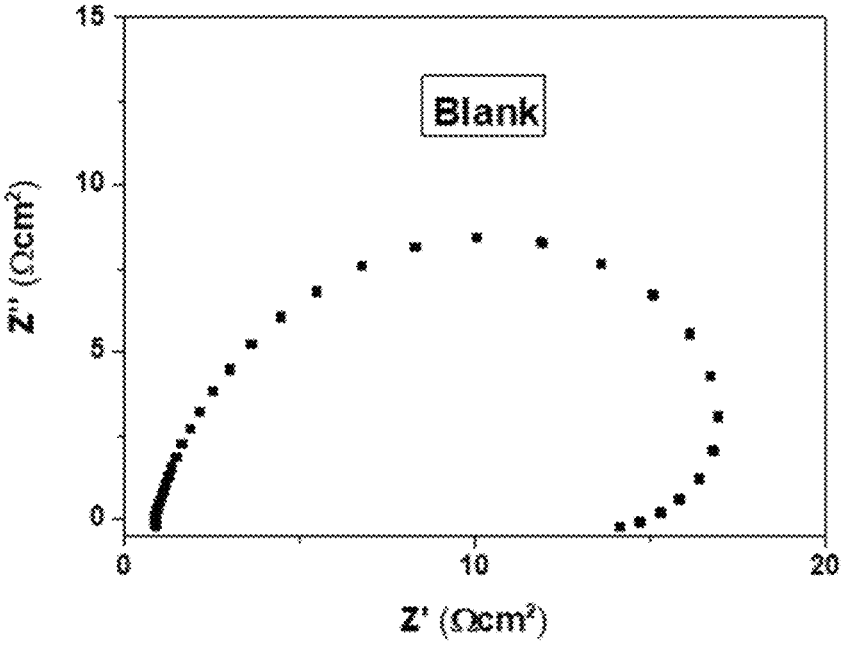
Figure 9A:
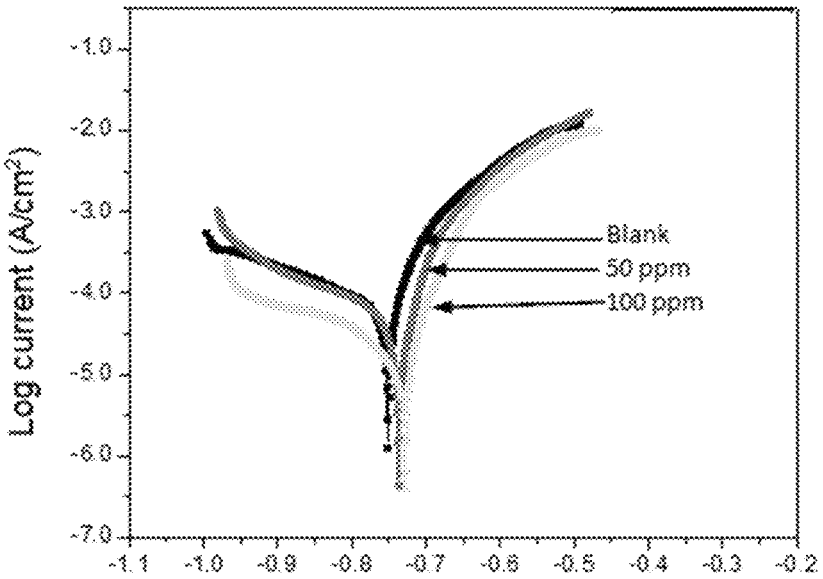
FIGS. 9A-9D are graphs illustrating the Tafel polarization curves of mild steel specimen in 0.5 M NaCl saturated with $CO_2$ gas in the absence (blank) and presence of PUCorr-2 (50-100 ppm) at (FIG. 9A) 298 K, (FIG. 9B) 303 K, (FIG. 9C) 313 K and (FIG. 9D) 323 K.
Figure 9B:
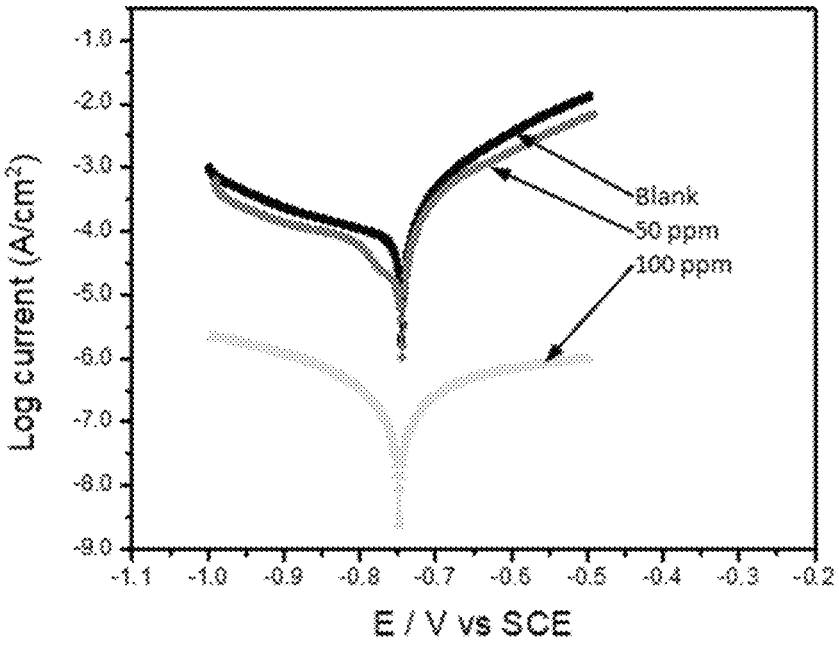
Figure 9C:
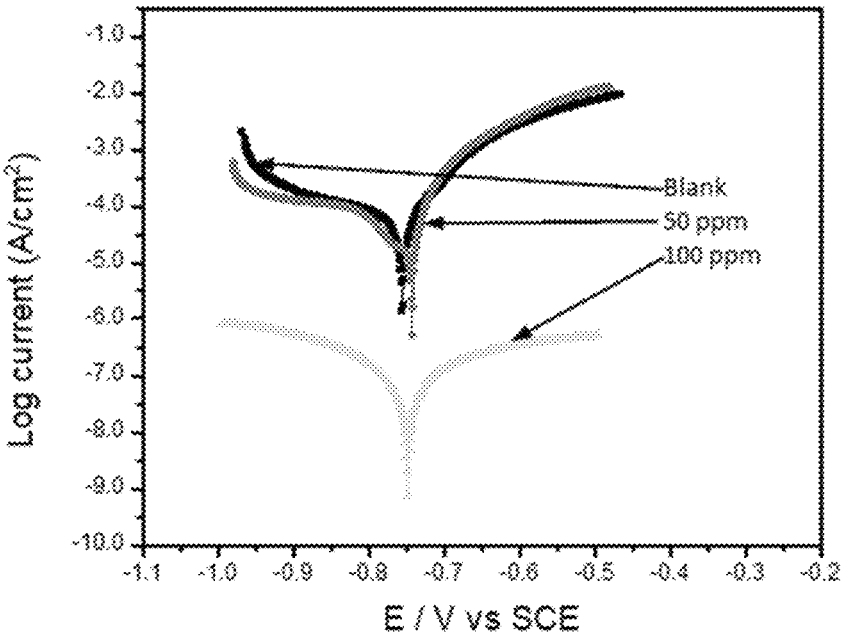
Figure 9D:
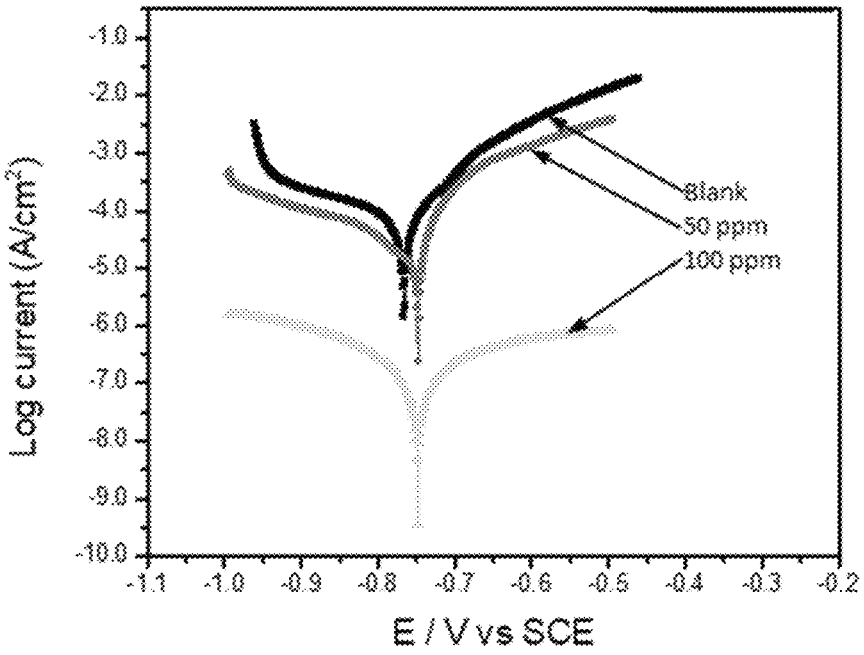

The FT-IR spectrum of PUCorr-2 (FIG. 4A) shows a strong absorption band at 3350 $cm^{-1}$ corresponding to —NH vibrational stretch. The medium band at 3000 $cm^{-1}$ corresponds to CH vibrational stretch, while the very strong band at 1680 $cm^{-1}$ corresponds to the C═O stretch. See Y. Yang, X. Jiang, X. Zhu, X. Z. Kong, A facile pathway to polyurea nanofiber fabrication and polymer morphology control in copolymerization of oxydianiline and toluene diisocyanate in acetone, RSC Advances, 5 (2015) 7426-7432, incorporated herein by reference in its entirety. Others are; $sp^3$ CH bend at 1400 $cm^{-1}$, CN stretch at 1230 $cm^{-1}$, $sp^3$ C—C stretch at 950 $cm^{-1}$ and —NH wag at 650 $cm^{-1}$, respectively. A very strong absorption band appeared at 1550 $cm^{-1}$ and it could not be ascertained whether this band is due to —NH bend or C═C stretch as both bands occurs in this region. Thermal degradation characteristics of PUCorr-2 were further investigated by TGA analysis. As shown in FIG. 4B two major losses in weight were recorded at 300° C. and 550° C. referring to the combustion of nitrogenous organic fractions present in the polymer with the release of $CO_2$, NO, and $H_2O$ species, respectively. See T. A. Saleh, S. A. Haladu, S. A. Ali, A novel cross-linked pH-responsive tetrapolymer: Synthesis, characterization and sorption evaluation towards Cr(III), Chemical Engineering Journal, 269 (2015) 9-19, incorporated herein by reference in its entirety. Morphological characterization of PUCorr-2 revealed a cluster of porous spherical materials, while elemental analysis using EDX confirmed the composition to be mainly C, N and O. X-ray diffraction analysis revealed abroad peak characteristic of amorphous materials (FIGS. 5A-5C).

Electrochemical Corrosion Studies

To understand the electrochemical behavior of the corrosion inhibition process, potentiodynamic polarization measurements were carried out on mild steel specimen in 1.0 M HCl in the absence and presence of PUCorr-2 at different concentrations (20-100 ppm) and temperatures (25-60° C.). FIGS. 6A-6E shows the Tafel polarization curves, while the corresponding extrapolated data are given in Table 1. Notably from these data, the corrosion current density ($i_{corr}$) decreases with the presence of PUCorr-2. This indicates that there are adsorbed layers of the polymer on the metal surface, leading to corrosion inhibition. Furthermore, the polarization curves of the inhibited solutions showed a decrease in anodic and cathodic slopes compared to the un-inhibited (blank) solution. This indicates that the anodic reaction (metal dissolution) and the cathodic reaction (hydrogen evolution) were both inhibited. The variation in Tafel slope indicates that PUCorr-2 influences the kinetics of hydrogen evolution reaction leading to an increase in the energy barrier for proton discharge which subsequently results into less gas evolution. See L. R. Chauhan, G. Gunasekaran, Corrosion inhibition of mild steel by plant extract in dilute HCl medium, Corrosion Science, 49 (2007) 1143-1161, incorporated herein by reference in its entirety.

A shift in corrosion potential ($E_{corr}$) was also observed with the addition of PUCorr-2 and with increasing temperature in a manner that suggests that the adsorbed polymer films acted as mixed-type corrosion inhibitor, impeding both anodic and cathodic processes with more pronounced effects on the anodic reaction (metal dissolution). See M. A. Quraishi, A. Singh, V. K. Singh, D. K. Yadav, A. K. Singh, Green approach to corrosion inhibition of mild steel in hydrochloric acid and sulphuric acid solutions by the extract of *Murraya koenigii* leaves, Materials Chemistry and Physics, 122 (2010) 114-122; and A. K. Singh, Inhibition of Mild Steel Corrosion in Hydrochloric Acid Solution by 3-(4-((Z)-Indolin-3-ylideneamino)phenylimino)indolin-2-one, Industrial & Engineering Chemistry Research, 51 (2012) 3215-3223, each incorporated herein by reference in their entirety. An efficiency of 99.4% was achieved at 25° C. in the presence of 100 ppm PUCorr-2, while at elevated temperature (60° C.) where there is less dissolved oxygen, an efficiency of 99.9% was recorded at 100 ppm. Similar corrosion tests were conducted in saline medium (0.5 M NaCl) and the results shown in FIGS. 7A-7E and Table 2 further demonstrate the propensity of PUCorr-2 to serve as inhibitor of mild steel corrosion in both acidic and saline media.

TABLE 1

Tafel polarization data of mild steel in 1.0M HCl

| Temperature (K) | Medium | Inhibitor Conc. (ppm) | $E_{corr}$/V vs SCE | $i_{corr}$ ($\mu A \cdot cm^{-2}$) | Corrosion rate (mmpy) | θ | η% |
|---|---|---|---|---|---|---|---|
| 298 | Blank | 0 | −0.512 | 301.1 | 3.43 | — | — |
| | PUCorr-2 | 20 | −0.466 | 69.0 | 0.88 | 0.771 | 77.1 |
| | | 50 | −0.443 | 9.2 | 0.10 | 0.969 | 97.1 |
| | | 100 | −0.449 | 2.1 | 0.02 | 0.993 | 99.3 |
| 303 | Blank | 0 | −0.539 | 470.2 | 5.46 | — | — |
| | PUCorr-2 | 20 | −0.500 | 18.2 | 0.22 | 0.961 | 96.1 |
| | | 50 | −0.467 | 13.3 | 0.16 | 0.972 | 97.2 |
| | | 100 | −0.433 | 1.2 | 0.05 | 0.997 | 99.7 |
| 313 | Blank | 0 | −0.542 | 3070.3 | 35.56 | — | — |
| | PUCorr-2 | 20 | −0.499 | 8.5 | 0.08 | 0.997 | 99.7 |
| | | 50 | −0.450 | 5.1 | 0.06 | 0.998 | 99.8 |
| | | 100 | −0.500 | 5.0 | 0.06 | 0.998 | 99.8 |
| 323 | Blank | 0 | −0.521 | 4400.5 | 51.08 | — | — |
| | PUCorr-2 | 20 | −0.492 | 28.5 | 0.32 | 0.994 | 99.4 |
| | | 50 | −0.504 | 21.3 | 0.25 | 0.995 | 99.5 |
| | | 100 | −0.489 | 5.2 | 0.07 | 0.999 | 99.9 |
| 333 | Blank | 0 | −0.504 | 8430.2 | 96.5 | — | — |
| | PUCorr-2 | 20 | −0.528 | 10.6 | 0.04 | 0.998 | 99.8 |
| | | 50 | −0.561 | 1.5 | 0.01 | 0.999 | 99.9 |
| | | 100 | −0.551 | 1.5 | 0.01 | 0.999 | 99.9 |

TABLE 2

Tafel polarization data of mild steel in 0.5M NaCl

| Temperature (K) | Medium | Inhibitor Conc. (ppm) | $E_{corr}$/V vs SCE | $i_{corr}$ ($\mu A \cdot cm^{-2}$) | Corrosion rate (mmpy) | θ | η% |
|---|---|---|---|---|---|---|---|
| 298 | Blank | 0 | −0.749 | 30.30 | 0.403 | — | — |
| | PUCorr-2 | 20 | −0.821 | 5.98 | 0.069 | 0.829 | 82.9 |
| | | 50 | −0.727 | 3.37 | 0.039 | 0.903 | 90.3 |
| | | 100 | −0.727 | 3.05 | 0.022 | 0.945 | 94.5 |
| 303 | Blank | 0 | −0.730 | 45.40 | 0.527 | — | — |
| | PUCorr-2 | 20 | −0.758 | 4.66 | 0.054 | 0.898 | 89.8 |
| | | 50 | −0.727 | 2.91 | 0.034 | 0.935 | 93.5 |
| | | 100 | −0.601 | 1.92 | 0.028 | 0.947 | 94.7 |
| 313 | Blank | 0 | −0.713 | 33.20 | 0.385 | — | — |
| | PUCorr-2 | 20 | −0.807 | 4.25 | 0.049 | 0.873 | 87.3 |
| | | 50 | −0.720 | 2.11 | 0.024 | 0.938 | 93.8 |
| | | 100 | −0.693 | 1.97 | 0.022 | 0.943 | 94.3 |

TABLE 2-continued

Tafel polarization data of mild steel in 0.5M NaCl

| Temperature (K) | Medium | Inhibitor Conc. (ppm) | $E_{corr}$/V vs SCE | $i_{corr}$ ($\mu A \cdot cm^{-2}$) | Corrosion rate (mmpy) | θ | η% |
|---|---|---|---|---|---|---|---|
| 323 | Blank | 0 | −0.747 | 39.70 | 0.461 | — | — |
| | PUCorr-2 | 20 | −0.759 | 1.62 | 0.019 | 0.959 | 95.9 |
| | | 50 | −0.738 | 1.03 | 0.012 | 0.974 | 97.4 |
| | | 100 | −0.688 | 0.73 | 0.008 | 0.983 | 98.3 |
| 333 | Blank | 0 | −0.780 | 54.20 | 0.630 | — | — |
| | PUCorr-2 | 20 | −0.793 | 3.18 | 0.037 | 0.941 | 94.1 |
| | | 50 | −0.726 | 1.63 | 0.019 | 0.970 | 97.0 |
| | | 100 | −0.623 | 0.45 | 0.005 | 0.992 | 99.2 |

Kinetics and characteristics of the electrochemical processes occurring at the steel/solution interface in the presence of PUCorr-2 was further investigated using electrochemical impedance spectroscopy (EIS) technique. The dominating part in this process is believed to be a charge transfer reaction occurring at the metal/solution interface as implied by the Nyquist and Bode plots (FIG. 8A-8D) which are characterized by single depressed semi-circles. See C. Verma, L. O. Olasunkanmi, E. E. Ebenso, M. A. Quraishi, I. B. Obot; Adsorption Behavior of Glucosamine-Based, Pyrimidine-Fused Heterocycles as Green Corrosion Inhibitors for Mild Steel: Experimental and Theoretical Studies, The Journal of Physical Chemistry C, 120 (2016) 11598-11611, incorporated herein by reference in its entirety. In addition, the depressed single capacitive loop has been attributed to surface heterogeneity due to the adsorbed inhibitors through a surface coverage mechanism. See R. Solmaz, Investigation of corrosion inhibition mechanism and stability of Vitamin B1 on mild steel in 0.5M HCl solution, Corrosion Science, 81 (2014) 75-84, incorporated herein by reference in its entirety. Furthermore, an increase in diameter of the semi-circle was observed with increasing inhibitor concentration due to increase in the surface coverage on the metal. Bode plots also revealed the effect of the addition of the inhibitor at the lower frequency modulus as the low frequency impedance increases with the increase in inhibitor concentration, which has also being attributed to the adsorption of the inhibitor molecules onto the exposed steel surface. See Z. Cao, Y. Tang, H. Cang, J. Xu, G. Lu, W. Jing, Novel benzimidazole derivatives as corrosion inhibitors of mild steel in the acidic media. Part II: Theoretical studies, Corrosion Science, 83 (2014) 292-298, incorporated herein by reference in its entirety. In the absence of the inhibitor, the mild steel specimen corroded freely without a resistive barrier giving rise to a large double layer capacitance, $C_d$ and a lower polarization resistance, $R_p$ (the resistance of the specimen to corrosion), as shown in Table 3. When the inhibitor was introduced, however, a drop in $C_{dl}$ values and a corresponding increase in $R_p$ were noticed. This is because in the presence of the inhibitor, the charge transfer processes leading to the corrosion of the metal was prevented by adsorbed inhibitor films. See Cao et al. Values obtained from EIS measurements correlates with those obtained from Tafel polarization measurements.

TABLE 3

EIS data of mild steel in 0.5M NaCl

| Temperature (K) | Medium | Inhibitor conc. (ppm) | $R_s$ ($\Omega \cdot cm^2$) | $R_p$ ($\Omega \cdot cm^2$) | $C_{dl}$ ($\mu F \cdot cm^{-2}$) | n | η% |
|---|---|---|---|---|---|---|---|
| 298 | Blank | 0 | 0.869 | 56.14 | 28.30 | 0.74 | — |
| | PUCorr-2 | 20 | 1.073 | 326.20 | 9.70 | 0.79 | 82.8 |
| | | 50 | 1.081 | 461.40 | 11.50 | 0.80 | 87.9 |
| | | 100 | 1.099 | 561.20 | 15.20 | 0.80 | 90.0 |
| 333 | Blank | 0 | 0.890 | 16.38 | 48.80 | 0.90 | — |
| | PUCorr-2 | 20 | 1.362 | 261.4 | 24.30 | 0.83 | 93.7 |
| | | 50 | 1.099 | 530.3 | 7.69 | 0.80 | 96.9 |
| | | 100 | 1.104 | 635.0 | 7.80 | 0.80 | 97.4 |

Furthermore, corrosion inhibitive performance of PUCorr-2 was investigated under severe simulated condition in the presence of $CO_2$ gas. This is because $CO_2$ gas contributes significantly in accelerating pipeline corrosion in oil and gas industries. During exploration and transportation, complex mixtures of liquids and gases may be carried along in close contact with the inner surface of the steel pipelines leading to its deterioration. Under such conditions having an effective inhibitor capable of preventing direct contact between the corrosive gases and the steel surface is one of the best strategies utilized to prevent pipeline failures. See M. E. Olvera-Martinez, J. Mendoza-Flores, J. Genesca, CO2 corrosion control in steel pipelines. Influence of turbulent flow on the performance of corrosion inhibitors, Journal of Loss Prevention in the Process Industries, 35 (2015) 19-28, incorporated herein by reference in its entirety. To study the corrosion inhibitive performance of PuCorr-2 in the presence of $CO_2$ gas, Tafel polarization measurements were conducted in 0.5 M NaCl. Prior to the measurements, $N_2$ gas (99.999%) was purged into the electrolyte solution (0.5 M NaCl) for 30 min to maintain an anoxic (oxygen-free) condition. This was followed by purging high purity $CO_2$ gas (99.995%) for 30 min to remove all dissolved oxygen before commencement of measurements. The complete removal of oxygen and saturation of the solution with $CO_2$ were achieved when an open circuit potential became stable and, thereafter, Tafel polarization measurements were carried out. In the presence of $CO_2$ gas, the overall reaction leading to mild steel deterioration can be summarized as shown in eq. 3. See Y. Zhang, X. Pang, S. Qu, X. Li, K. Gao, Discussion of the CO2 corrosion mechanism between low partial pressure and supercritical condition, Corrosion Science, 59 (2012) 186-197, incorporated herein by reference in its entirety.

$$Fe+CO_2+H_2O \rightarrow FeCO_3+H_2 \quad (3)$$

In addition to formation of $FeCO_3$ scale, other products such as $Fe_3O_4$ are formed which depending on the environmental conditions, can be protective or non-protective. However, since the rate of formation of $Fe^{2+}$ species precedes the above processes, it is obvious that the presence of adsorbed polymer films which block the active corrosion sites would lead to a corresponding decrease in the corrosion rate. See J. Zhao, H. Duan, R. Jiang, Synergistic corrosion inhibition effect of quinoline quaternary ammonium salt and Gemini surfactant in H2S and CO2 saturated brine solution, Corrosion Science, 91 (2015) 108-119, incorporated herein by reference in its entirety. This can be noticed from the Tafel polarization curves (FIGS. 9A-9D) and the corresponding extrapolated data (Table 4) that the addition of PUCorr-2 in saline solutions saturated with $CO_2$ led to a decrease in the anodic current as well as an increase in the corrosion resistance of the mild steel specimen. With increasing temperature corrosion resistance in the presence of PUCorr-2 further increases due to increased formation of protective scales of iron carbonate and enhanced adsorption of the inhibitor molecules. Excellent inhibition efficiency of 99.5% (Table 4) was achieved in saline media saturated with $CO_2$ in the presence of 100 ppm PUCorr-2.

TABLE 4

Tafel polarization data of mild steel in 0.5M NaCl saturated with $CO_2$

| Temperature (K) | Medium | Inhibitor Conc. (ppm) | $E_{corr}$/V vs SCE | $i_{corr}$ ($\mu A \cdot cm^{-2}$) | Corrosion rate (mmpy) | θ | η% |
|---|---|---|---|---|---|---|---|
| 298 | Blank | 0 | −0.752 | 137.0 | 1.592 | — | — |
| | PUCorr-2 | 50 | −0.737 | 22.60 | 0.262 | 0.835 | 83.5 |
| | | 100 | −0.729 | 15.70 | 0.183 | 0.885 | 88.5 |
| 303 | Blank | 0 | −0.744 | 182.0 | 2.112 | — | — |
| | PUCorr-2 | 50 | −0.745 | 20.10 | 0.233 | 0.889 | 88.9 |
| | | 100 | −0.748 | 1.15 | 0.013 | 0.994 | 99.4 |
| 313 | Blank | 0 | −0.756 | 154.0 | 1.790 | — | — |
| | PUCorr-2 | 50 | −0.743 | 18.80 | 0.218 | 0.877 | 87.7 |
| | | 100 | −0.749 | 0.37 | 0.004 | 0.997 | 99.7 |
| 323 | Blank | 0 | −0.767 | 242.0 | 2.809 | — | — |
| | PUCorr-2 | 50 | −0.748 | 21.30 | 0.247 | 0.912 | 91.2 |
| | | 100 | −0.749 | 1.19 | 1.19 | 0.995 | 99.5 |

Figure 10A:
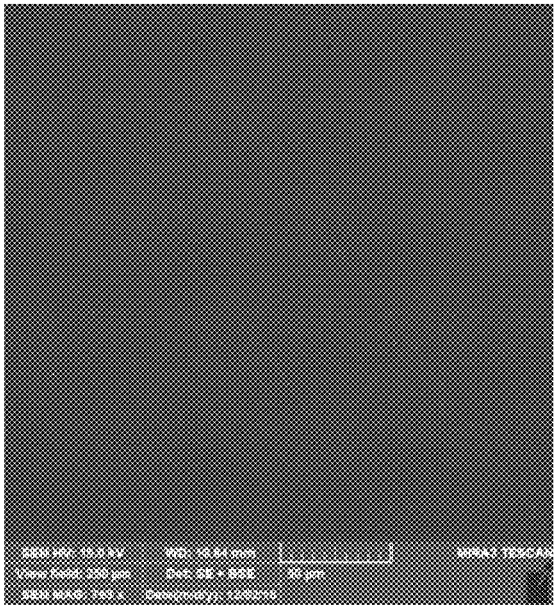
FIGS. 10A-10D illustrate SEM micrographs of mild steel specimen (FIG. 10A) before immersion in 0.5 M NaCl, (FIG. 10B) after immersion in 0.5 M NaCl without inhibitor, (FIG. 10C) after immersion in 0.5 M NaCl saturated with $CO_2$ without inhibitor and (FIG. 10D) after immersion in 0.5 M NaCl in the presence of 100 ppm PUCorr-2 at 298 K for 24 h.
Figure 10B:
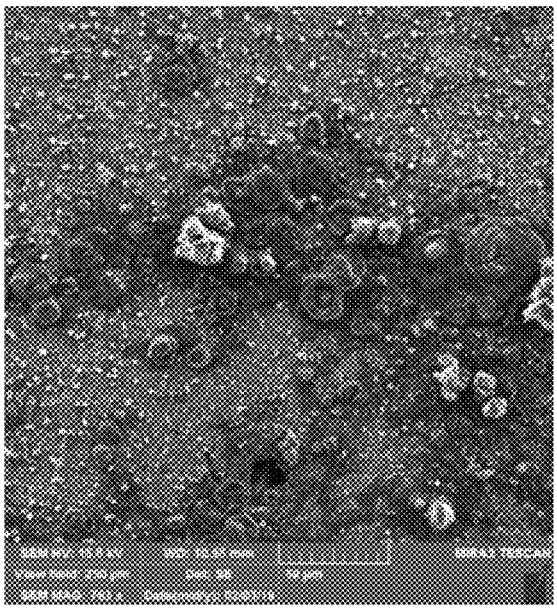
Figure 10C:
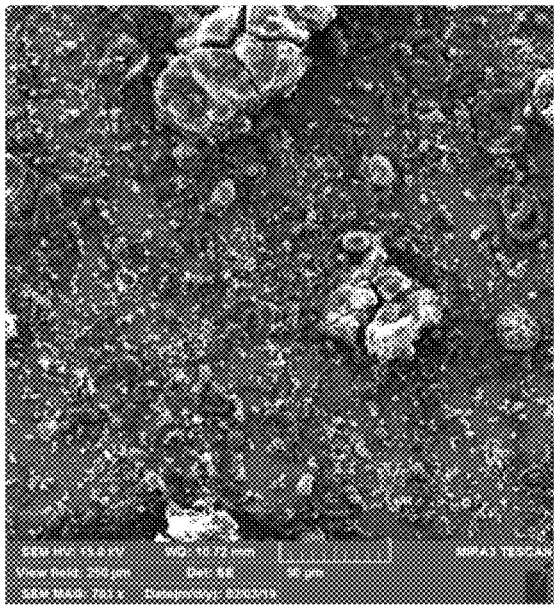
Figure 10D:
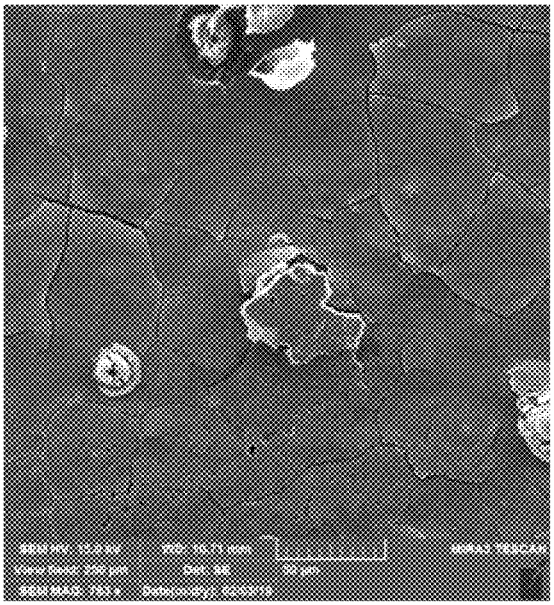

To further investigate the corrosion inhibitive action of PUCorr-2, mild steel specimens were immersed in 0.5 M NaCl in the absence and presence of 100 ppm PUCorr-2 at 25° C. for 24 h. The specimens were then rinsed with anhydrous ethanol, dried in a stream of nitrogen and SEM micrographs were recorded as shown in FIGS. 10A-10D. Morphological features of specimen immersed in 0.5 M NaCl (FIG. 10B) showed evidence of severe corrosion as compared to the bare specimen (FIG. 10A). With further addition of $CO_2$ (FIG. 10C), there was further formation of corrosion products on the metal surface. However, on the specimen containing 100 ppm PUCorr-2 (FIG. 10D) these corrosion products were absent and the surface of the metal appeared covered by the adsorbed inhibitor molecules. This clearly demonstrates the corrosion inhibitive performance of PUCorr-2 in saline media.

Figure 11A:
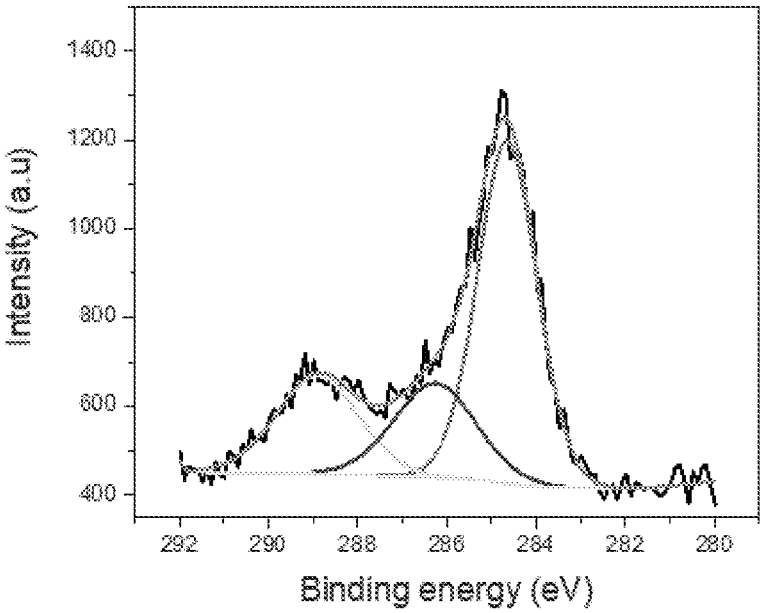
FIGS. 11A-11D are graphs illustrating the high resolution (FIG. 11A) C Is, (FIG. 11B) Cl2p, (FIG. 11C) O1s and (FIG. 11D) Fe2p spectra of mild steel specimen immersed in 0.5 M NaCl saturated with $CO_2$ in the absence of inhibitor molecule.
Figure 11B:
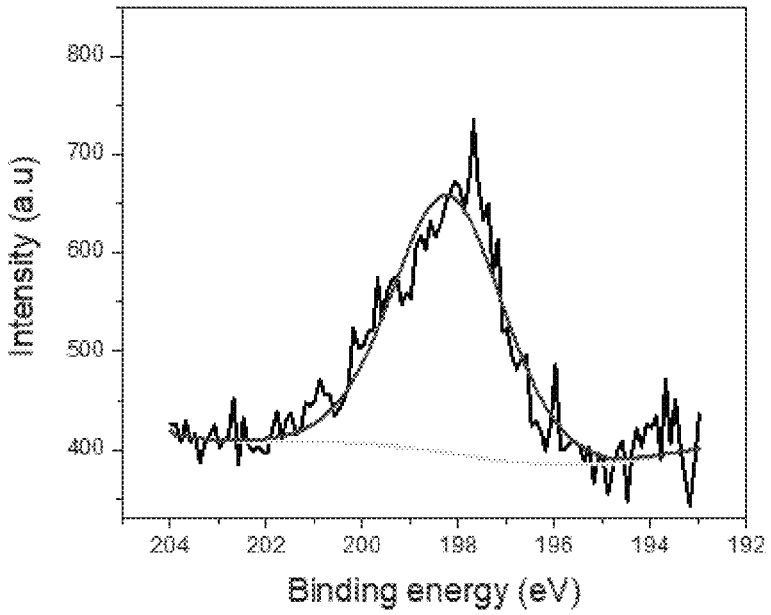
Figure 11C:
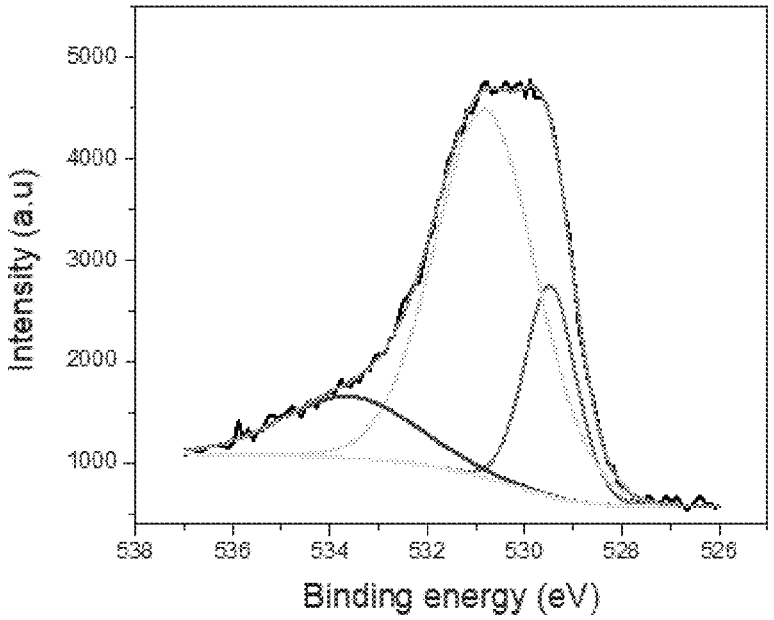
Figure 11D:
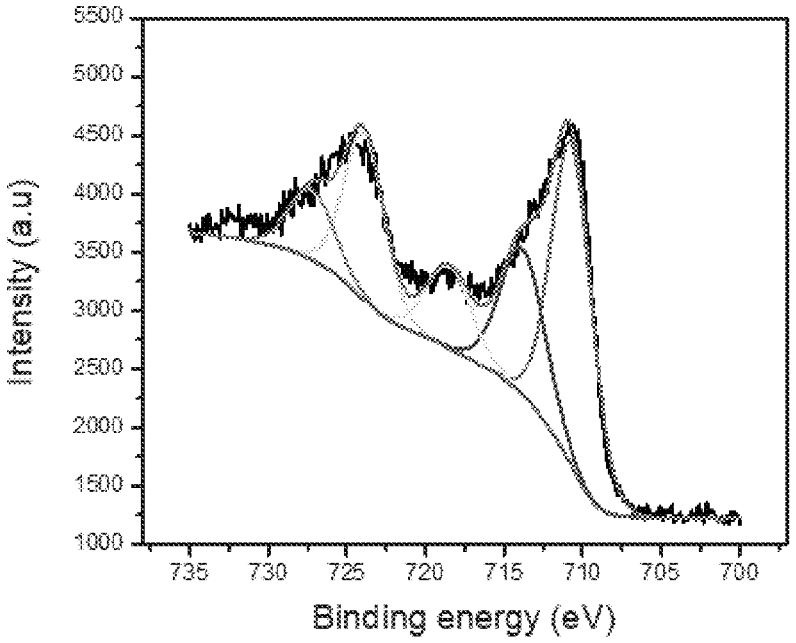
Figure 12A:
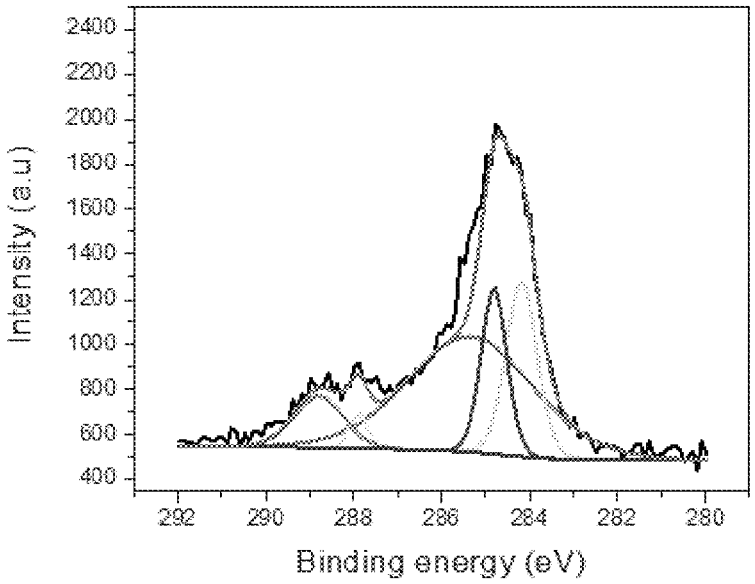
FIGS. 12A-12D are graphs illustrating the high resolution (FIG. 12A) C1s, (FIG. 12B) N1s, (FIG. 12C) O1s and (FIG. 12D) Fe2p spectra of mild steel specimen immersed in 0.5 M NaCl saturated with $CO_2$ in the absence of inhibitor molecule.
Figure 12B:
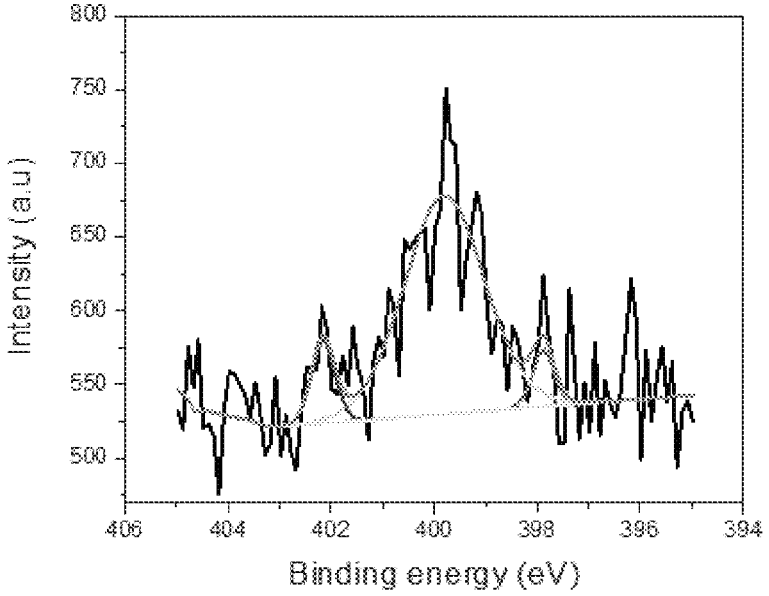
Figure 12C:
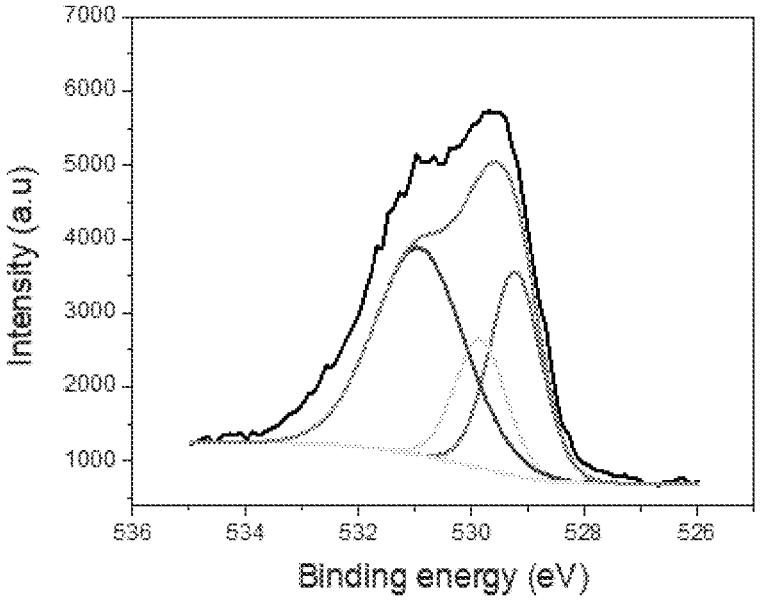
Figure 12D:
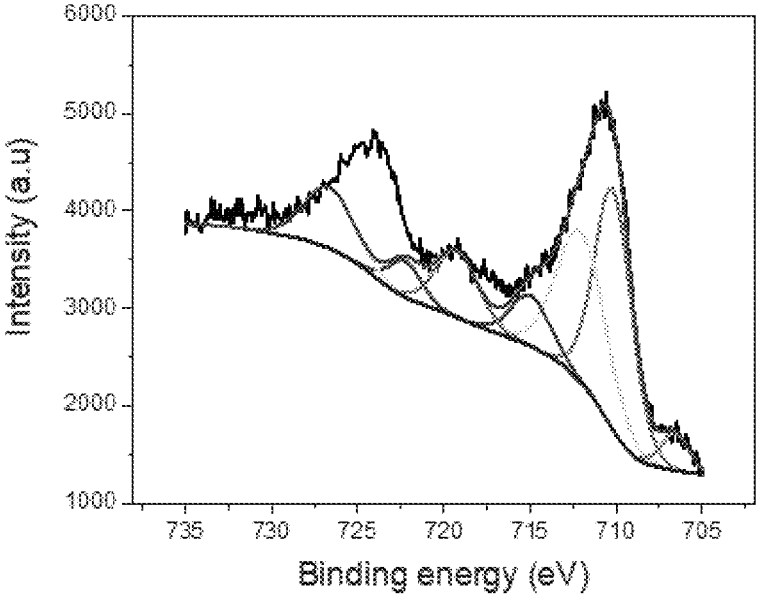
Figure 13A:
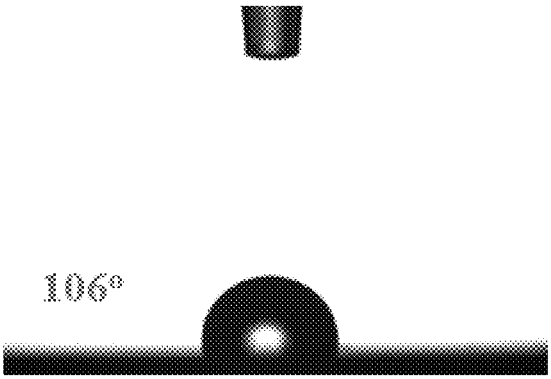
FIGS. 13A-13E illustrate the water droplet contact angle of (FIG. 13A) bare mild steel, (FIG. 13B) mild steel specimen immersed in 0.5 M NaCl in the absence of PUCorr-2, (FIG. 13C) mild steel specimen immersed in 0.5 M NaCl containing 20 ppm PUCorr-2, (FIG. 13D) mild steel specimen immersed in 0.5 M NaCl containing 50 ppm PUCorr-2, and (FIG. 13E) mild steel specimen immersed in 0.5 MNaCl containing 100 ppm PUCorr-2.
Figure 13B:
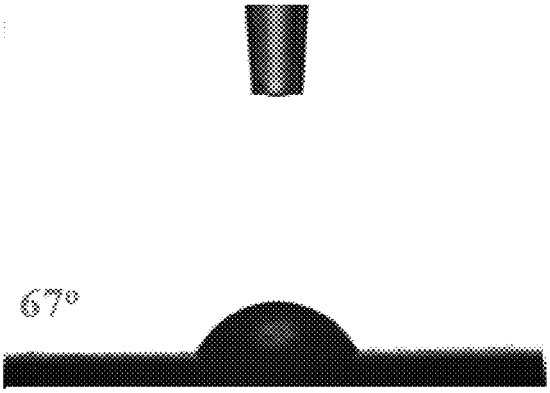
Figure 13C:
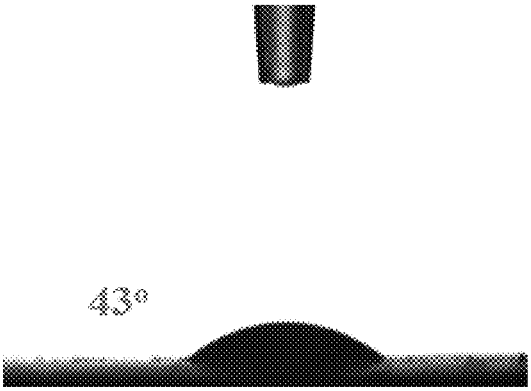
Figure 13D:
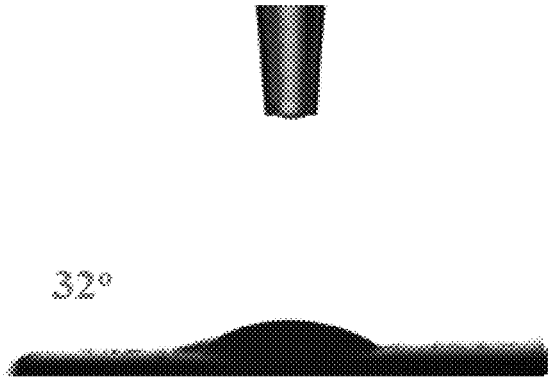
Figure 13E:
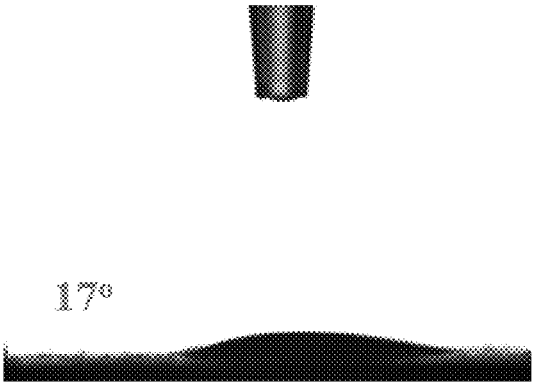

Elemental composition of the adsorbed inhibitor molecules on mild steel specimen were further investigated by x-ray photoelectron spectroscopy (XPS) analysis. High resolution XPS spectra of mild steel specimen immersed in 0.5 M NaCl saturated with $CO_2$ in the absence of inhibitor molecules are presented in FIGS. 11A-11D. The C1s spectrum after deconvolution (FIG. 11A) was fitted into three distinct peaks at 284.5 eV, 286.2 eV and 289.0 eV. The peak at 284.5 eV was assigned to $sp^2$ carbon atoms, while the peaks at 286.2 eV and 289.0 eV were assigned to C—O and O—C═O, respectively. See R. Sadri, M. Hosseini, S. N. Kazi, S. Bagheri, N. Zubir, K. H. Solangi, T. Zaharinie, A. Badarudin, A bio-based, facile approach for the preparation of covalently functionalized carbon nanotubes aqueous suspensions and their potential as heat transfer fluids, Journal of Colloid and Interface Science, 504 (2017) 115-123, incorporated herein by reference in its entirety. The Cl2p spectrum (FIG. 11B) was fitted into a single peak at 198.5 eV corresponding to alkali chloride present on the surface of the metal. The O1s spectrum after deconvolution gave three distinct peaks at 529.0 eV, 531.0 eV and 534.0 eV (FIG. 11C). The peak at 529.0 eV was assigned to iron (II) in the form of FeO, while the peaks at 531.0 eV and 534.0 eV represents surface oxygens as a result of water chemisorption to form $Fe(OH)_2$, and carbonyl oxygen of the carbonate, respectively. See Sadri et al.; and D. K. Bandgar, S. T. Navale, M. Naushad, R. S. Mane, F. J. Stadler, V. B. Patil, Ultra-sensitive polyaniline-iron oxide nanocomposite room temperature flexible ammonia sensor, RSC Advances, 5 (2015) 68964-68971, each incorporated herein by reference in their entirety. Fe2p spectrum (FIG. 11D) consists of three peaks at 711.0 eV ($Fe2p_{3/2}$), 725.0 eV ($Fe2pu_{1/2}$) and a satellite peak at 719.0 eV representing $\alpha$-$Fe_2O_3$. See M.-H. Pham, C.-T. Dinh, G.-T. Vuong, N.-D. Ta, T.-O. Do, Visible light induced hydrogen generation using a hollow photocatalyst with two cocatalysts separated on two surface sides, Physical Chemistry Chemical Physics, 16 (2014) 5937-5941, incorporated herein by reference in its entirety. The fitted Fe2p spectrum reveals the presence of Fe in the ferric (712.5 eV) and ferrous (710.0 eV) forms almost at the same proportion. The presence of the ferric species is due to the oxidation of ferrous species of iron during the course of corrosion of the steel specimen. As for mild steel specimen immersed in 0.5 M NaCl saturated with $CO_2$ in the presence of the inhibitor (FIGS. 12A-12D), the C1s spectrum (FIG. 12A) in addition to the already assigned peaks in the blank solution gave two additional peaks at 285.0 eV and 288.0 eV corresponding to C—OH and C═O, respectively. The N1s spectrum (FIG. 12B) was fitted into three peaks at 398.0 eV, 400.0 eV and 402.0 eV which were assigned to pyridinic, pyrrolic and graphitic nitrogen atoms, respectively. See F. Pan, J. Jin, X. Fu, Q. Liu, J. Zhang, Advanced Oxygen Reduction Electrocatalyst Based on Nitrogen-Doped Graphene Derived from Edible Sugar and Urea, ACS Applied Materials & Interfaces, 5 (2013) 11108-11114, incorporated herein by reference in its entirety. The O1s spectrum (FIG. 12C) also gave peaks similar to that of the blank specimen with an additional peak at 530.0 eV which represents characteristic peak of $\alpha$-$Fe_2O_3$, while the Fe2p spectrum (FIG. 12D) gave characteristic peaks similar to that of the blank specimen. See Bandgar et al. The overall XPS data confirms the adsorption of PUCorr-2 onto mild steel specimen and is in agreement with other experimental results.

Figure 14:
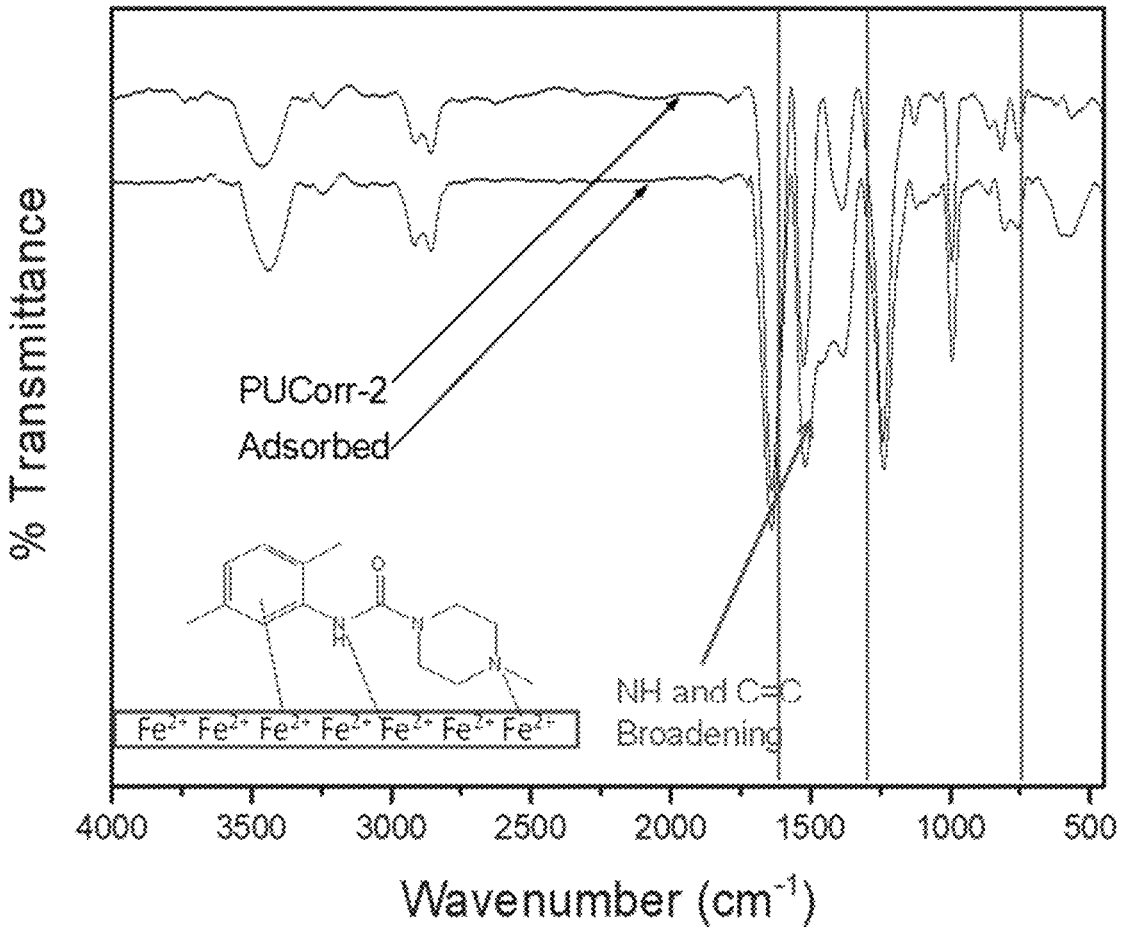
FIG. 14 is a graph illustrating the FT-IR spectra of PUCorr-2 and adsorbed species.

To investigate the change in surface characteristics of the mild steel as a result of adsorption of PUCorr-2, contact angle measurements were carried out on a specimen immersed in 0.5 M NaCl with and without PUCorr-2 for 24 h (FIGS. 13A-13E). The results showed the presence of adsorbed hydrophilic PUCorr-2 films on the mild steel surface as the wettability features changes significantly yielding contact angles of 106° (bare steel), 67° (steel immersed in 0.5 M NaCl), and 43°, 320 and 17° for specimen immersed in 0.5 M NaCl containing 20 ppm, 50 ppm and 100 ppm PUCorr-2, respectively. Furthermore, the thin adsorbed film was scratched off and subjected to FT-IR analysis (FIG. 14). The results revealed the presence of adsorbed polymer species on the mild steel specimen as vibrational bands assigned to the functional groups in PUCorr-2 appeared in the adsorbed specie. In addition, the —NH bend and/or C═C stretch band at 1550 $cm^{-1}$ appeared broadened in the adsorbed specie due to bonding to Fe ions. See S. A. Rounaghi, D. E. P. Vanpoucke, H. Eshghi, S. Scudino, E. Esmaeili, S. Oswald, J. Eckert, Mechanochemical synthesis of nanostructured metal nitrides, carbonitrides and carbon nitride: a combined theoretical and experimental study, Physical Chemistry Chemical Physics, 19 (2017) 12414-12424, incorporated herein by reference in its entirety. Furthermore, the —NH wag absorption band at 650 $cm^{-1}$ also appeared broadened and increased in intensity. Results from adsorption and spectroscopic studies, therefore, suggest that PUCorr-2 forms a chemically adsorbed thin film on mild steel, serving as a firm barrier which isolates the metal from the corrosive medium and leads to a decrease in corrosion attack.

Figure 15A:
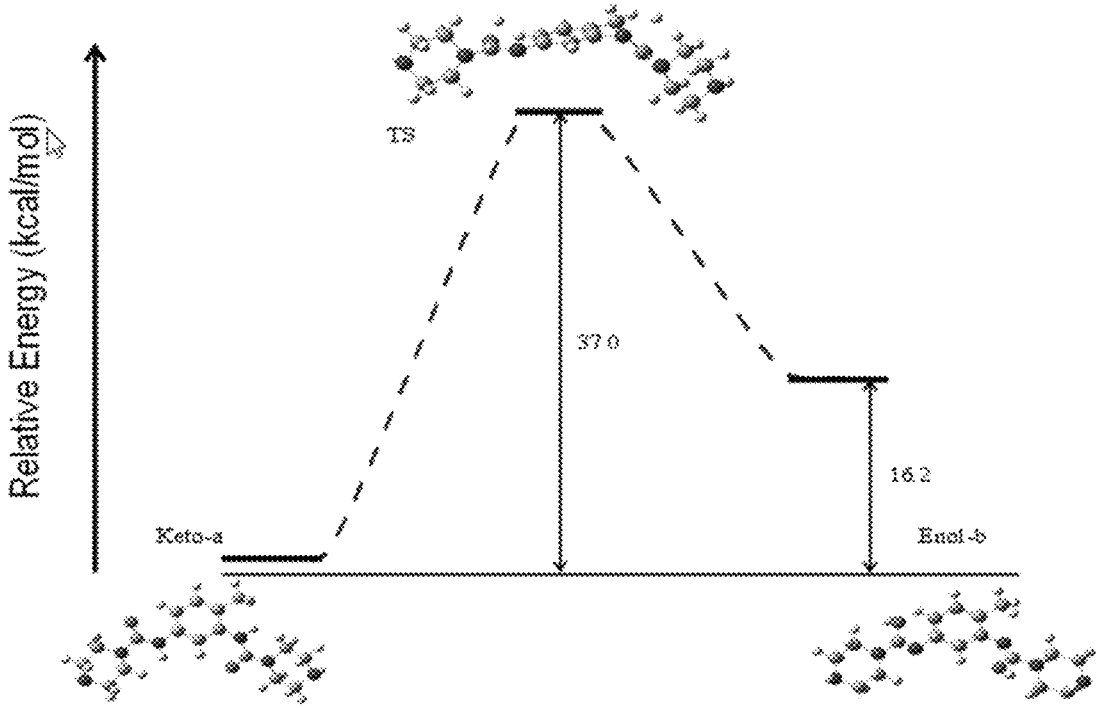
FIG. 15A illustrates the proposed step-wise keto-enol tautomerization of PUCorr-2 prior to adsorption onto metal surface.
Figure 15B:
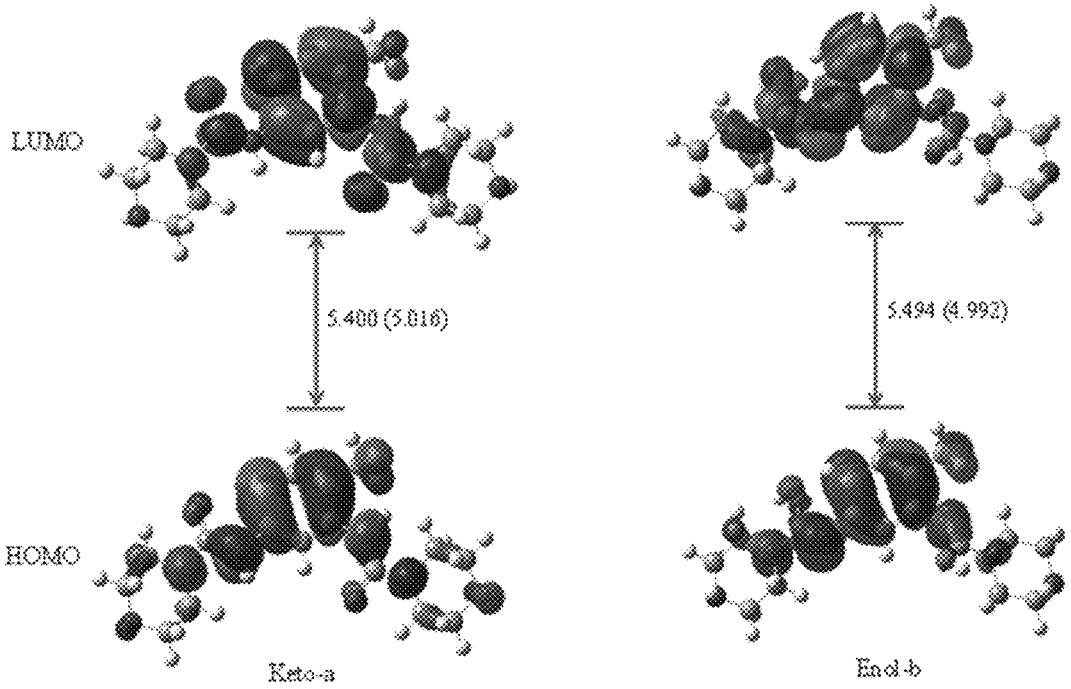
FIG. 15B illustrates the frontier orbital distribution across the molecules where values in parenthesis represent protonated molecules.

Conformational properties and stabilities of the tautomeric forms of PUCorr-2 before and during interaction with atoms of the metal to form inhibitor-metal complex was further investigated using DFT calculations. Although the tautomeric forms of the inhibitor displays comparable stabilities, the keto tautomer was predicted to be more stable by a factor of around 16 kcal/mol as shown in FIG. 15A. This implies that although the preferred geometry of PUCorr-2 in an un-complexed form is the keto-a form, it undergoes an intra-molecular proton transfer to form the enol-b tautomer prior to adsorption on the metal surface, as evidenced from XPS analysis results. Furthermore, molecular properties of the molecules were investigated to gain insight into the possible reactivities of the tautomers and to relate their donor-acceptor properties to PUCorr-2 corrosion potential. It is generally believed that charge transfer properties of any given molecule are a function of the spatial orientation of its frontier orbitals and the energy gap maintained therein. Frontier orbital analysis of the molecules (FIG. 15B) showed that the HOMO-LUMO orbitals were fairly distributed across the molecules, while the electron density around the phenyl and nitrogen fragments predicts more interactions with atoms of the metal within these sites. See I. Abdulazeez, C. Basheer, A. A. Al-Saadi, Selective colorimetric sensing of nickel (II) ions using 2-hydroxy-5-nitrobenzaldehyde-4-hydroxybenzoylhydrazone ligand: Spectroscopic and DFT insights, Journal of Molecular Liquids, 264 (2018) 58-65; and I. Abdulazeez, C. Basheer, A. A. Al-Saadi, A selective detection approach for copper(ii) ions using a hydrazone-based colorimetric sensor: spectroscopic and DFT study, RSC Advances, 8 (2018) 39983-39991, each incorporated herein by reference in their entirety. Other reactivity descriptors (Table 5) such as electronegativity ($\chi$), global hardness ($\eta$), electrophilicity ($\omega$) and fraction of transferred electrons ($\Delta N$) further indicated that whereas in a neutral medium, keto-a exhibit higher tendency towards corrosion inhibition, a greater fraction of the inhibitive properties of PUCorr-2 in acidic medium comes from enol-b tautomer. See I. Obot, S. Umoren, Z. Gasem, R. Suleiman, B. El Ali, Theoretical prediction and electrochemical evaluation of vinylimidazole and allylimidazole as corrosion inhibitors for mild steel in 1M HCl, Journal of Industrial and Engineering Chemistry, 21 (2015) 1328-1339; and P. Singh, E. E. Ebenso, L. O. Olasunkanmi, I. B. Obot, M. A. Quraishi, Electrochemical, Theoretical, and Surface Morphological Studies of Corrosion Inhibition Effect of Green Naphthyridine Derivatives on Mild Steel in Hydrochloric Acid, The Journal of Physical Chemistry C, 120 (2016) 3408-3419, each incorporated herein by reference in their entirety.

TABLE 5

Quantum chemical reactivity descriptors of inhibitor at B3LYP/6-31G(d)

| | Non-protonated | | Protonated | |
|---|---|---|---|---|
| Parameter | Keto-a | Enol-b | Keto-a | Enol-b |
| $E_{HOMO}$ (eV) | −5.510 | −5.407 | −6.170 | −6.112 |
| $E_{LUMO}$ (eV) | −0.109 | 0.087 | −1.153 | −1.120 |
| $\Delta E$ (eV) | 5.400 | 5.494 | 5.016 | 4.992 |
| $\eta$ (eV) | 2.700 | 2.747 | 2.508 | 2.496 |
| $\chi$ (eV) | 2.810 | 2.660 | 3.662 | 3.616 |
| $\omega$ (eV) | 1.462 | 1.288 | 2.673 | 2.620 |
| $\Delta N$ | 0.776 | 0.790 | 0.665 | 0.678 |

A piperazine-based polyurea (PUCorr-2) was successfully synthesized and investigated for the corrosion inhibition of mild steel in acidic and saline media. Quantum chemical DFT calculations revealed that the polymer maintains high electron density across its structural network and on the nitrogen, oxygen and the pi-system. Electrochemical corrosion tests, supported with surface characterization studies revealed that PUCorr-2 adsorbs onto mild steel yielding a stable film through chemisorption mechanism. Corrosion resistance of mild steel was observed to increase with increasing PUCorr-2 concentration and increasing temperature with excellent inhibition efficiencies of 99.9% and 99.2% in acidic and saline media, respectively. In the presence of $CO_2$ gas, PUCorr-2 exhibited remarkable inhibition efficiency (99.5%) making it a potential corrosion inhibitor in aggressive industrial environments.

The invention claimed is:

1. A method of inhibiting corrosion of metal in contact with a corrosive medium, the method comprising:

introducing a formulation comprising a polyurea into the corrosive medium in contact with the metal, wherein the polyurea comprises reacted units of a piperazine having at least two reactive amine groups and a diisocyanate, wherein the polyurea is introduced into the corrosive medium at a concentration of 1 to 250 ppm, wherein the polyurea has a weight average molecular weight of 20 to 30 kDa and a polydispersity index of 1.1 to 1.8, and wherein the polyurea is in the form of microparticles having an average diameter of 10 to 50 μm.

2. The method of claim 1, wherein the piperazine is at least one selected from the group consisting of piperazine, 2-methylpiperazine, 2-ethylpiperazine, 2,3-dimethylpiperazine, 2,2-dimethylpiperazine, 2,5-dimethylpiperazine, 2,6-dimethylpiperazine, and 1-(2-aminoethyl)piperazine.

3. The method of claim 1, wherein the piperazine is piperazine.

4. The method of claim 1, wherein the diisocyanate is toluene 2,4-diisocyanate, toluene 2,6-diisocyanate, or a mixture of toluene 2,4-diisocyanate and toluene 2,6-diisocyanate, and when the diisocyanate is the mixture, a molar ratio of the toluene 2,4-diisocyanate to the toluene 2,6-diisocyanate is 1:1 to 50:1.

5. The method of claim 1, wherein the polyurea is formed with a molar ratio of the piperazine to the diisocyanate of 1:1 to 4:1.

6. The method of claim 1, wherein the microparticles are macroporous with an average macropore size of 400 to 600 nm.

7. The method of claim 1, wherein the microparticles have a BET surface area of 30 to 350 $m^2/g$.

8. The method of claim 1, wherein:

the formulation further comprises at least one polar aprotic solvent selected from the group consisting of N-methyl-2-pyrrolidone, dimethylformamide, dimethyl sulfoxide, and 1,3-dimethyl-2-imidazolidinone, and a volume ratio of the polar aprotic solvent to the corrosive medium is 1:80 to 1:200.

9. The method of claim 1, wherein the formulation further comprises at least one additive selected from the group consisting of a viscosity modifying agent, a chelating agent, a stabilizing agent, a dispersing agent, a supplemental corrosion inhibitor, a scale inhibitor, a defoaming agent, and an emulsifier.

10. The method of claim 1, wherein the formulation is substantially free of a binder.

11. The method of claim 1, wherein the metal is not pre-coated with the formulation.

12. The method of claim 1, wherein the metal is mild steel.

13. The method of claim 1, wherein the corrosive medium has a pH of 0 to 7.

14. The method of claim 1, wherein the corrosive medium comprises at least one acid selected from the group consisting of hydrochloric acid, sulfuric acid, nitric acid, hydrofluoric acid, acetic acid, and formic acid.

15. The method of claim 1, wherein the corrosive medium comprises carbon dioxide.

16. The method of claim 1, wherein the corrosive medium has a total dissolved solids content of 10,000 to 400,000 mg/L.

17. The method of claim 1, wherein the corrosive medium is a water-oil mixture.

18. The method of claim 1, wherein the corrosive medium has a temperature of 20 to 80° C.

* * * * *